US011322898B2

(12) United States Patent
Cowham et al.

(10) Patent No.: US 11,322,898 B2
(45) Date of Patent: May 3, 2022

(54) METHODS AND SYSTEMS FOR A MODULAR PLUG-IN BUS WIRING SYSTEM

(71) Applicants: Walter Morgan Cowham, Quincy, MA (US); Jeremy Charles Cowham, Quincy, MA (US)

(72) Inventors: Walter Morgan Cowham, Quincy, MA (US); Jeremy Charles Cowham, Quincy, MA (US)

(73) Assignee: Cowham Innovations, LLC, Quincy, MA (US)

( * ) Notice: Subject to any disclaimer, the term of this patent is extended or adjusted under 35 U.S.C. 154(b) by 187 days.

(21) Appl. No.: 16/793,187

(22) Filed: Feb. 18, 2020

(65) Prior Publication Data

US 2020/0358230 A1 Nov. 12, 2020

Related U.S. Application Data

(63) Continuation of application No. 16/409,000, filed on May 10, 2019, now Pat. No. 10,622,768.

(51) Int. Cl.

| | |
|---|---|
| ***H01R 24/20*** | (2011.01) |
| ***H01R 13/62*** | (2006.01) |
| ***H01R 13/6588*** | (2011.01) |
| ***H01R 31/06*** | (2006.01) |
| ***H01R 24/28*** | (2011.01) |
| ***H01R 43/00*** | (2006.01) |

(52) U.S. Cl.

CPC ..... *H01R 24/20* (2013.01); *H01R 13/6205* (2013.01); *H01R 13/6588* (2013.01); *H01R 24/28* (2013.01); *H01R 31/06* (2013.01); *H01R 43/00* (2013.01); *H01R 2201/06* (2013.01)

(58) Field of Classification Search

CPC .... H01R 24/20; H01R 24/28; H01R 13/6588; H01R 31/06; H01R 43/00

USPC ..... 439/535, 536

See application file for complete search history.

(56) References Cited

U.S. PATENT DOCUMENTS

| | | | |
|---|---|---|---|
| 4,589,719 | A | 5/1986 | Gentry |
| 4,918,258 | A | 4/1990 | Ayer |
| 4,997,388 | A | 3/1991 | Dale et al. |
| 5,064,386 | A | 11/1991 | Dale et al. |
| 5,087,207 | A | 2/1992 | Byrne |
| 5,097,099 | A | 3/1992 | Miller |
| 5,178,555 | A | 1/1993 | Kilpatrick et al. |
| 5,188,541 | A | 2/1993 | Comerci et al. |
| 5,503,565 | A | 4/1996 | Mccoy |

(Continued)

OTHER PUBLICATIONS

PCT/US20/31825, International Search Report, dated Sep. 21, 2020.

*Primary Examiner* — Hae Moon Hyeon

(74) *Attorney, Agent, or Firm* — Caldwell Intellectual Property Law; Katherine Rubino

(57) ABSTRACT

A modular plug-in bus wiring system for electrical connections. The system includes an adapter module, the adapter module including at least a housing wherein the housing includes a front side containing at least an electrical connector, a back side, an upper end, a lower end, and at least a receptacle. The system includes at least a plug configured to insert in the at least a receptacle wherein the at least a plug is connected to at least a cable that includes at least an electrically conductive wire. The at least a plug includes a ventral surface, a dorsal surface, a first side and a second side.

18 Claims, 43 Drawing Sheets

(56) References Cited

U.S. PATENT DOCUMENTS

| | | | | | |
|---|---|---|---|---|---|
| 5,562,493 | A | * | 10/1996 | Ferrill | H01R 13/518 439/536 |
| 5,582,822 | A | | 12/1996 | Johnson | |
| 5,599,206 | A | * | 2/1997 | Slack | H01R 24/64 439/536 |
| 5,762,525 | A | | 6/1998 | Candeloro | |
| 5,857,259 | A | | 1/1999 | Johnston | |
| 6,027,367 | A | | 2/2000 | Woertz et al. | |
| 6,083,053 | A | | 7/2000 | Anderson, Jr. et al. | |
| 6,250,966 | B1 | | 6/2001 | Hashimoto et al. | |
| 6,767,245 | B2 | | 7/2004 | King | |
| 6,945,815 | B1 | | 9/2005 | Mullally | |
| 7,108,532 | B2 | | 9/2006 | Lubkert | |
| 7,410,379 | B1 | | 8/2008 | Byrne | |
| 7,549,882 | B2 | | 6/2009 | Kimura | |
| 7,648,379 | B2 | | 1/2010 | Johnson et al. | |
| 7,658,635 | B2 | | 2/2010 | Gilchrist | |
| 8,998,618 | B2 | | 4/2015 | Hashiguchi | |
| 10,622,768 | B1 | * | 4/2020 | Cowham | H01R 4/46 |
| 2003/0181092 | A1 | | 9/2003 | Negishi et al. | |

* cited by examiner

2700

METHODS AND SYSTEMS FOR A MODULAR PLUG-IN BUS WIRING SYSTEM

RELATED APPLICATION DATA

This application is a continuation of U.S. patent application Ser. No. 16/409,000, filed on May 10, 2019, and entitled "METHODS AND SYSTEMS FOR A MODULAR PLUG-IN BUS WIRING SYSTEM," which is hereby incorporated by reference in its entirety.

FIELD OF THE INVENTION

The present invention generally relates to the field of electrical wiring. In particular, the present invention is directed to methods and systems for a modular plug-in bus wiring system.

BACKGROUND

Installation of electrical wiring systems is currently highly inefficient, due to the lack of a user-friendly standard connection interface between cables and electrical outlet hardware. As a result, most electrical wiring is tediously hand assembled, resulting in variations based on the skill level of assembly personnel. Electrical wiring systems can be challenging to locate after installation, hidden behind walls and mounted in unknown locations. This can hinder simple changes that may be necessary to update wiring in an office building or home. Any changes that are later made, pose a potential hazard, exposing electricians to wires that can cause serious injury and even death.

SUMMARY OF THE DISCLOSURE

Aspects of the present disclosure are directed to a system for a modular plug-in bus wiring system for electrical connections. The system includes an adapter module. The adapter module includes at least a housing. The at least a housing includes a front side, the front side including at least an electrical connector. The at least a housing includes a back side. The at least a housing includes an upper end and a lower end, wherein at least one of the upper and the lower end contain at least a receptacle containing a conductive element linked to the at least an electrical connector. The at least a housing includes a first lateral side, the first lateral side connecting the front side and the back side. The at least a housing includes a second lateral side, the second lateral side connecting the front side and the back side. The system includes at least a plug configured to insert in the at least a receptacle wherein the at least a plug is connected to at least a cable that includes at least an electrically conductive wire. The at least a plug includes a ventral surface, a dorsal surface, a first side surface connecting the ventral surface and the dorsal surface, and a second side connecting the ventral surface and the dorsal surface, wherein the ventral surface includes a ventral lower end containing a grove housing the at least a cable and connected to at least a channel housing the at least an electrically conductive wire and a ventral upper end, wherein insertion of the plug into the at least a receptacle causes the at least a wire in the at least a channel to come into electrical connection with the conductive element.

Aspects of the present disclosure are directed to a method of manufacturing a modular plug-in bus wiring system for electrical connections. The method includes providing an adapter module. The method includes inserting at least a plug in at least a receptacle located on the adapter module, wherein the at least a plug is connected to at least a cable that includes at least an electrically conductive wire. Inserting at least a plug to at least an end of the adapter module includes stripping at least a cable to expose at least an electrically conductive wire end. Inserting at least a plug to at least an end of the adapter module includes pressing the at least an electrically conductive wire onto at least a channel designed and configured to house the at least an electrically conductive wire on the at least a plug. Inserting at least a plug to at least an end of the adapter module includes inserting the stripped wire end into at least an electrically conductive wire receptacle located on the at least a plug. Inserting at least a plug to at least an end of the adapter module includes pressing at least two communication wires onto at least a channel designed and configured to house the at least a wire located on the at least a plug. Inserting at least a plug to at least an end of the adapter module includes securing the at least a cable with a plate and fastener on the at least a plug.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

At a high level, aspects of the present disclosure are directed to methods and systems for a modular plug-in bus wiring system. In an embodiment, the modular plug-in bus wiring system is able to accept connections from four sides, thereby maximizing connection sites while maintaining a sleek compact size. In an embodiment, the modular plug-in bus wiring system is center-mounted in a wall separating a room, thereby allowing devices from different rooms to be electrically connected to one power adapter. This feature reduces waste while maintaining system integrity and maximizing space behind walls to house devices. In an embodiment, the modular plug-in bus wiring system greatly maximizes safety features for electricians and users by greatly reducing exposure to live wires, making it safer to upgrade devices at outlets. The modular plug-in bus wiring system is configured to work with communication wires and electrically conductive wires alike, thereby creating a plug and play system that can be used in both the commercial and residential setting to create wiring for smart technology and electrical fixtures alike.

Figure 1:
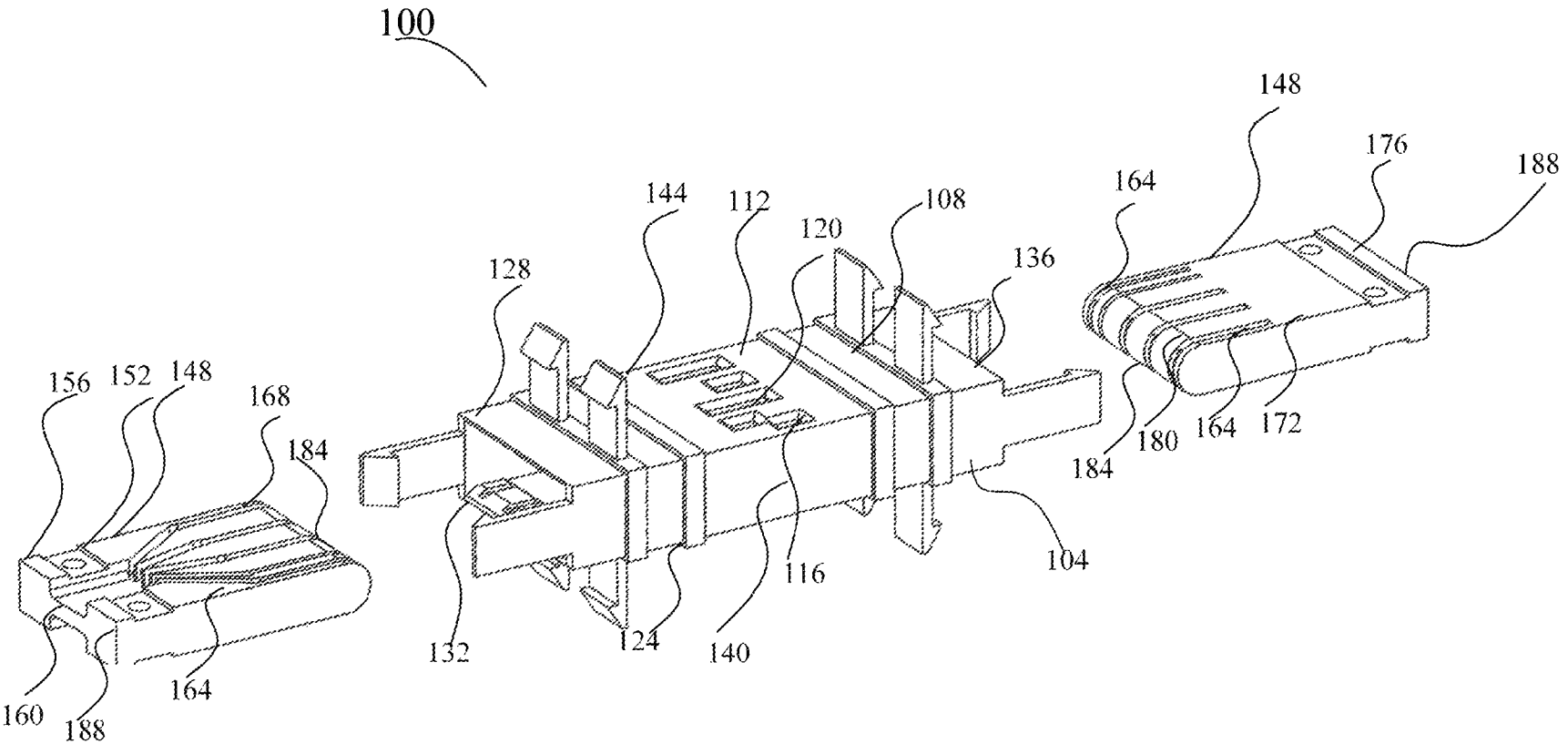
FIG. 1 is a schematic diagram illustrating an exemplary embodiment of a modular plug-in bus wiring system.

Referring now to FIG. 1, a modular plug-in bus wiring system 100 is illustrated. System 100 includes at least an adapter module 104. Adapter module 104 includes at least a housing 108. Housing may be composed of nonconductive materials and/or insulating materials such as plastic, fiberglass, metal coated with an insulating coating and the like.

The at least a housing includes a front side 112 that includes at least an electrical connector 116. Electrical connector 116 may include an electrical plug and/or aperture set which may be used to join an electrical termination and create a continuous path for electrical current to flow. Electrical connector 116 may include a plug which may include a male ended plug, or a female ended plug. Female ended plug may include a receptacle that may hold a protrusion found on a male ended plug. In an embodiment, electrical connector 116 may be designed to accommodate between 0 ampere to 50 amperes of current. In an embodiment, electrical connector 116 may be designed to carry between 0 volts to 600 volts. Electrical connector 116 may be composed of materials which may include for example metal, plastic, brass, phosphor bronze, beryllium copper, high copper alloy, and the like. Electrical connector 116 may be composed of a combination of materials including any of the previous materials. In an embodiment, electrical connector 116 may include a female connector; female connector may include one or more prongs 120 designed to accept projections of a male connector such as a device plug as described in further detail below. As a non-limiting example, female connector may include five cutout prongs 120 designed to be used for connection to a device plug as described in more detail below. Prongs may be of varied sizes to allow for connections of different wire types at different times. Prong size may correspond to different wires that the prongs may connect to. In an embodiment, prongs may connect to power transmission wire. Power transmission wires, as used herein include wires that are involved in the movement of electrical energy. Power transmission wires may be constructed of any material suitable for electrical connector as described above. In an embodiment, prongs may connect to wires that may include power transmission wires that may include a hot wire, a ground wire, a neutral wire, and/or communication wires. Communication wires may send and receive computer data, television and sound data, telemechanical data, telephone data, photograph data and the like. Communication wires may be constructed of any material suitable for electrical connector as described above. Communication wire may include transmission media that may include optical fiber, coaxial conductors, copper conductors, and/or twisted wire pairs. Communication wires may include wires that may be utilized to control lighting, climate, entertainment systems, appliances, home security, building access, alarm systems. Communication wires may include wires that may connect with the internet and may be part of the internet of things. Adapter module 104 includes a back side 124. Adapter module 104 includes an upper end 128, at least a receptacle 132, and a lower end 136. Upper end 128 and/or lower end 136 includes at least a receptacle 132 containing a conductive element linked to the at least an electrical connector. Receptacle 132 may attach to at least a channel located on at least a plug as described in more detail below. Conductive element, as used herein includes any element that transmits energy, including via electrical, thermal, and acoustical conductivity. Conductive element may be composed of any material suitable for electrical connector as described above. Conductive element may include a mini-busbar as described in more detail below. Mini-busbar may be composed of any material suitable for electrical connector as describe above. Conductive element may transfer conductivity from at least a plug through receptacle 132 to a mini-busbar and out to an electrical connector 116 located on adapter module. The modular bus wiring system also greatly reduces conductive heating at the outlet area, by increasing current capacity through the use of mini bus-bars. At least a receptacle 132 may be structurally designed to connect and latch onto at least a plug as described in more detail below. In an embodiment, lower end 136 may include at least a receptacle 132 and may be designed to encompass and connect with at least a plug as described in more detail below. Adapter module 104 includes a first lateral side 140 which connects the front side 112 and the back side 124. Adapter module 104 includes a second lateral side 144 the second lateral side connecting the front side 112 and the back side 124.

With continued reference to FIG. 1, system 100 includes at least a plug 148 configured to insert in the at least a receptacle 132. At least a plug 148 is connected to at least a cable that includes at least an electrically conductive wire. Electrically conductive wire may include a communication wire and/or a power transmission wire as described in more detail above. At least a plug 148 may be comprised of material suitable for housing as described above. At least a plug 148 may be electrically insulating and may protect a user from electrocution. Cable may include thermoplastic-sheathed cable (TPS) and/or nonmetallic cable such as ROMEX™ as produced by Southwire Company, LLC of Carrollton Ga. Cable may be insulated by an individual thermoplastic sheath with a particular exterior color used to indicate the purpose of the conductor. Non-metallic cable may include cable that contains an exterior outer sheathing that is not metallic. In an embodiment conductive shield may surround conductive material of the cable. This may include for example, a Hochstadter shield. Cable may include twisted pair, extensible, coaxial, shielded, and communication cable. Cable may include at least an electrically conductive wire. At least an electrically conductive wire may be categorized according to American wire gauge (AWG) whereby the gauge may be indicative of its current-carrying capacity. Cable may include for example but is not limited to white 14 AWG wire for 15-amp circuits, yellow 12 AWG wire for 20-amp circuits, orange 10 AWG wire for 30-amp circuits, black 6 AWG wire for 60-amp circuits, black 8 AWG wire for 45-amp circuits. Cable itself may be flexible which may allow it to be manipulated to lay flat against plug as described in more detail below. In an embodiment, thermoplastic-sheathed cable (TPS) such as ROMEX™ as produced by Southwire Company, LLC of Carrollton Ga. may be stripped back to expose at least three wires. Stripping may be performed using certain tools such as crimping tools. Outer material may include for example, thermoplastic sheath and/or a conductive shield. Terminal end of cable may be pressed to create solderless electrical connection. In an embodiment, terminal end of cable may be inserted into a handheld crimping tool containing an appropriately sized crimp barrel. Cable conductors may then be inserted into the tool with a blank plug. Handles of the crimp tool are then used to compress and reshape the terminal end until conductors have been embedded into plug. Crimping may also occur by electric handheld crimping tools such as battery-powered crimpers that may allow for consistent crimps to be generated. Crimping may occur through a benchtop manual crimping tool, a benchtop electric crimping tool, a pneumatic mountable crimping tool, a hydraulic handheld crimping tool and the like. In an embodiment, stripping of a cable may expose three wires. Two of the wires may be covered with plastic insulation and the third may be a bare copper conductor. One wire may be a hot wire, providing a 120 volts AC power, one wire may be a neutral wire providing a return path for the current provided by the hot wire and may be connected to an earth ground, and one wire may be a ground wire such as a bare copper wire that may be connected to an earth ground. Plugs can be easily inspected and isolated by unplugging them from adapter module 104. This is a desirable feature to electricians in the field as it is increases safety by reducing exposure to live wires. In an embodiment, circuits can be installed without cutting cable, meaning less wire is utilized, thereby reducing waste while increasing reliability of any circuit. Increased reliability is critical in hospitals and home-based care settings where power failure can be a threat to life. This may also make troubleshooting easy, as a great number of possible failure points are eliminated. Ability to unplug at an electrical panel and then inserting plug with a locking system 100 lock out tag out cap, improves safety as it provides a positively-disconnected circuit to be worked on. The current use of circuit breakers to shut of circuits that need work is particularly dangerous on construction sites due to a large presence of other trades that are operating simultaneously, such as plumbers and builders. It is a common tendency at construction sites for some workers to attempt to restore power to a tripped circuit and inadvertently turn on the wrong circuit. Current lock-out devices are not easy to use and thus simply unplugging the circuit would entirely avoid this danger.

With continued reference to FIG. 1, the at least a plug 148 includes a ventral surface 152. Ventral surface 152 includes a ventral lower end 156. Ventral lower end 156 includes a groove 160 designed and configured to house the at least a cable. Cable may be secured within groove 160 by a plate and at least a fastener. Groove 160 may include an indentation that cable may fit within. For example, a cable that has been stripped to expose at least a wire that may be pressed into groove 160 at junction where at least a wire and outer sheathing of cable come together. Groove 160 is connected to at least a channel 164. At least a channel 164 is designed and configured to house at least an electrically conductive wire. At least a channel 164 may be of a certain length, width, and/or depth to accommodate at least an electrically conductive wire. In an embodiment, a plurality of channels may be of equal width. In an embodiment, a plurality of channels may be of unequal width. For example, at least a channel 164 designed and configured to house at least an electrically conductive wire may be of a different width as compared to at least a channel 164 designed and configured to house a communication wire. In an embodiment, a cable that has been stripped to expose at least a wire may be pressed into grove 160 at junction where at least a wire and outer sheathing of cable come together, and at least a wire may be pressed into at least a channel 164. In an embodiment, the groove 160 may be connected to five channels, with one channel housing a hot wire, one channel housing a neutral wire, one channel housing a ground wire, and two channels housing a communication wire. Ventral surface 152 includes a ventral upper end 168.

With continued reference to FIG. 1, the at least a plug 148 includes a dorsal surface 172. Dorsal surface 172 may include a dorsal lower end 176 and a dorsal upper end 180. Dorsal surface 172 includes at least a channel 164 designed and configured to house the at least an electrically conductive wire.

With continued reference to FIG. 1, the at least a plug 148 includes a first side surface 184. First side surface 184 connects the ventral surface 152 and the dorsal surface 172. First side surface 184 may contain a rounded edge. The at least a plug 148 includes a second side surface 188. Second side surface 188 connects the ventral surface 152 and the dorsal surface 172.

Figure 2:
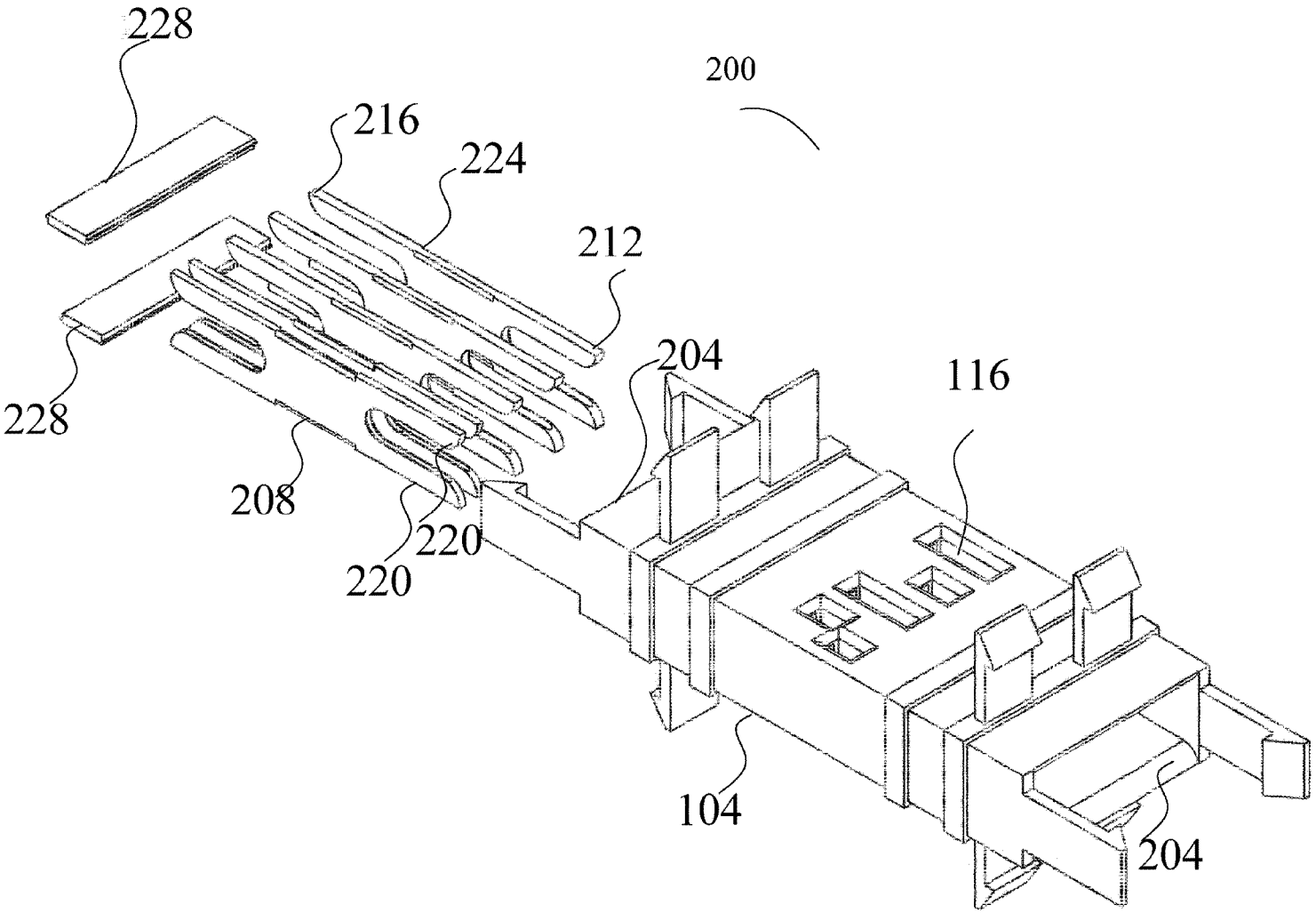
FIG. 2 is a schematic diagram illustrating an exemplary embodiment of an adapter module.

Referring now to FIG. 2, an exemplary embodiment 200 of an adapter module 104 is illustrated. Adapter module 104 provides safe and efficient power transfer from a cable to electrical outlet devices. Adapter module 104 is designed to contain a plug-in format for plugs to create a safe installation method that allows various plugs to be used to connect devices to wiring systems within walls. Adapter module 104 may be designed to create a space-efficient module that can accept back to back electrical box connections as described in more detail below. Adapter module 104 may include an inner compartment 204 which may include inner surface area of adapter module 104. Contained within inner compartment 204 may be at least a mini-busbar 208. Mini-busbar 208 may receive and/or generate power distribution. Mini-busbar 208 may electrically link at least a plug located at receptacle 132 out to an electrical connector 116 located on adapter module 104. Mini-busbar 208 may be composed of material such as copper, brass, and/or aluminum. Mini-busbar 208 may be composed of any material suitable for use as electrical connector as described in more detail above. Mini-busbar 208 includes a first end 212 and a second end 216. First end 212 may contain a double jaw 220 designed and configured to electrically connect with the at least an electrically conductive wire located in the at least a channel on at least a plug 148. In an embodiment, mini-busbar 208 may connect with at least a plug 148 by interfacing with first side surface 184 containing a rounded edge and at least a channel 164 housing at least an electrically conductive wire at receptacle 132 located on upper end 128 and/or lower end 136 of adapter module 104. Rounded edge located on first side surface 184 may accommodate at least a plug once inserted into the at least a receptacle. At least a receptacle may be designed and configured to interface with rounded edge located on first side surface 184 as described in more detail below. Second end 216 may contain a double jaw 220 designed and configured to electrically connect with at least a plug 148. Jaw may contain at least a rounded curved edge. Double jaw may contain two rounded curved edges. Curved edges may allow for greater surface area to increase transmission of power. Mini-busbar 208 may be of a length equal to fit within at least a housing 108 of adapter module 104. In an embodiment, min-busbar 208 first end 212 may be located at adapter module 104 upper end 128 and mini-busbar 208 second end 216 may be located at adapter module 104 lower end 136. Mini-busbar 208 shape and size may allow for compact fit within adapter module 104. Mini-busbar body 224 may be contained within inner surface of adapter module 104, between front side 112 and back side 124. Mini-busbar body 224 may be of a flat bar. Mini-busbar 208 may interface with at least an electrical connector 116 located on front side 112. In an embodiment, electrical connector box connects to at least an electrical connector 116 located on front side 112 of adapter module 104 may interface with mini-busbar 208 thereby transmitting power to a device. In an embodiment, mini-busbar 208 may electrically connect from four sides, with a plug connection at first end 212, a plug connection at second end 216, with at least an electrical connector 116 located on front side 112 and with at least an electrical connector 116 located on back side 124. Mini-busbar 208 may be stacked in sequence within adapter module 104. Mini-busbars 208 may be connected to one another through for example a welded connection. In an embodiment, mini-busbar 208 may be press fitted into adapter module 104. Press fit may include an interference fit and/or friction fit that may including fastening mini-busbar within adapter module 104 by friction after at least a mini-busbar are pushed together. In an embodiment, plug in connection to mini-busbar 208 may be spring loaded within adapter module. Spring load may include the use of a spring located on mini-busbar 208 and/or adapter module 104 that may store mechanical energy. Spring may be composed of elastic materials which may include for example, steel, phosphor bronze, titanium, and/or beryllium copper. Spring may include a coil spring, tension spring, extension spring, compression spring, torsion spring, constant spring, variable spring, helical spring and the like. Spring may be compressed and/or stretched from its resting position, exerting mechanical pressure to force contact surfaces on mini-busbar against the contact surface of the conductor wire embedded in the plug. Mini-busbar 208 may be covered by a conductor bus retainer block 228 located within adapter module 104. Conductor bus retainer block 228 may interface with at least a mini-busbar 208 to prevent at least a mini-busbar 208 from sliding out of adapter module 104 as described in more detail below. In an embodiment, at least a mini-busbar 208 may interface with conductor bus retainer block 228 at first end 212 and/or second end 216.

Figure 3:
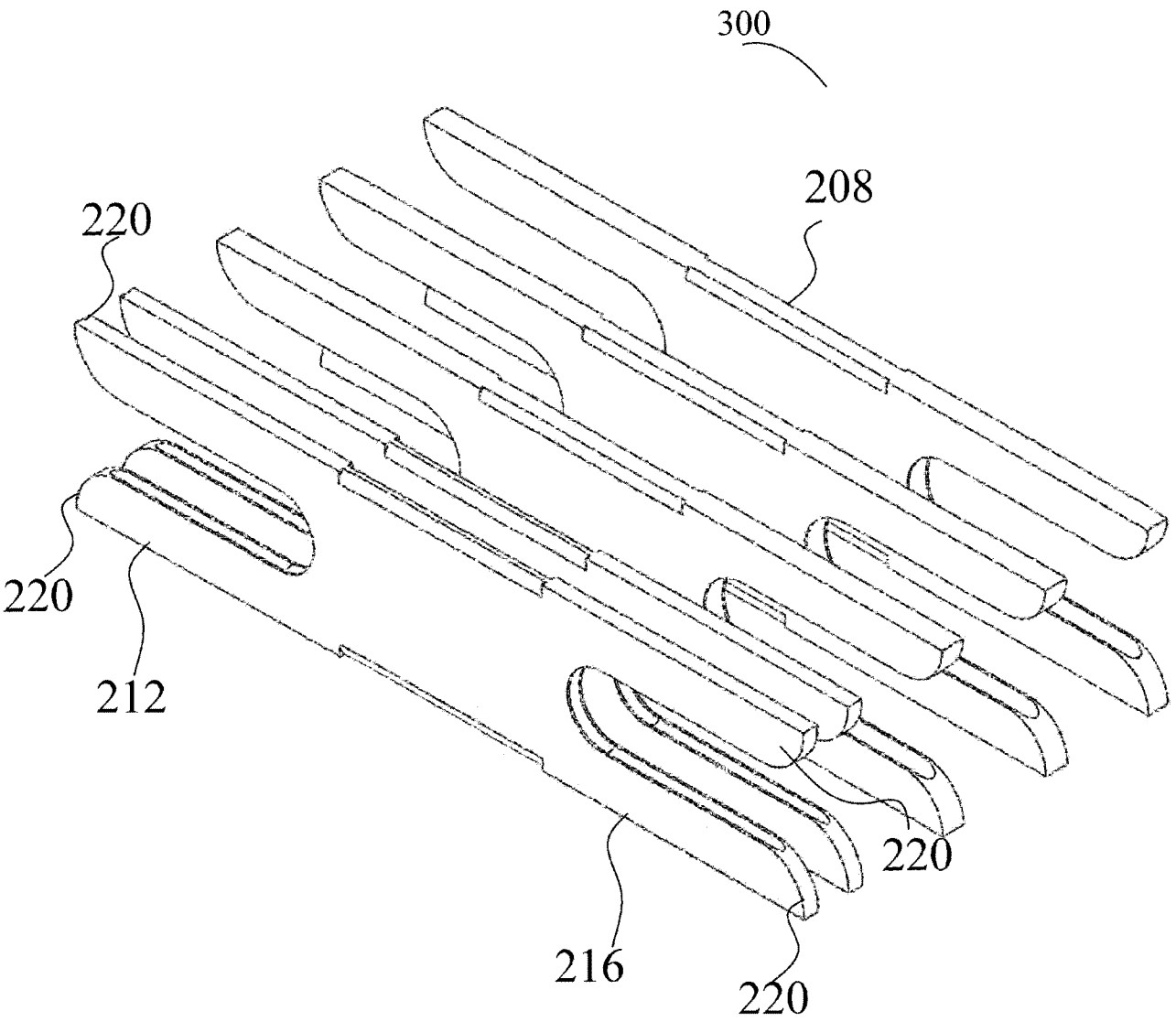
FIG. 3 is a schematic diagram illustrating an exemplary embodiment of a mini-busbar.

Referring now to FIG. 3, an exemplary embodiment 300 of a mini-busbar 208 is illustrated. Mini-busbar first end 212 and second end 216 each contain double jaw 220. Double jaw 220 at least two rounded curved edges that allow for increased surface area to generate and/or receive power distribution. Double jaw 220 allows first end 212 and second end 216 to interface with at least a plug 148 thereby allowing for connections to be made at either end of mini-busbar 208. In an embodiment, mini-busbar 208 may connect with at least a plug 148 by interfacing with first side surface 184 containing a rounded edge and at least a channel 164 housing at least an electrically conductive wire at receptacle 132 located on upper end 128 and/or lower end 136 of adapter module 104.

Figure 4:
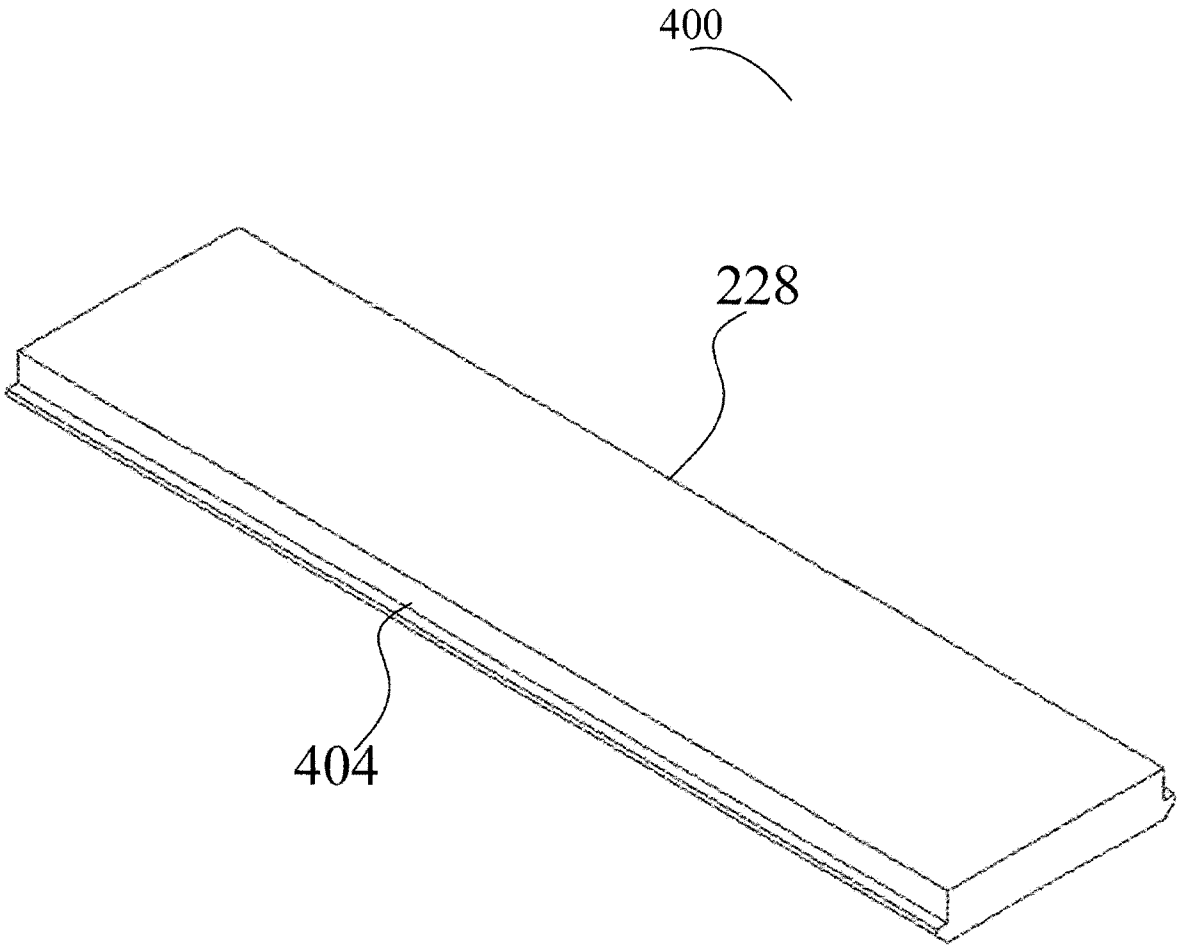
FIG. 4 is a schematic diagram illustrating an exemplary embodiment of a conductor bus retainer block.

Referring now to FIG. 4, an exemplary embodiment 400 of conductor bus retainer block 228 is illustrated. Mini-busbar 208 may interface with conductor bus retainer block 228 at first end 212 and/or second end 216. Conductor bus retain block may be composed of any material suitable for electrical connector as described in more detail above. In an embodiment, a rounded curved edge of double jaw 220 located at first end 212 and second end 216 may be covered by conductor bus retainer block. Rounded curved edge of double jaw 220 located on mini-busbar 208 may slide into an opening 404 located on conductor bus retainer block 228 and fit within conductor bus retainer block 228 located within adapter module 104. Conductor bus retainer block 228 may be configured to house a plurality of mini-busbars 208. In an embodiment, first end 212 of mini-busbar 208 may contain two rounded curved edges or "jaws". In such an instance, each rounded curved edged may be covered by a separate conductor bus retainer block 228. In an embodiment, a plurality of mini-busbars 208 may be connected to one another each containing two rounded curved edges on a first end 212 and two rounded curved edges on a second end 216. In such an instance, a row of first curved edges located on a first end 212 of a plurality of min-busbars 208 may fit into a first conductor bus retainer block 228 and a row of second curved edges located on a first end 212 of a plurality of mini-busbars may fit into a second conductor bus retainer block 228.

Figure 5:
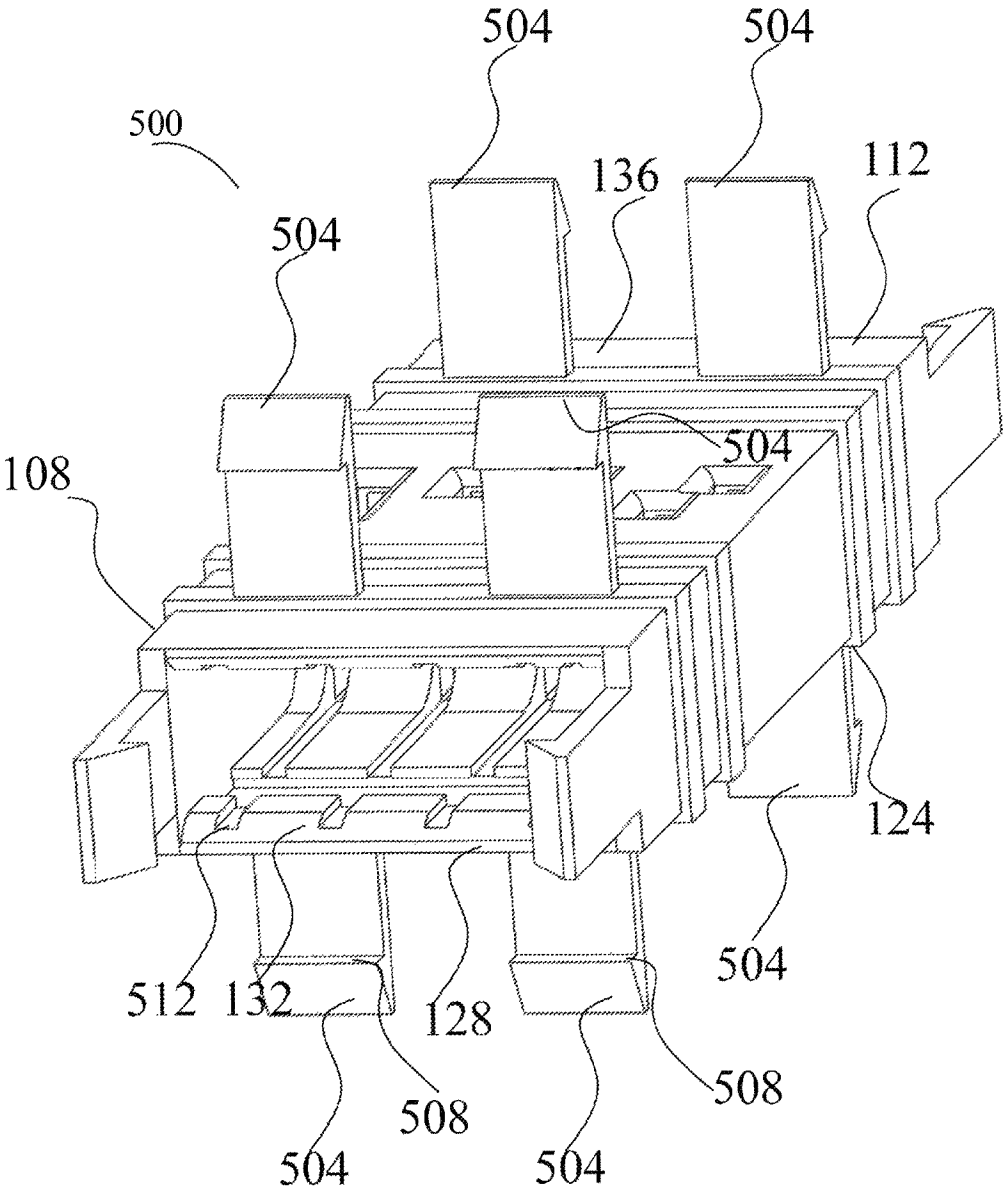
FIG. 5 is a schematic diagram illustrating an exemplary embodiment of a top view of an adapter module.

Referring now to FIG. 5, an exemplary embodiment of a mounting feature 500 located on an adapter module 104 is illustrated. Housing 108 located on adapter module 104 may include at least a mounting feature 504. Mounting feature 504 as used herein includes any feature that assists in connecting adapter module to a structure. Structure may include for example, a wall, stud, sheet rock, electrical box, and the like. Mounting feature 504 may be composed of any material suitable for housing as described in more detail above. Mounting feature 504 may include a clip-on bracket whereby a bracket may interface with a structure such as an electrical box and clip into place. Clip may include a protrusion 508 located on mounting feature 504 that holds adapter module 104 in place against structure such as electrical box. Protrusion 508 may be composed of any material suitable for housing as described above in more detail. In an embodiment, protrusion 508 may clip onto an edge located on structure, such as a side edge of an electrical box. Electrical box may include a housing 108 to enclose electrical connections. Electrical box may be of a rectangular shape and may be composed of materials such as metal or plastic. Electrical box may include be categorized according to the number of switches and/or receptacles that an electrical box may be able to accommodate. Single gang electrical box may include an electrical box wide enough for a single switch or a duplex receptacle to plug in two devices. Double gang electrical box may be wide enough for a double switch or two duplex receptacles to plug in four devices. Triple gang electrical box may be wide enough for a triple switch or three duplex receptacles to plug in six devices. Mounting feature 504 may clip onto any size electrical box without adjustments necessary. In an embodiment, mounting feature 504 may be secured to a structure such as a wall or stud without the addition of a screw and which may allow for a user such as an electrician to have a free hand during installation. In an embodiment, mounting feature 504 may include 8 clip-on brackets located on housing 108, such that 4 clip-on brackets are located on front side 112 of adapter module 104 and 4 clip-on brackets are located on back side 124 of adapter module 104. In an embodiment, mounting feature 504 may include 8 clip-on brackets that may be located on housing 108, such that 2 clip-on brackets are located on upper end of front side 112, 2 clip-on brackets are located on lower end of front side 112, 2 clip-on brackets are located on upper end of back side 124, and 2 clip on brackets are located on lower end of back side 124. Mounting feature 504 may enable a custom configuration of system 100 whereby system 100 can be custom designed to mount different size electrical boxes on either side of adapter module 104. Mounting feature 504 may be clipped onto a single gang electrical box on front side 112 and a triple gang electrical box on back side 124. In certain cases, an adapter module may have to be on a precise location on a wall. In such an instance, stud mounting bracket may have a sliding feature whereby positioning of stud mount bracket can be adjusted to accommodate such differences. In yet another non-limiting example, clip-on sliding mounting bracket may be utilized when stud mount bracket contains multiple openings where mounting bracket may interface with. Favorable position may include ability to have adapter module 104 interface with stud mount bracket in such a way that maximum connections may be utilized from all four possible sides located on system 100 including for example, connections from plugs located on either end of adapter module 104 and connections at electrical connection located on front side 112 and back side 124 of housing 108. Currently, lack of a mounting feature as is custom in the field, results in poor quality work and many construction and logistical problems such as buried boxes, cut wires, and difficulty modifying already installed outlets. Mounting feature 504 may also assist in enabling work of carpenters, wall finishers, and painters to be aided as well by installing the electrical box after the walls are boarded, removing a major hindrance to their work. System 100 does not require the electrical box to be installed in advance, as the magnets embedded in the stud mount bracket allows easy recovery of outlet points in the wall. In an embodiment mounting feature 504 may align with a stud mount bracket, which may contain at least a magnet. In an embodiment a magnet located within stud mount bracket, may allow the number of visits by an electrician to be greatly reduced as after system 100 has been installed in a wall, as it can be easily detected by dragging another magnet over the wall until it magnet located on mounting feature and/or stud mount bracket is located and the two magnets attract. Mounting feature 504 containing at least a magnet may also allow for efficiencies to be created at construction sites. For example, the number of visits by an electrician to a construction site may be reduced as a first visit may be necessary to install system 100 into a wall without any electrical boxes connected to it so that the wall can be boarded, finished, and painted, and then only a second visit is needed to detect system 100 in the wall and cut a precise hole to connect an electrical box. In another non-limiting example, system 100 may be installed with at least a connected electrical box whereby electrical box outlets could be cut as sheetrock is installed. Magnetic alignment with mounting feature 504 also allows for a more precise and predictable cut of a wall, as there is no guesswork as to where the cutout for the electrical box needs to be cut on the wall. Currently it is a common practice in the field to spend labor hours repairing improperly cut openings in wallboard for outlet, due to workers missing the correct cut location. Mounting feature 504, containing at least a magnet allows for accurate detection and location to be known so that precise cutouts can be made. Mounting feature 504 also allows for accurate placement of electrical boxes, whereby electrical boxes can be placed on the front side 112 and back side 124, thereby maximizing the number connections of adapter module 104. In such an instance, adapter module 104 with electrical boxes on the front side 112 and back side 124 may allow for system 100 to be placed in a wall and utilized by different devices located on both sides of wall. This assists in maximizing connections and reducing waste as less outlets are required to be created in a cable run. Currently it is common practice for an electrical outlet to only be accessible from one side of the wall. Any change requires a new box, to be installed and spliced into an existing outlet. This is a significant cost, that is avoided with system 100. In an embodiment, at least a mounting feature 504 may be placed at same locations on front side 112 of adapter module 104 and back side 124 of adapter module 104. For example, at least a mounting feature 504 may be located at upper end of front side 112 of adapter module 104 and at least a mounting feature 504 may be located at same location on upper end of back side 124 of adapter module 104. Placement of mounting feature 504 may ensure adequate weight dispersion of structure attached to mounting feature 504. For example, a front side 112 containing one mounting feature 504 attached to a triple gang electrical box may not be able to adequately support electrical box, leading to flimsy connections. In yet another non-limiting example, having a front side 112 containing one mounting feature 504 and a back side 124 containing six mounting feature 504 may also create uneven support for a structure attached to either side. Mounting feature 504 may also allow for system 100 to be placed in a wall as far back as possible from cutting and drilling tools that may be acting on surface of wall. In addition, placement at center of the wall also allows for equal access from either side of the wall so that maximum connections of system 100 can be utilized. Mounting feature 504 also eliminates inefficiencies of pre-installing electrical boxes before wall boarding. As is current practice, pre-installing electrical boxes before wall boarding results in poor quality work as well as construction problems such as buried boxes, cut wires, and excessive difficulty in modifying already installed outlets. Carpenters, wall finishers, and painters commonly find that current practice results in a hindrance to their work.

With continued reference to FIG. 5, adapter module 104 includes at least a receptacle 132. At least a receptacle 132 may be structurally designed to connect and attach with at least a plug. In an embodiment, at least a receptacle 132 may be located at adapter module 104 upper end 128 and/or at adapter module 104 lower end 136. At least a receptacle 132 may include a protrusion designed and configured to attach to the at least a plug 148. Protrusion may be composed of any nonconductive material as housing as described above. At least a receptacle 132 may include an aperture 512 configured to receive and secure at least a plug. Aperture 512 may include a depression that may attach to and receive at least a plug 148 as described in more detail below. Aperture 512 may be designed and configured to attach to the first adjacent side of the at least at plug. In an embodiment, first adjacent side of the at least a plug 148 may contain a rounded edge that may fit within aperture 512 as described in more detail below.

Figure 6:
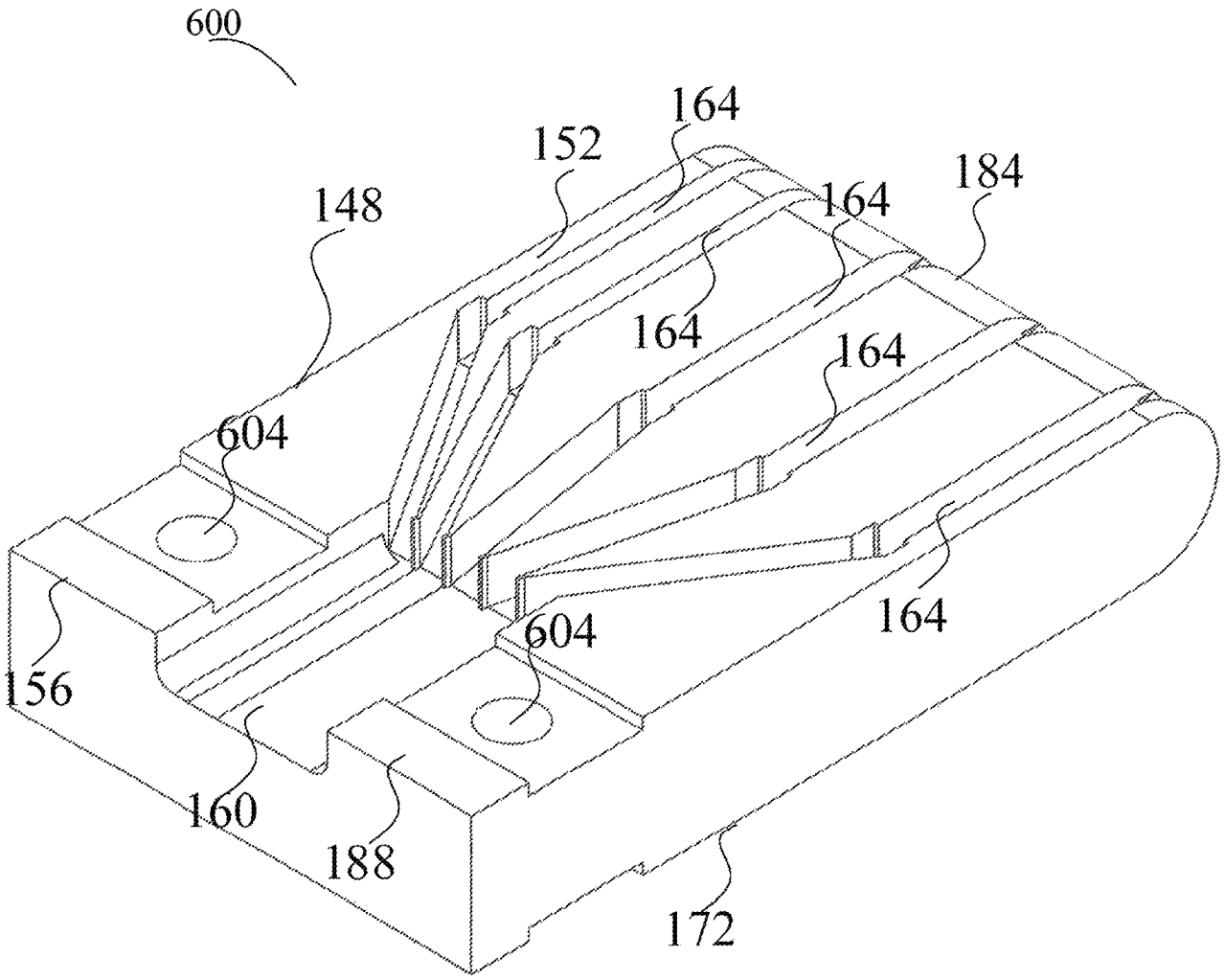
FIG. 6 is a schematic diagram illustrating an exemplary embodiment of a plug.

Referring now to FIG. 6, an exemplary embodiment 600 of at least a plug 148 is illustrated. At least a plug 148 is connected to at least a cable that includes at least an electrically conductive wire. At least an electrically conductive wire may be composed of any conducting material as described above, including any material suitable for use in at least an electrical conductor. At least an electrically conductive wire may include any wire that allows flow of charge in one or more directions. At least an electrically conductive wire may include wire from a thermoplastic-sheathed cable (TPS) such as ROMEX™ as produced by Southwire Company, LLC of Carrollton Ga. In an embodiment, at least an electrically conductive wire may include a hot wire, providing a 120 volts AC power, at least an electrically conductive wire may be a neutral wire providing a return path for the current provided by the hot wire, and one conductor such as a bare copper wire may be a ground wire and may be connected to an earth ground. At least a wire may include a communication wire may include wires used to send and receive information signals. For example, communication wires may send and receive computer data, television and sound data, telemechanical data, telephone data, photograph data and the like. Communication wire may include transmission mediums that may include optical fiber, coaxial conductors, copper conductors, and/or twisted wire pairs. In an embodiment, at least an electrically conductive wire may include five wires with one wire being a hot wire, one wire being a neutral wire, one wire being a ground wire, and two wires being communication wire. In an embodiment, terminal end of wire may be stripped to create solderless electrical connection. In an embodiment, terminal end of wire may be inserted into a handheld crimping tool containing an appropriately sized crimp barrel. Wire may then be inserted into the terminal with the end of the wire flush with the exit of the terminal to maximize contact.

Handles of the crimp tool may then be used to compress and reshape the terminal end until outer material has been stripped and shaped. Crimping may also occur by electric handheld crimping tools such as battery-powered crimpers that may allow for consistent crimps to be generated. Crimping may occur through a benchtop manual crimping tool, a benchtop electric crimping tool, a pneumatic mountable crimping tool, a hydraulic handheld crimping tool and the like.

With continued reference to FIG. 6, at least a plug 148 contains a groove 160 at ventral lower end 156 designed and configured to house at least a cable. The at least a cable may include any of the cables as described above in reference to FIG. 1. Ventral lower end 156 contains at least an opening 604. Opening 604 as used herein is a hole contained within the at least a plug 148 located between ventral surface 152 and dorsal surface 172. In an embodiment, at least an opening 604 may be located on both sides of groove 160. In an embodiment, the at last an opening 604 located on both sides of groove 160 may be of equal diameter. In an embodiment, two openings may be of a circular shape, each having a diameter of equal size. At least an opening 604 may be utilized to mount the at least a plug 148 to a structure which may include for example, a wall, stud, sheet rock, electrical box, and the like. At least an opening 604 may house a fastener that may aid in mounting the at least a plug 148 to a structure. Fastener may include for example a drywall screw, eye screw, threaded fastener, carriage bolt, rivet, threaded rod, lag bolt, lag screw, mirror screw, sheet metal screw, twinfast screw, wood screw, security head screw, cap screw, carriage bolt, elevator bolt, eye bolt, hex cap screw, hex bolt, fine adjustment screw, machine screw, plow bolt, self-drilling screw, self-tapping machine screw, set bolt, set screw, shoulder bolt, shoulder screw, stove bolt, tension control bolt, thread rolling screws, superbolt, bone screws and the like. Fastener may include a built-in washer, may be fitted or tapered, or non-tapered shank. Fastener may be mounted in place and stabilized with a plate. Fastener may be made of material such as steel, stainless steel, brass, titanium, bronze, silicon bronze, plastic, aluminum, nylon, and/or pol and/or Monel.

Figure 7:
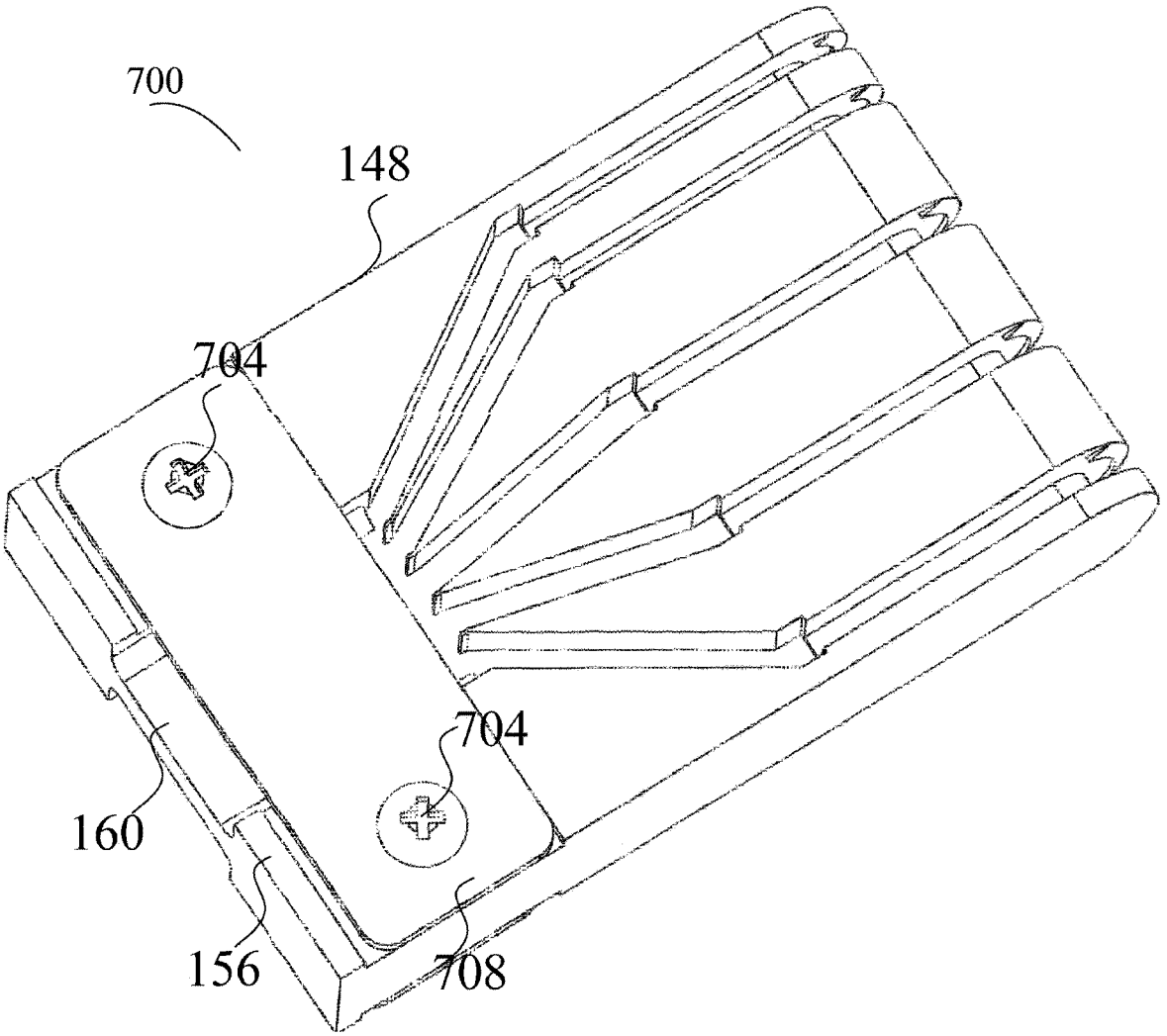
FIG. 7 is a schematic diagram illustrating an exemplary embodiment of a plug containing a fastener and plate.
Figure 8:
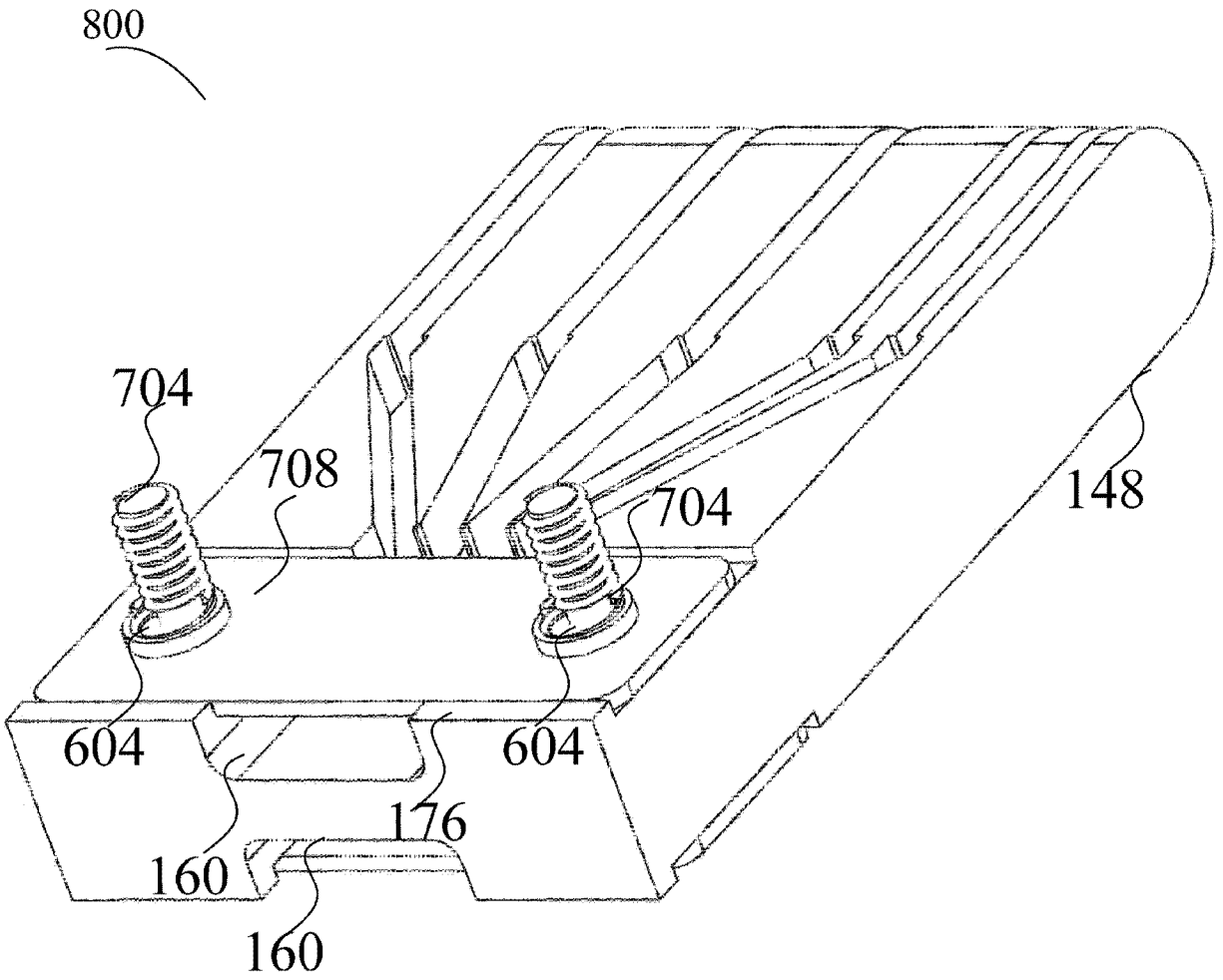
FIG. 8 is a schematic diagram illustrating an exemplary embodiment of a dorsal surface of a plug.

Referring now to FIG. 7, an exemplary embodiment 700 of at least a plug 148 containing a fastener and plate is illustrated. Fastener 704 may include any of the fasteners as described above in FIG. 6. Fastener 704 may include a head located on one end of fastener 704 that allows fastener 704 to be turned and driven into opening 604 with the use of a tool such as a screw driver. In an embodiment, head of fastener 704 may be located at ventral lower end 156 of the at least a plug and driven into opening 604 so that end of fastener 704 is located on dorsal lower end of the at least a plug 148 as illustrated below in FIG. 8. Fastener 704 may be mounted in place and stabilized with a plate 708. In an embodiment, plate 708 may be a rectangular length with two openings to allow for fastener 704 to fit through. Plate 708 may be positioned at ventral lower end 156 and may function to secure cable in place by covering groove 160. Plate 708 may be of a length to cover at least an opening 604 located on both sides of groove 160 and over groove 160. In an embodiment, plate maybe of a length equal to length of the at least a plug 148. Plate 708 may be placed flat against plug and secure by fastener 704. Plate 708 may assist in securing cable to lie flat against the at least a plug 148. Plate 708 may contain at least an opening 604 to accommodate fastener 704. Diameter of at least an opening 604 on plate 708 may be equal in to diameter of at least an opening 604 located on at least a plug 148. In an embodiment, cable may be laid flat against the at least a plug 148 and covered with plate 708, whereby plate 708 may then be secured by into place with fastener 704 which may be housed in at least an opening 604 located on plate 708 and the at least a plug 148. In an embodiment, a fastener 704 of different length may be utilized depending on desired depth needed to mount the cable to at least a plug Referring now to FIG. 8, an exemplary embodiment 800 of dorsal surface 172 of the at least a plug 148 is illustrated. Dorsal lower end 176 may include at least an opening 604 containing fastener 704, which may be covered by plate 708. In an embodiment, head of fastener 704 may be located at ventral lower end 156 of the at least a plug and driven into opening 604 so that end of fastener 704 is located on dorsal lower end of the at least a plug. In an embodiment, dorsal lower end 176 may include groove 160 which may also be covered by plate 708. Groove 160 is designed and configured to house the at least a cable secured by a plate and at least a fastener, connected to at least a channel designed and configured to house the at least an electrically conductive wire. In such an instance, groove 160 located on ventral surface 152 and dorsal surface 172 may allow for multiple connections to be formed.

Referring back now to FIG. 6, groove 160 located on ventral lower end 156 is connected to at least a channel 164 designed and configured to house the at least an electrically conductive wire. Channel 164 may be of a certain size designed to house at least an electrically conductive wire of different types. In an embodiment, channel 164 may be of varying size based on the type of electrically conductive wire utilized. For example, diameter of grooved channel receptacles to accommodate a communication wire may be different than diameter of grooved channel receptacle to accommodate a hot wire. In an embodiment, groove channel receptacles may all may be of an equal size and may be able to accommodate diameter of communication wire and/or hot, neutral, and ground wire. Channel 164 may travel from ventral lower end 156 to first side surface 184 and continue to dorsal side surface 172. Channel 164 may curve over rounded edge located on first side surface 184. In an embodiment, channel 164 located on first side surface 184 may interface with receptacle 132 located on adapter module 104. For example, aperture 512 may be of a size and shape that mirrors channel 164.

Figure 9:
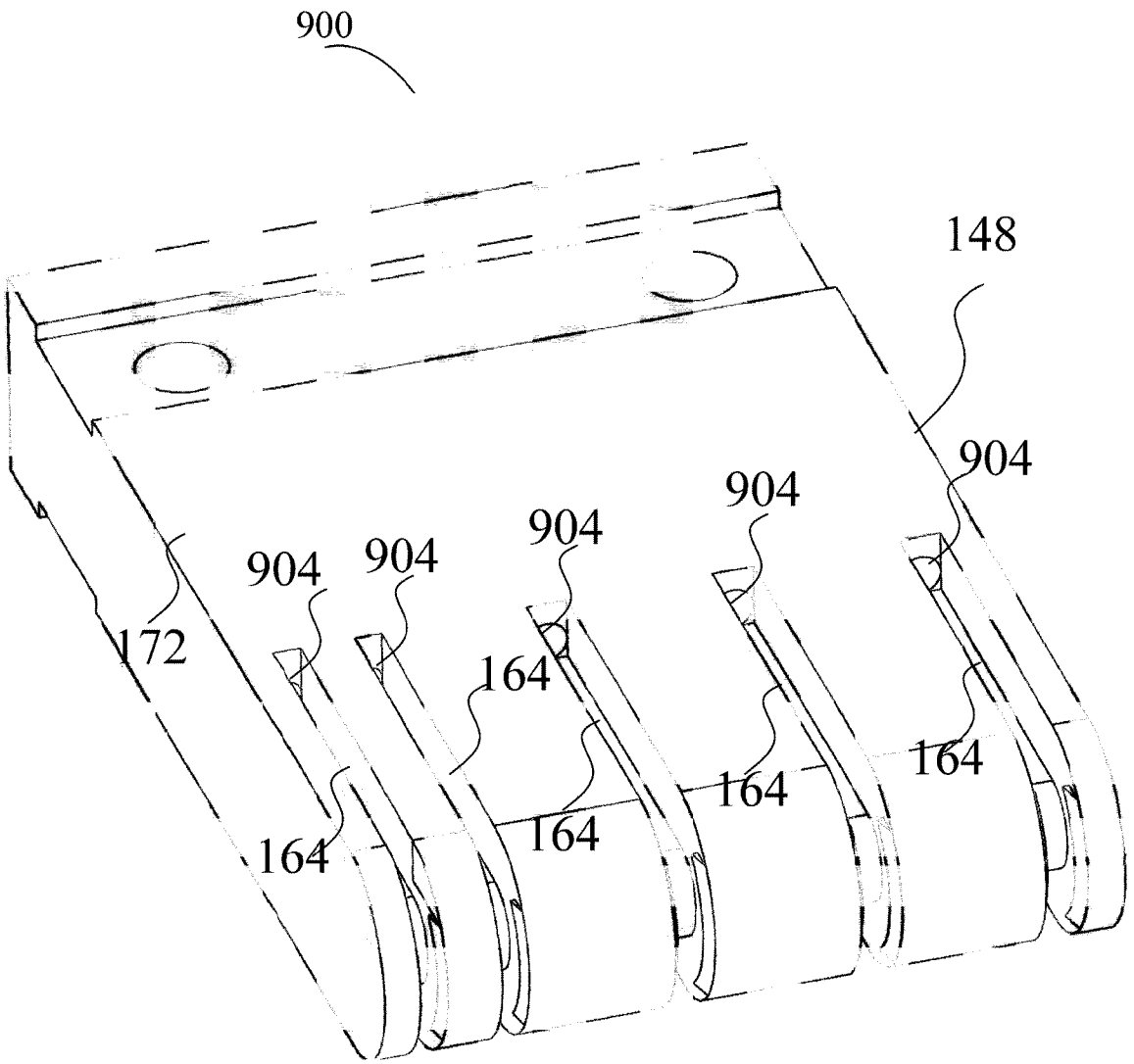
FIG. 9 is a schematic diagram illustrating an exemplary embodiment of a dorsal surface of a plug.

Referring now to FIG. 9, an exemplary embodiment 900 of dorsal surface 172 of the at least a plug 148 is illustrated. Dorsal surface 172 contains channel 164 located at ventral lower end 156 that travels over first side surface 184 and continues to dorsal surface 172. Dorsal surface 172 may contain channel receptacle 904 that may accept single end of the at least an electrically conductive wire. In an embodiment, end of the at least an electrically conductive wire that has been stripped may be inserted into channel receptacle 904. Channel receptacle 904 may be of a circular shape and may be of a diameter wide enough to accept end of at least an electrically conductive wire. In an embodiment, the at least an electrically conductive wire containing a stripped end may be inserted into channel receptacle 904 as part of manufacturing process as described in more detail below.

Figure 10:
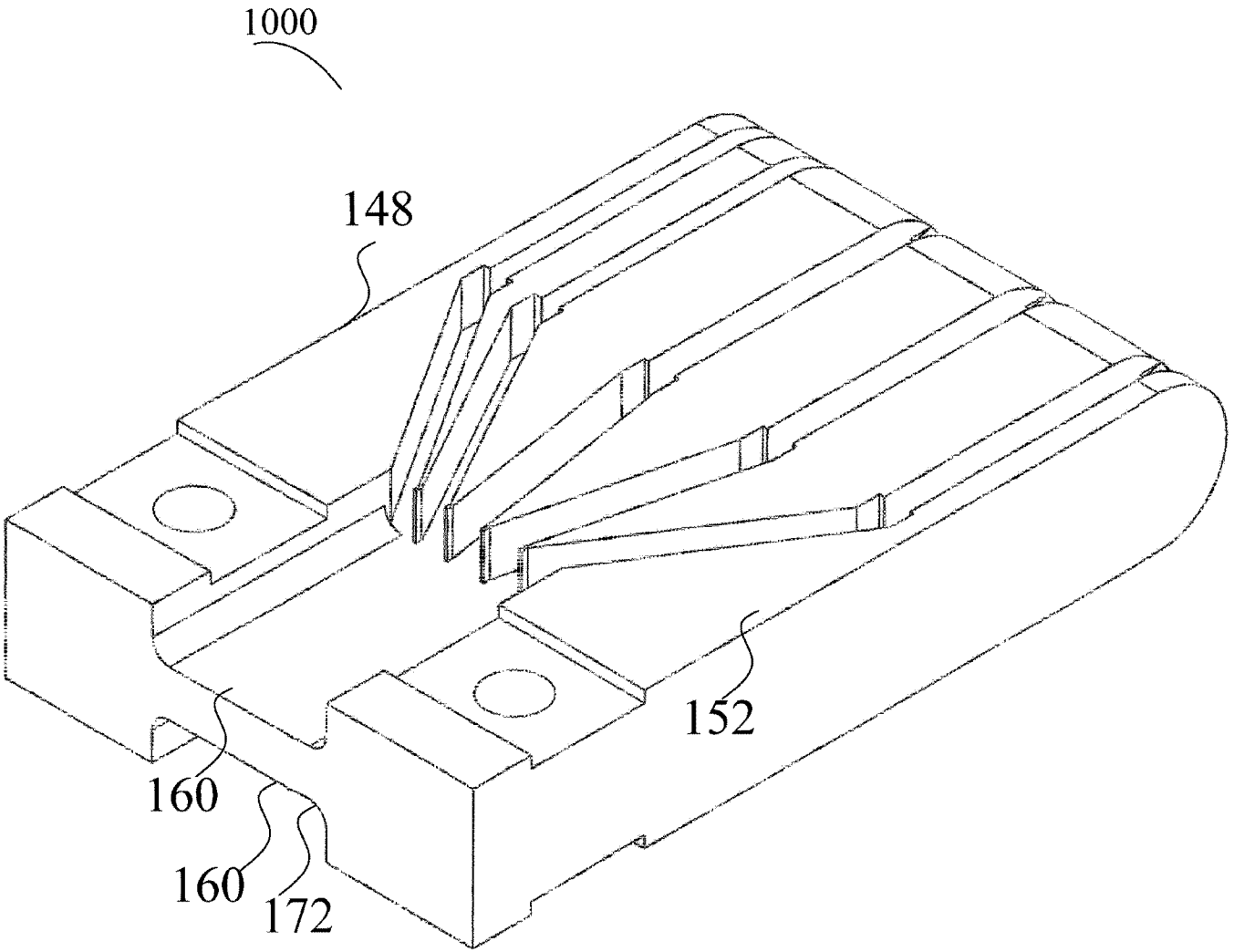
FIG. 10 is a schematic diagram illustrating an exemplary embodiment of a dorsal surface of a plug containing a groove.

Referring now to FIG. 10, an exemplary embodiment 1000 of at least a plug 148 is illustrated. In an embodiment, groove 160 may be located on ventral surface 152 and on dorsal surface 172. In such an instance, at least two cables, and/or a single cable having insulation stripped away in a portion threaded through the at least a plug, may connect with the at least a plug forming a continuous conduction. Dorsal surface 172 may include groove 160 configured to house the at least a cable secured by a plate 708 and fastener 704. Groove 160 located on dorsal surface 172 may allow for at least a plug 148 to be connected to at least two cables. In such an instance, maximal connections may be established forming a continuous conduction, thereby reducing waste.

Figure 11:
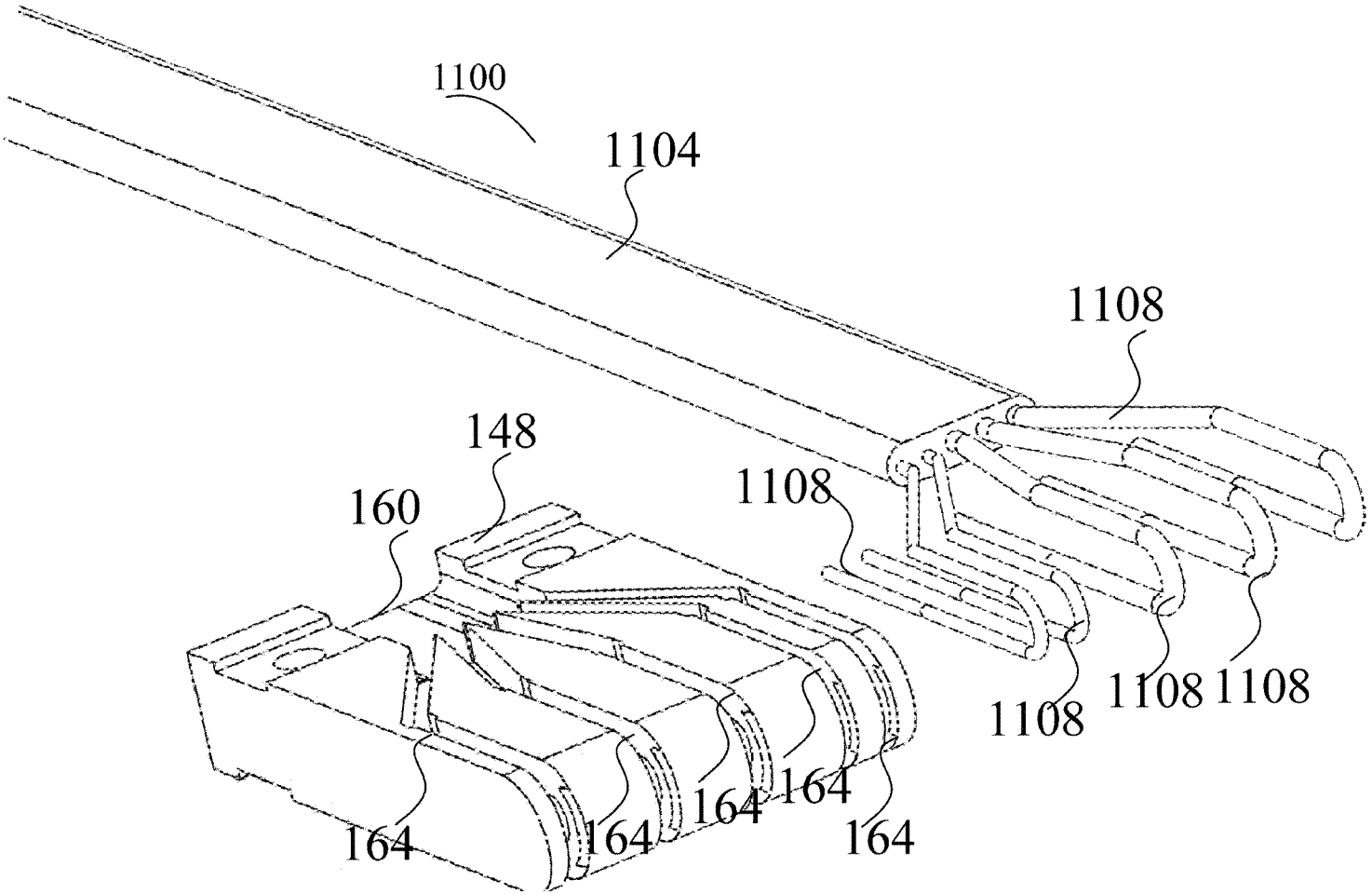
FIG. 11 is a schematic diagram illustrating an exemplary embodiment of a cable.

Referring now to FIG. 11, an exemplary embodiment 1100 of a cable 1104 is illustrated. Cable 1104 may include any cable as described above. Cable 1104 may be crimped and/or stripped to expose at least an electrically conductive wire 1108. In an embodiment, cable 1104 may include different size wires based on function. Wire may include for example communication wire and/or a power transmission wire. Channel 164 may be of a size suitable to house at least an electrically conductive wire. In an embodiment, cable 1104 may include five wires consisting of hot, neutral, ground, and 2 communication wires. In such an instance, at least a plug 148 may contain five channels 164 able to accommodate such an arrangement. Cable 1104 may be pressed into groove 160 and secured by fastener 704 and plate 708.

Figure 12:
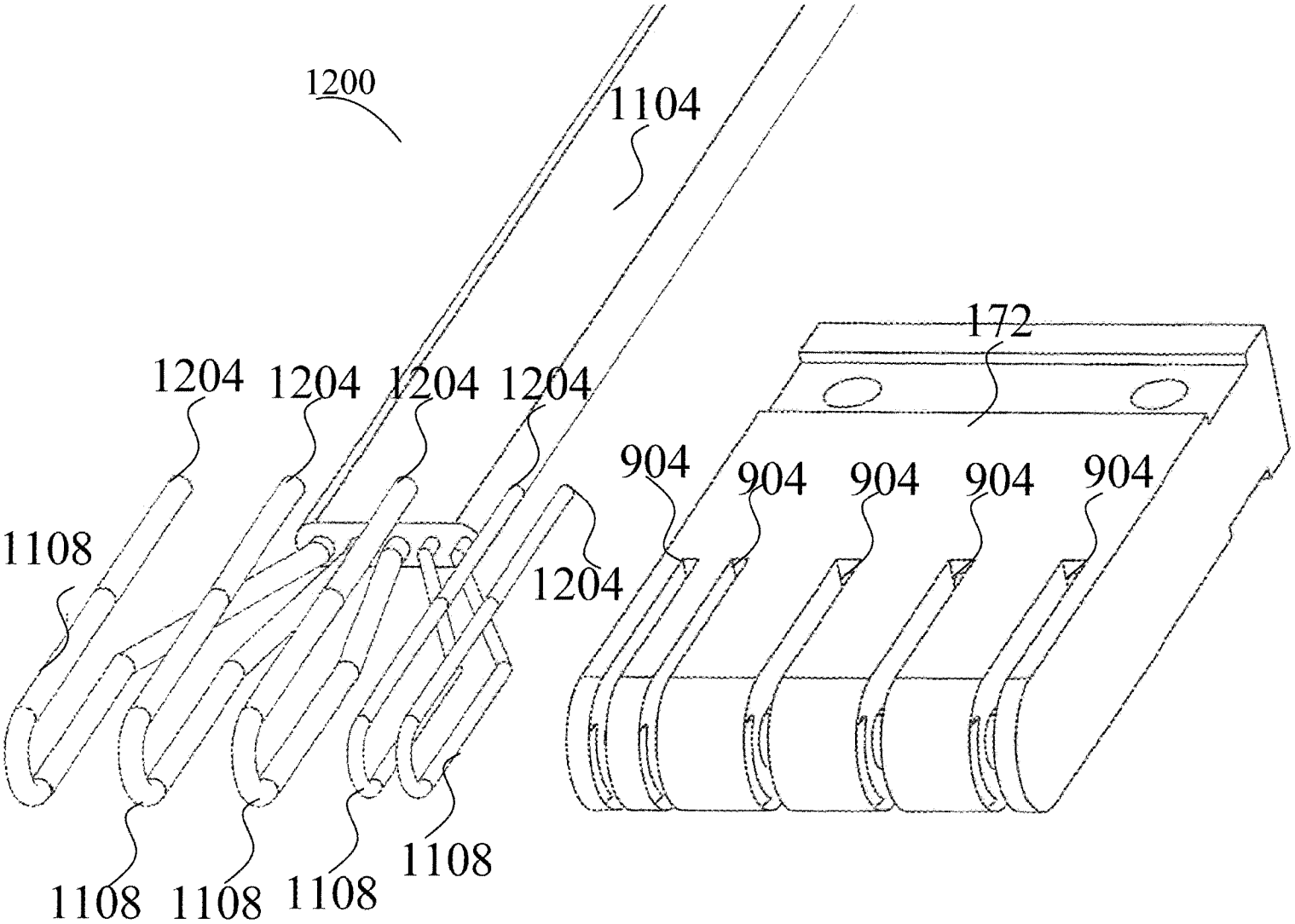
FIG. 12 is a schematic diagram illustrating an exemplary embodiment of a cable.

Referring now to FIG. 12, an exemplary embodiment 1200 of cable 1104 is illustrated. Cable 1104 may contain stripped end to expose at least an electrically conductive wire 1108. In an embodiment, wire end 1204 may be inserted into channel receptacle 904 located on dorsal surface 172 of the at least a plug 148. In an embodiment, cable 1104 may include five wires consisting of three power transmission wires which include hot, neutral, and ground wires and two communication wires. In such an instance, at least a plug 148 may contain five channels 164 able to accommodate such an arrangement. Cable 1104 may be pressed into groove 160 and secured by fastener 7044 and plate 708.

Figure 13:
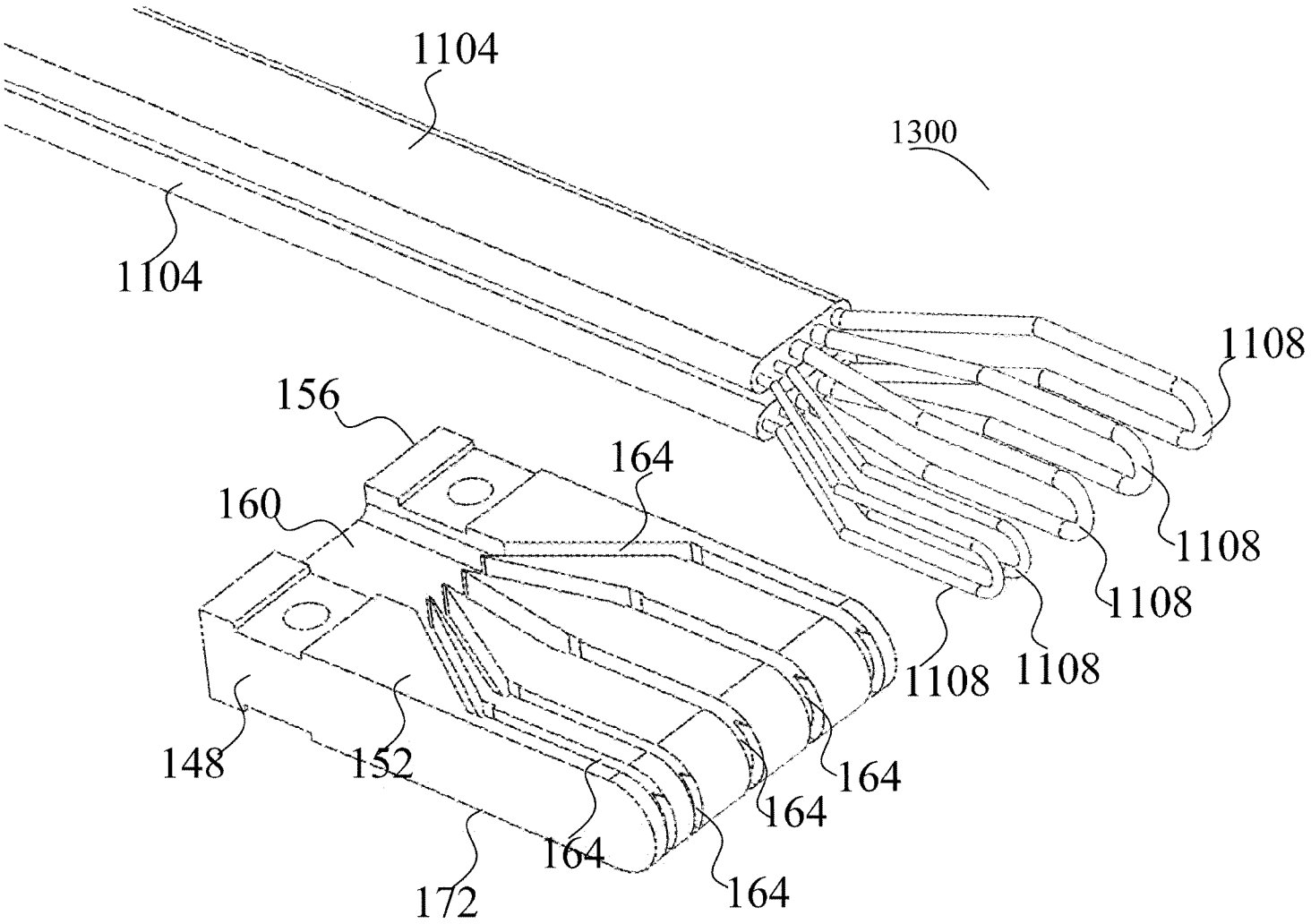
FIG. 13 is a schematic diagram illustrating an exemplary embodiment of dual cable connected to a plug.

Referring now to FIG. 13, an exemplary embodiment 1300 of dual cable 1104 connection to the at least a plug 148 is illustrated. Cable 1104 may include any of the cables as described above. Plug 148 may contain groove 160 on ventral surface 152 and dorsal surface 172. In an embodiment, groove 160 may be located at ventral lower end 156 and dorsal lower end 176. In an embodiment, groove 160 may be connected to at least a channel 164 designed and configured to house at least an electrically conductive wire. Channel size and width may correspond to type of the at least an electrically conductive wire utilized. In an embodiment, cable 1104 may include five wires consisting of three power transmission wires which include hot, neutral, and ground wires and two communication wires. In such an instance, at least a plug 148 may contain ten channels 164 able to accommodate such an arrangement with five channels 164 located on ventral surface 152 and five channels located on dorsal surface 172. Such a configuration may maximize connections and reduce waste. Cable 1104 may be pressed into groove 160 and secured by fastener 704 and plate 708.

Figure 14:
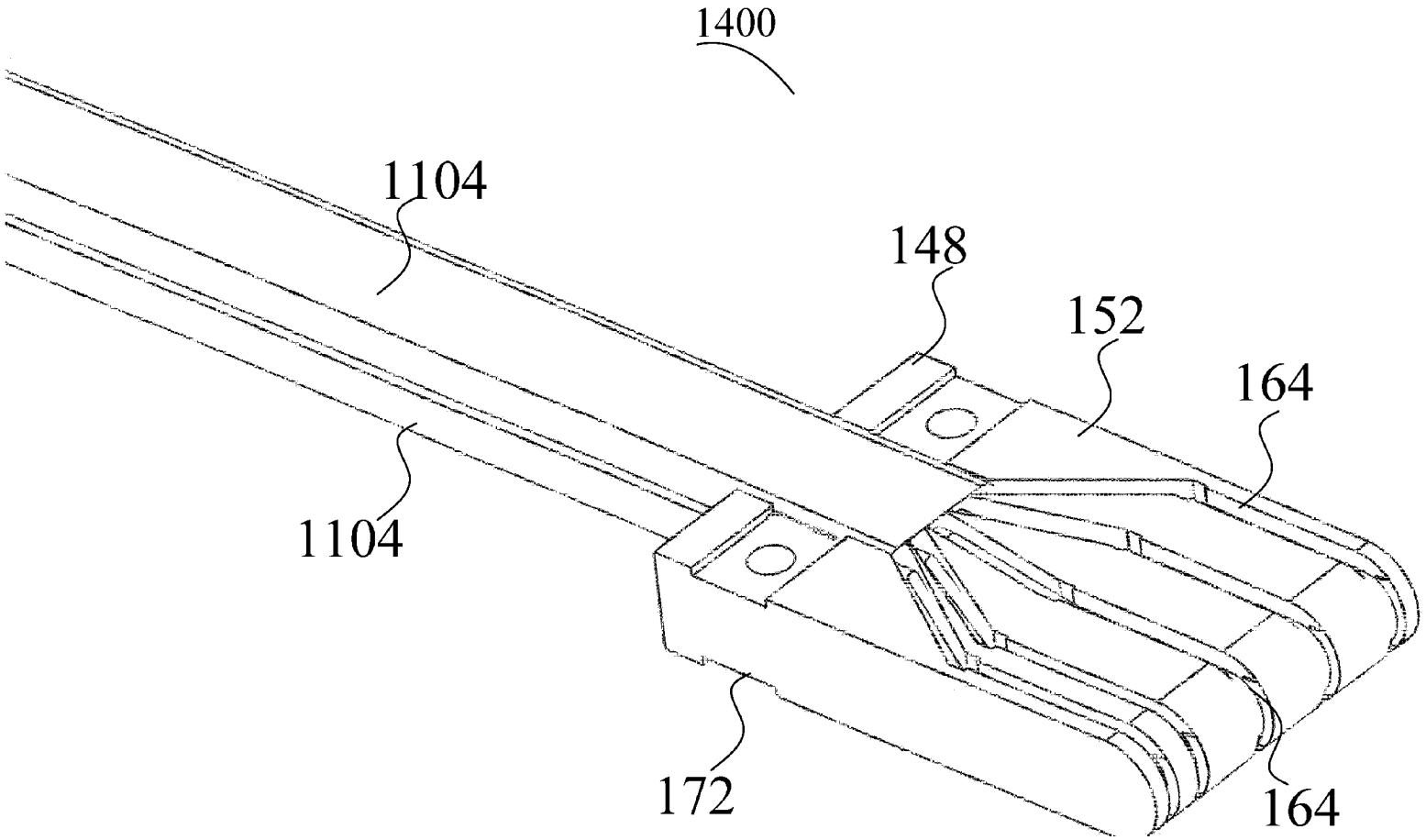
FIG. 14 is a schematic diagram illustrating an exemplary embodiment of dual cables connected to a plug.

Referring now to FIG. 14, an exemplary embodiment 1400 of at least a plug 148 connected to dual cables 1104 is illustrated. In an embodiment, cable 1104 may include five wires consisting of three power transmission wires which include hot, neutral, and ground wires and two communication wires. In such an instance, at least a plug 148 may contain ten channels 164 able to accommodate such an arrangement with five channels 164 located on ventral surface 152 and five channels located on dorsal surface 172. In an embodiment, cable 1104 may be connected to at least a plug 148 by pressing wires into channel 164. Channel 164 may be of varying sizes to accommodate different wires as discussed in more detail above.

Figure 15:
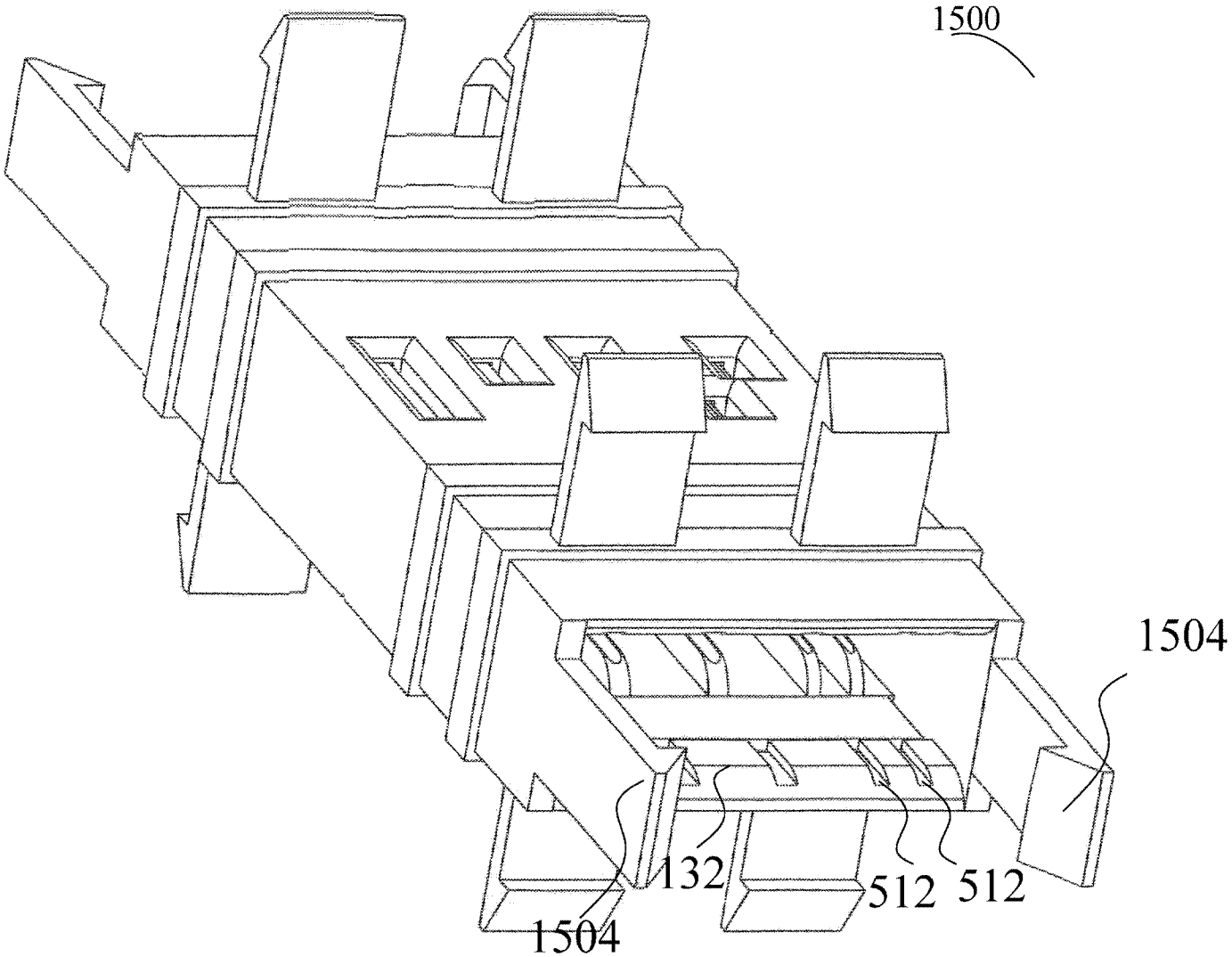
FIG. 15 is a schematic diagram illustrating an exemplary embodiment of a receptacle.

Referring now to FIG. 15, an exemplary embodiment 1500 of least a receptacle 132 is illustrated. At least a receptacle 132 may be structurally designed to connect with at least a plug 148. Receptacle 132 may include aperture 512 which may include at least a depression that may attach to and receive at least a plug 148. Aperture 512 may contain at least a depression corresponding to at least a channel 164 located on rounded edge of first side surface 184 of at least a plug 148. In an embodiment, at least a plug 148 may contain five channels 164 corresponding to five wires consisting of three power transmission wires which include hot, neutral, and ground wires and two communication wires. In such an instance aperture 512 may contain five depressions that may attach to and receive each of the five channels 164. In an embodiment, aperture 512 may contain apertures 512 of varying size corresponding to sizes of at least a channel 164. For example, at least a channel 164 housing a communication wire may be of a smaller diameter as compared to at least a channel 164 housing a power wire. Aperture 512 may allow for at least a plug 148 to maintain contact with mini-busbar 208 located within adapter module 104 to create power transmission. Receptacle 132 may include at least a protrusion 1504 which may physically encompass at least a plug 148. Protrusion 1504 may contain a grip feature that may encompass plug to provide additional support and structural integrity to hold and maintain mechanical pressure at the electrical connection. In an embodiment, protrusion 1504 may interface with plug at second side surface. In such an instance, this may allow for adapter module and plug to maintain a compact shape, thereby saving space while using minimal materials.

Figure 16:
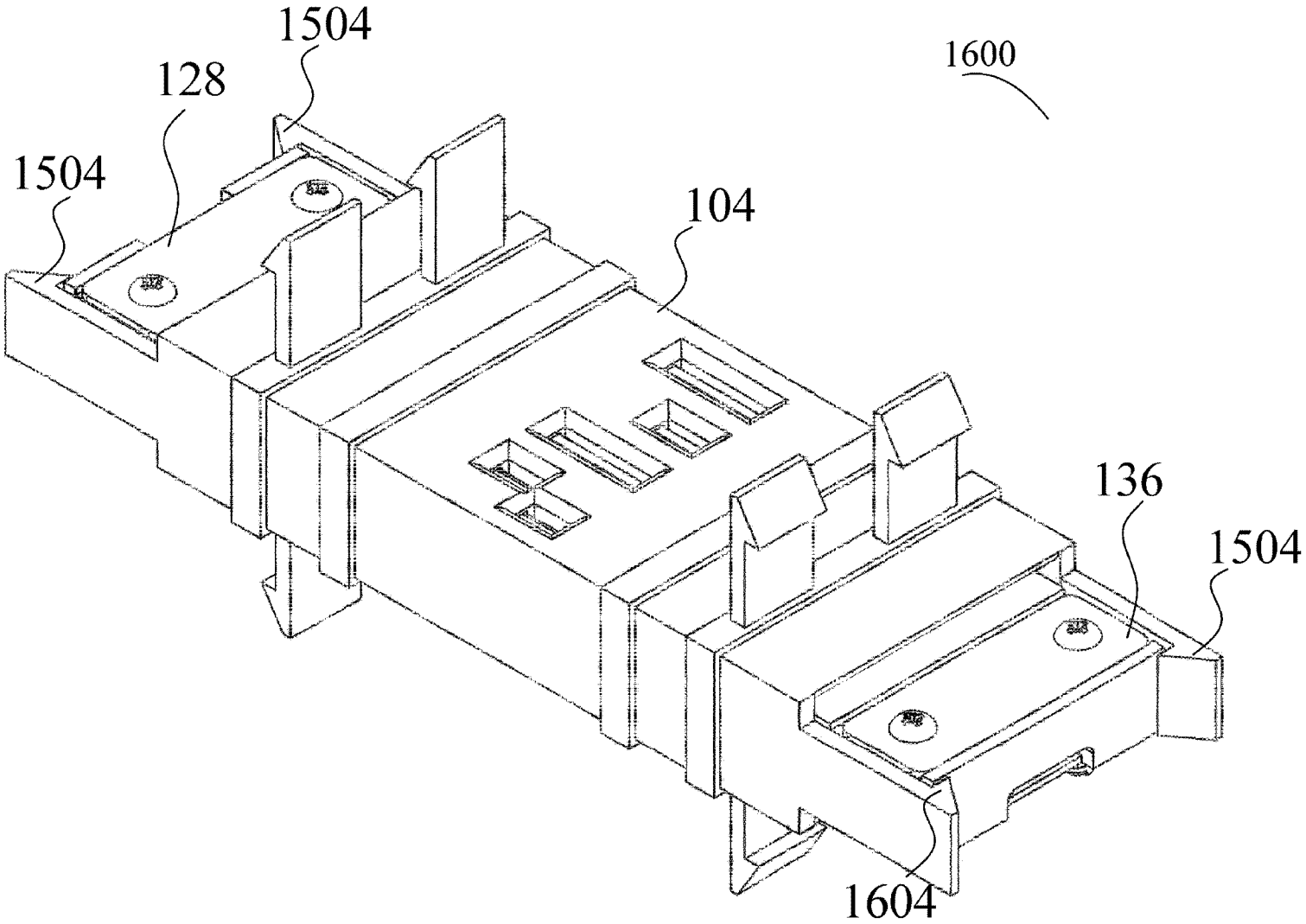
FIG. 16 is a schematic diagram illustrating an exemplary embodiment of an adapter module connected with two plugs.

Referring now to FIG. 16, an exemplary embodiment 1600 of adapter module 104 housing two plugs is illustrated. In an embodiment, adapter module 104 may include at least an end containing at least a receptacle for a plug an upper end 128 and at least an end containing at last a receptacle for a plug at lower end 136. Protrusion 1504 may grip plug to provide support and structural integrity, to hold and maintain mechanical pressure to the plug connection. System 100 includes a compact design that allows system 100 to be easily placed behind walls without taking up much room. This reduces waste that is commonly accrued at construction sites and reduces materials necessary to manufacture system 100.

Figure 17:
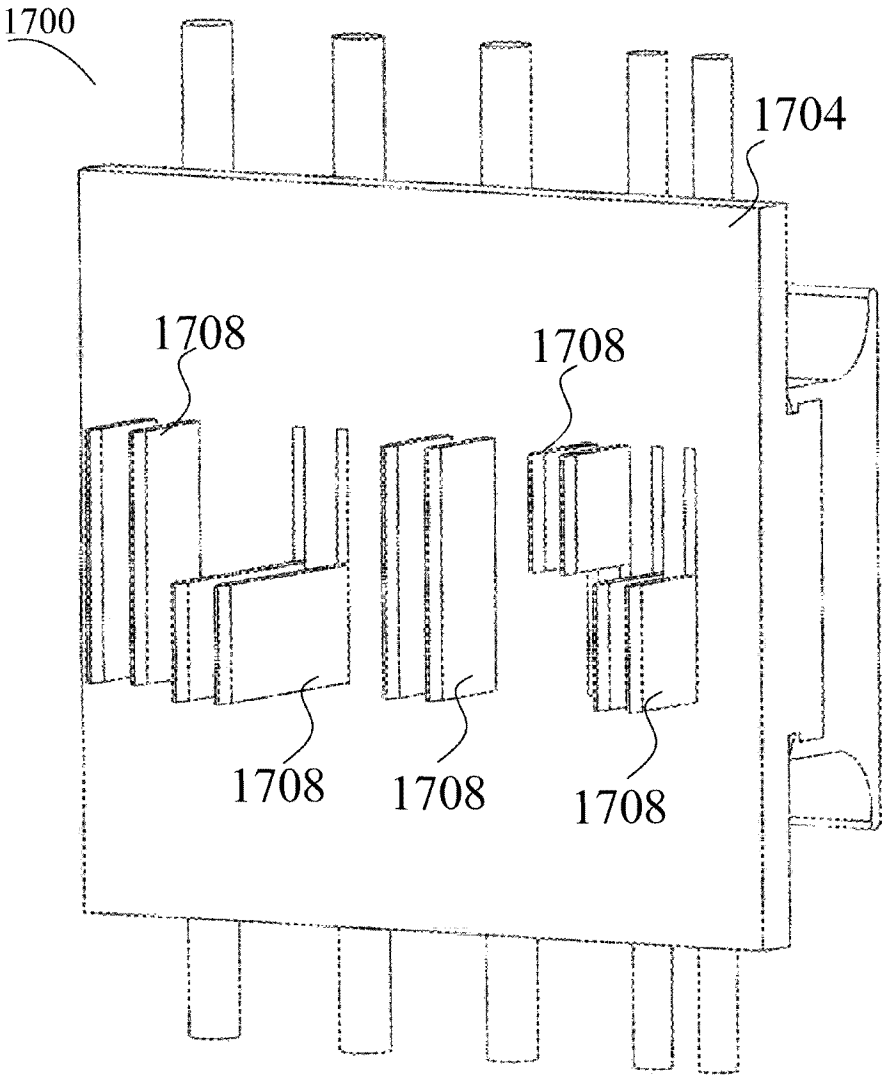
FIG. 17 is a schematic diagram illustrating an exemplary embodiment of a front side of a device plug.

Referring now to FIG. 17, an exemplary embodiment 1700 of a front side 1704 of a device plug is illustrated. Device plug may interface with electrical connector 116, which may be located on front side 112 of adapter module 104 and/or back side 124 of adapter module 104. Electrical connector 116 may contain at least a prong 120 that may connect to mini-busbar 208 located within adapter module 104 to provide electrical connections to device plug. Device plug may contain a front side 1704 that may contain at least a protrusion 1708. Protrusion 1708 may be of various shapes and may be designed and configured to attach to prong 120 located on at least an electrical connector 116. Electrical connector 116 may contain at least a prong 120 that may be of varied shapes and sizes to allow for different connections. For example, common practice may be to allow for ground first connection and polarity swap prevention. Prong 120 may be utilized for installation of devices connected to electrical box which may be connected to adapter module 104. In an embodiment, electrical connector 116 may contain five prongs, with one prong connected to a ground wire, one prong connected to a hot wire, one prong connected to a neutral wire, and two prongs connected to a communication wire. In such an instance, device plug may contain at least five protrusions that may connect with each of the five prongs.

Figure 18:
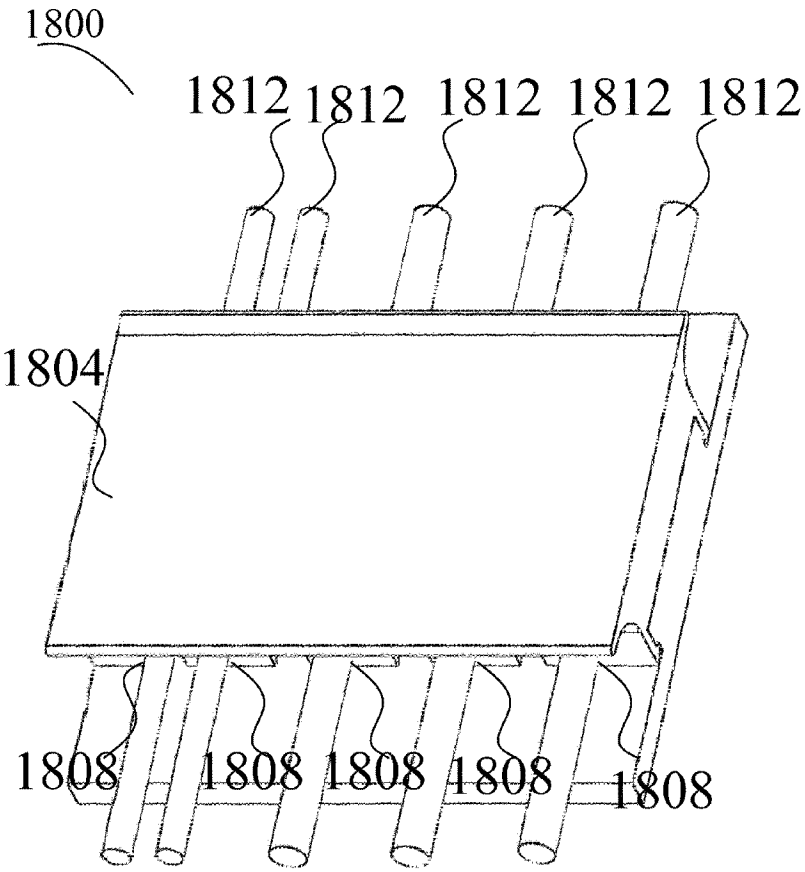
FIG. 18 is a schematic diagram illustrating an exemplary embodiment of a back side of a device plug.

Referring now to FIG. 18, an exemplary embodiment 1800 of back side 1804 of device plug is illustrated. Device plug may contain back side 1804. Back side 1804 may contain a groove 1808 designed and configured to house at least an electrically conductive wire 1812. Electrically conductive wire 1812 may include any of the wires as described above including any power transmission wires such as neutral, hot, and ground wires and/or communication wire. Electrically conductive wire 1812 may be of varying size and shape based on type of wire utilized. For example, a communication wire may have a smaller diameter as compared to a line wire.

Figure 19:
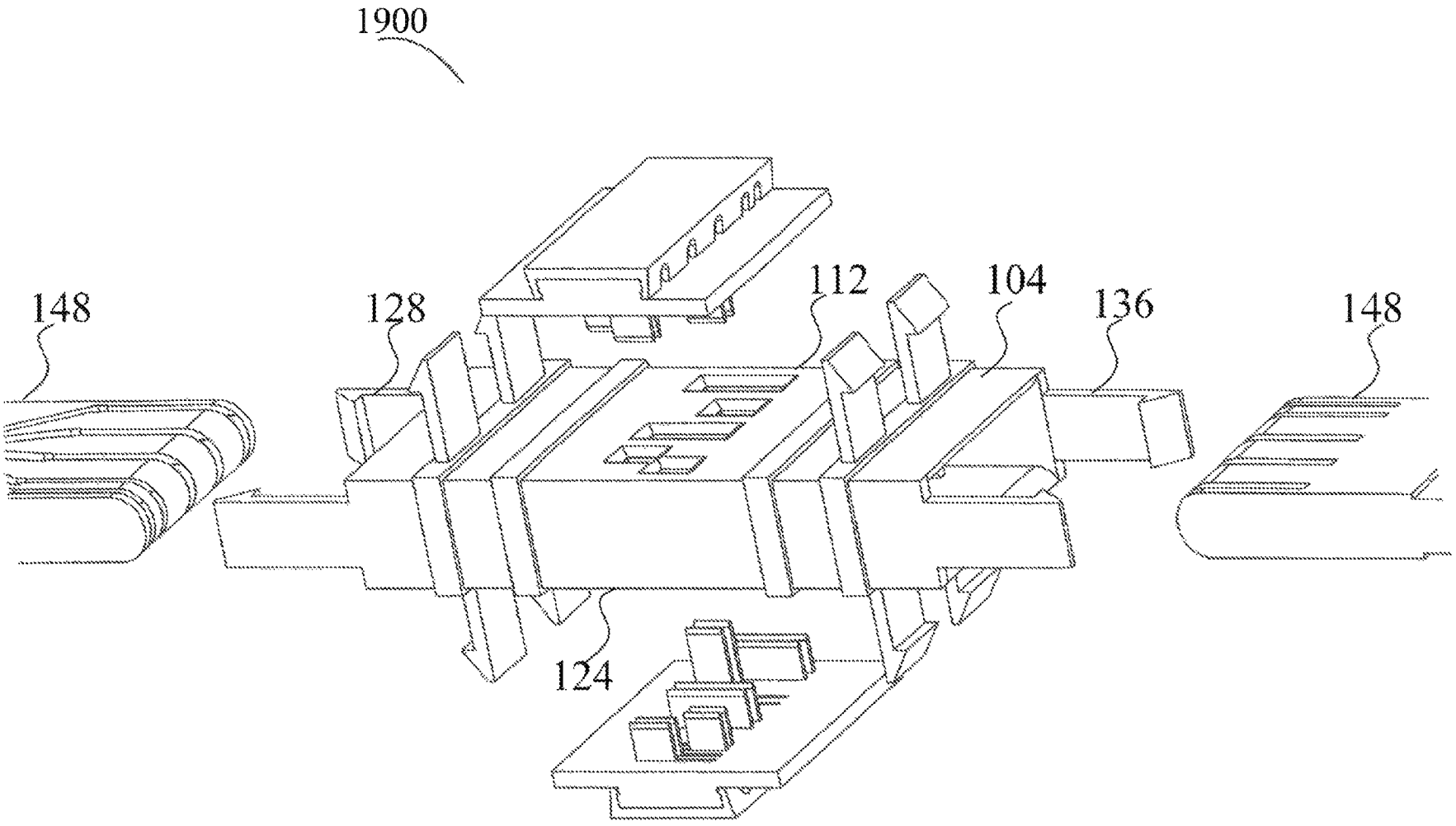
FIG. 19 is a schematic diagram illustrating an exemplary embodiment of device and plug connections on an adapter module.

Referring now to FIG. 19, an exemplary embodiment 1900 of device and plug connections available on an adapter module 104 are illustrated. In an embodiment, adapter module 104 may be able to receive connections from all four sides. For example, adapter module 104 may be connected to at least a plug at upper end 128, adapter module 104 may be connected to at least a plug at lower end 136, adapter module 104 may contain at least an electrical connector on front side 112, and adapter module 104 may contain at least an electrical connector on back side 124. Design of system 100 allows for compact fit of parts while maximizing possible connections. In an embodiment, adapter module 104 may be able to connect with at least a plug 148 at upper end 128 and lower end 136. At least a plug 148 may contain groove 160 located on ventral surface 152 and dorsal surface 172, thereby maximizing connections by being able to connect with two cables. In such an instance, upper end 128 may connect with at least a plug 148 connected to two cables and lower end 136 may connect with at least a plug 148 connected to two cables. In an embodiment, adapter module 104 may contain at least an electrical connector 116 located on front side 112 and back side 124. This feature may allow for connection to multiple devices. In such an instance, system 100 may be positioned in a wall separating two rooms. Devices located in both rooms may be able to connect with adapter module 104. This is a major advantage to current wiring systems as currently access to connect a device is only possible form one side. This system creates a compact, efficient wiring system that allows for multiple devices to be connected from multiple rooms.

Figure 20:
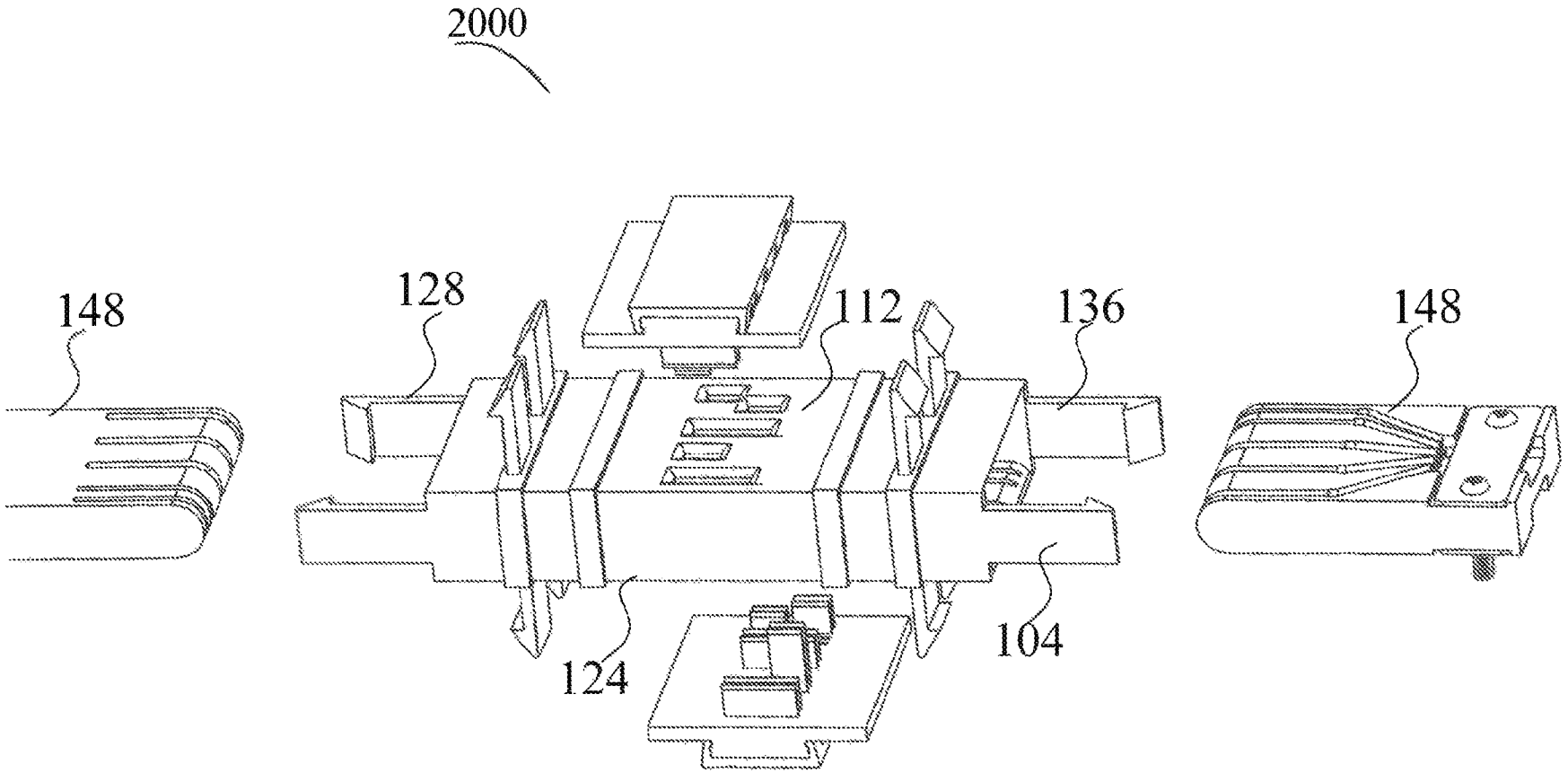
FIG. 20 is a schematic diagram illustrating an exemplary embodiment of four-sided connections available on adapter module.

Referring now to FIG. 20, an exemplary embodiment 2000 of four-sided connections available on adapter module 104 are illustrated. In an embodiment, adapter module 104 may accept a connection to a device plug, such as the device plug illustrated in FIGS. 17-18 at electrical connector 116 located on front side 112. Adapter module 104 may accept a connection to a device plug, such as the device plug illustrated in FIGS. 17-18 at electrical connector 116 located on back side 124. Adapter module 104 may accept a connection to a plug 148 at upper end 128. Adapter module 104 may accept a connection to a plug 148 at lower end 136. Four connections available on adapter module provides the ability to integrate smart home technology in a plug and play format. Current smart home technology devices are cumbersome to install and maintain mostly due to inefficient connectivity methods that include multiple small parts such as wire nuts. Connecting small stranded wires to heavier gauge solid conductors can be a frustrating job that is not user friendly. Communication wires housed within plug and connected to adapter module allows for integration of smart technology that a user can potentially install without the assistance of an electrician. Four connections maximize efficiency of adapter module while taking up very little space.

Figure 21:
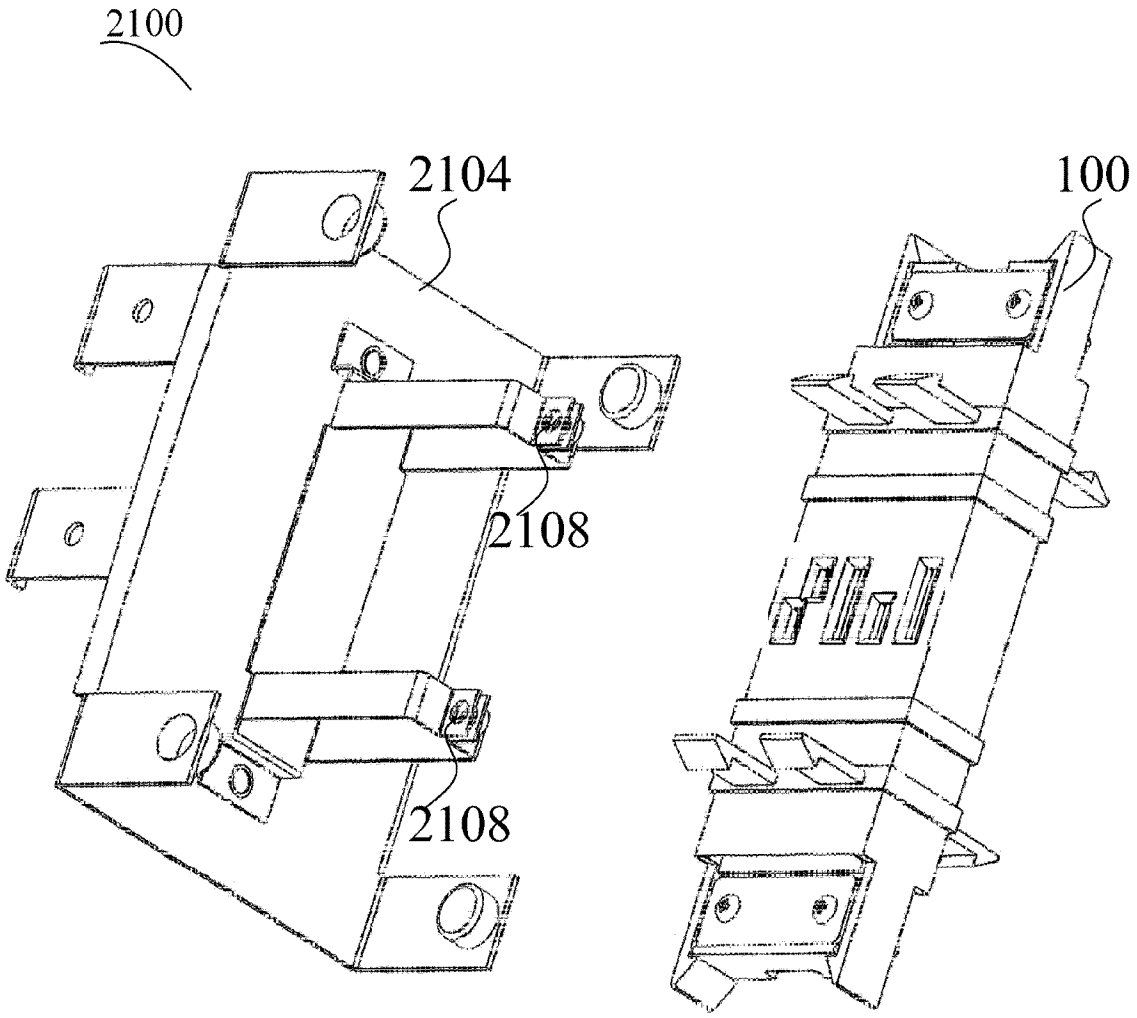
FIG. 21 is a schematic diagram illustrating an exemplary embodiment of a stud mount bracket.

Referring now to FIG. 21, an exemplary embodiment 2100 of system 100 located next to a stud mount bracket 2104 is illustrated. Stud mount bracket 2104 may include an overhanging member that projects from a stud and is designed to support at least a magnet. Four magnets are able to be supported at each bracket. A top magnet, a bottom magnet, behind the layers of wallboard on both sides of a wall. Magnet may include any object made from a material that is magnetized and creates its own persistent magnetic field. Magnetized material may include for example, ferromagnetic elements such as iron, nickel, and/or cobalt. In an embodiment, at least a magnet may be placed on at least a stud mount bracket 2104 to enable detection of system 100 at any time. For example, system 100 may be positioned in a wall mounted to a wall stud and covered by sheet rock during construction of a building. System 100 can later be detected to determine where electrical connections can be established by detecting at least a magnet located on stud mount bracket 2104 by another magnet as opposite poles of magnetic fields attract to one another. For example, when placed in close contact, the north pole of one magnet attracts to the south pole of another magnet. In yet another non-limiting example, certain magnet detecting tools that aid in locating a magnetic field surrounding at least a magnet may be utilized, such as the EXTECH MD10 as produced by Extech Instruments of Waltham, Mass., and/or C.H. HANSON MAGNETIC STUD FINDER as produced by C.H. Hanson of Naperville, Ill.

With continued reference to FIG. 21, a stud may include board such as a vertical framing member that functions as a framing element in a building's wall. Stud mount bracket 2104 may be composed of material such as metal, wood and the like. Studs may be spaced at certain intervals such as either 16 or 24 inches on-center measured from center to center, along the wall. Studs may run between the floor and ceiling in a building. Drywall may be attached at edge of stud. Studs provide additional sturdiness to create additional support to hold items mounted on a wall in place, such as when mounting to drywall may not provide sufficient support. Studs may be utilized for mounting in both a home setting and/or commercial setting. Studs may be composed of certain material such as wood and may be of certain diameters such as two inches by four inches or two inches. Stud mount bracket 2104 may contain at least an opening 2108 which as used herein is a hole contained within stud mount bracket 2104. Opening 2108 may be utilized to secure system 100 to stud mount bracket 2104. System 100 may be secured to stud mount bracket 2104 by a fastener that may be housed within opening 2108. Fastener may include any of the fasteners as described above, for example a screw, bolt, stud, threaded fastener, carriage bolt, rivet, threaded rod, and the like. Fastener may be composed of material such as steel, brass, nickel, aluminum, and the like. Fastener may be covered by a protective coating to protect fastener from corrosion over time, to create a decorative finish, and/or to alter the surface properties of the base materials. Different length fasteners may be utilized depending on varying adapter mounting options. Fastener may be selected on other factors including for example required strength, size that will fit through opening located on stud mount bracket, as well as conditions fastener may be exposed to. For example, a fastener in an industrial manufacturing plant may need to be composed of different materials and withstand different temperatures than a fastener in a climate-controlled condominium building. In an embodiment, stud mount bracket 2104 may contain a pair of jaws that may each contain an opening 2108. Jaws may encompass system 100 and make contact with system 100 at adapter module housing 108, thereby leaving all four possible sides for connections exposed and able to connect to at least a plug and/or device. Jaws may encompass system 100 to allow vertical mount of system 100 within stud, so that access from all four possible sides is retained once stud mount bracket 2104 containing system 100 is mounted to a surface such as a stud or wall.

Figure 22:
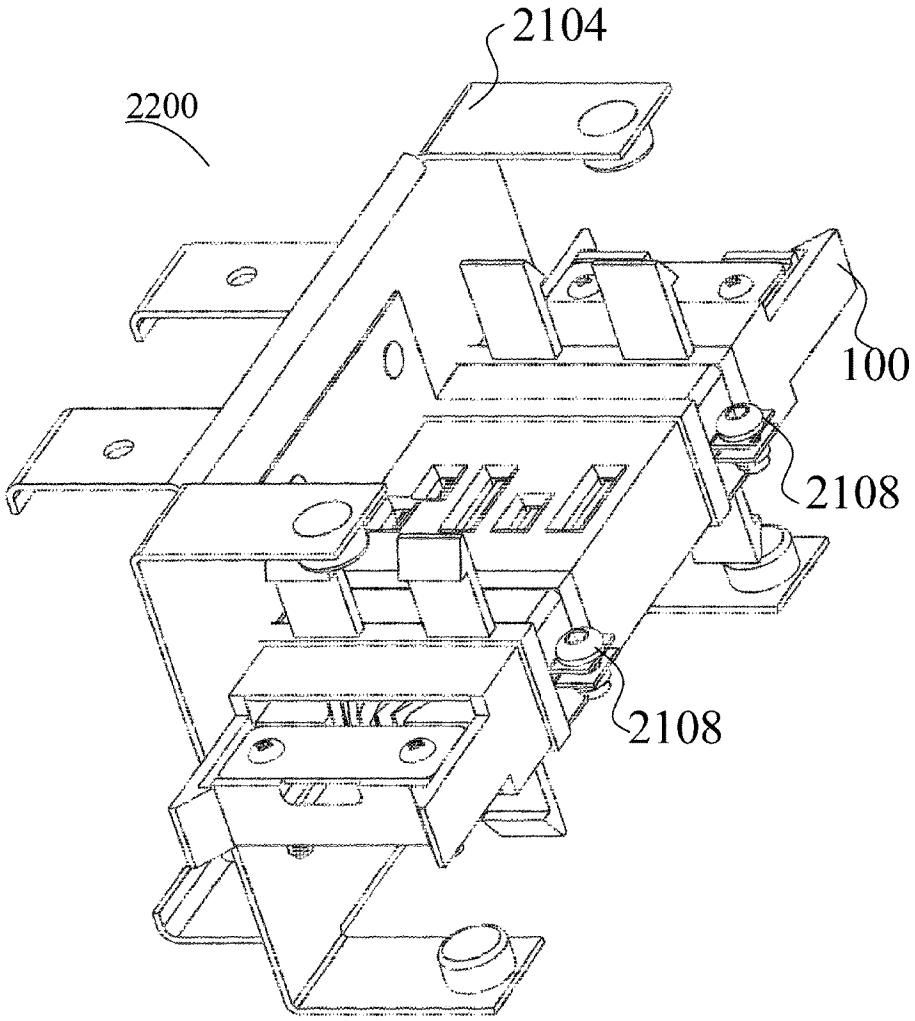
FIG. 22 is a schematic diagram illustrating an exemplary embodiment of a mounting to a stud mount bracket.

Referring now to FIG. 22, an exemplary embodiment 2200 of system 100 connected to stud mount bracket is illustrated. System 100 is connected to stud mount bracket 2104 by fasteners housed within openings 2108 located on stud mount bracket 2104. Fastener may include any of the fasteners described above. In an embodiment, stud mount bracket 2108 may connect to system 100 at housing 108. In such an instance, system 100 may be vertically mounted within stud mount bracket 2108 so as to preserve all four possible connection sites located at electrical connector 116 on front side 112, electrical connector 116 located on back side 124, at least a plug located at upper end 128 and at least a plug located at lower end 136. Stud mount bracket 2108 may then be vertically mounted onto a structure such as a wall or stud, thereby preserving all possible connection sites on system 100. Vertical mount may also be advantageous when system 100 contained within stud mount bracket 2108 is mounted to a wall or stud separating two rooms, thereby allowing access from either room. This reduces waste by maximizing connection sites on system 100 while preserving space within walls and studs to have more room for devices to be connected.

Figure 23:
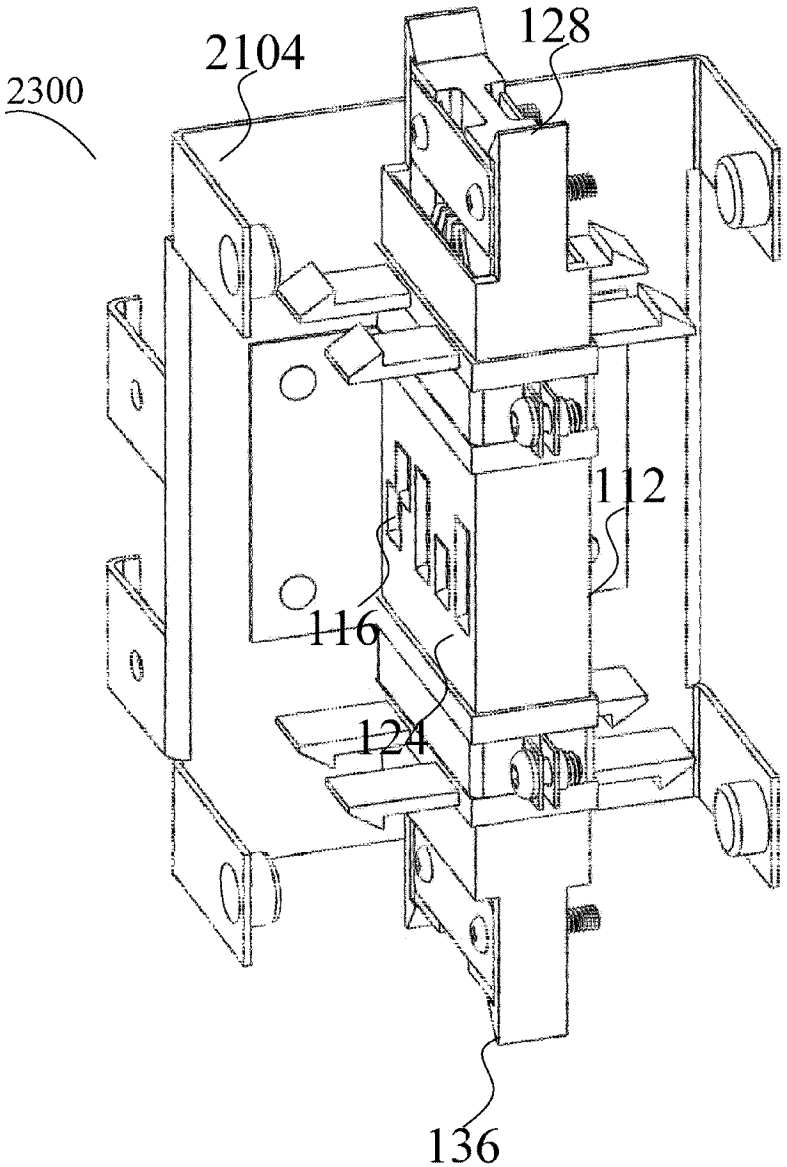
FIG. 23 is a schematic diagram illustrating an exemplary embodiment of a vertical mounting to a stud mount bracket.

Referring now to FIG. 23, an exemplary embodiment 2300 of vertical connection of system 100 to stud mount bracket in a center mount position is illustrated. System 100 is connected to stud mount bracket 2104 in a vertical position whereby upper end 128 of adapter module 104 points north, and lower end 136 of adapter module 104 points south, thereby preserving all four possible connections of system 100 as described in more detail above in FIG. 22. Stud mount bracket 2104 may then be mounted to a stud by fasteners connected through openings located on back side of stud mount bracket 2104 as described in more detail above. In an embodiment, vertical connection of system 100 to stud mount bracket 2104 allows for vertical position on a stud, so that electrical connector 116 located on front side 112 may connect with devices located in one room in a building, and electrical connector 116 located on back side 124 may connect with devices located in a second room in a building that share a stud. This is advantageous compared to current available technology, as the ability to share a connection for devices from different rooms at the same outlet point, does not currently exist. Vertical position enables back to back electrical boxes to be installed on mounting bracket. This highlights a major resource conservation feature, as currently methods only allow access from one side of wall at a time, because of inefficient space use of current wiring system. Compact nature of vertical connection of system 100 allows for more space to be preserved behind a wall or stud for devices. User can upgrade switches without accessing live parts, creating a plug and play type of equipment. Vertical position of system 100 on a stud allows for back to back electrical box installation on single adapter module as described in more detail below. This is a major advantage as electrical boxes can be installed from either side of wall. Also aids in reducing waste by increasing the number outlets each connection to cable can produce. This reduces material waste and also saves time and effort when installed. Further, the design of system 100 allows for expansion of electrical box to occur without disturbing adapter module 104 or any of the wiring.

Figure 24:
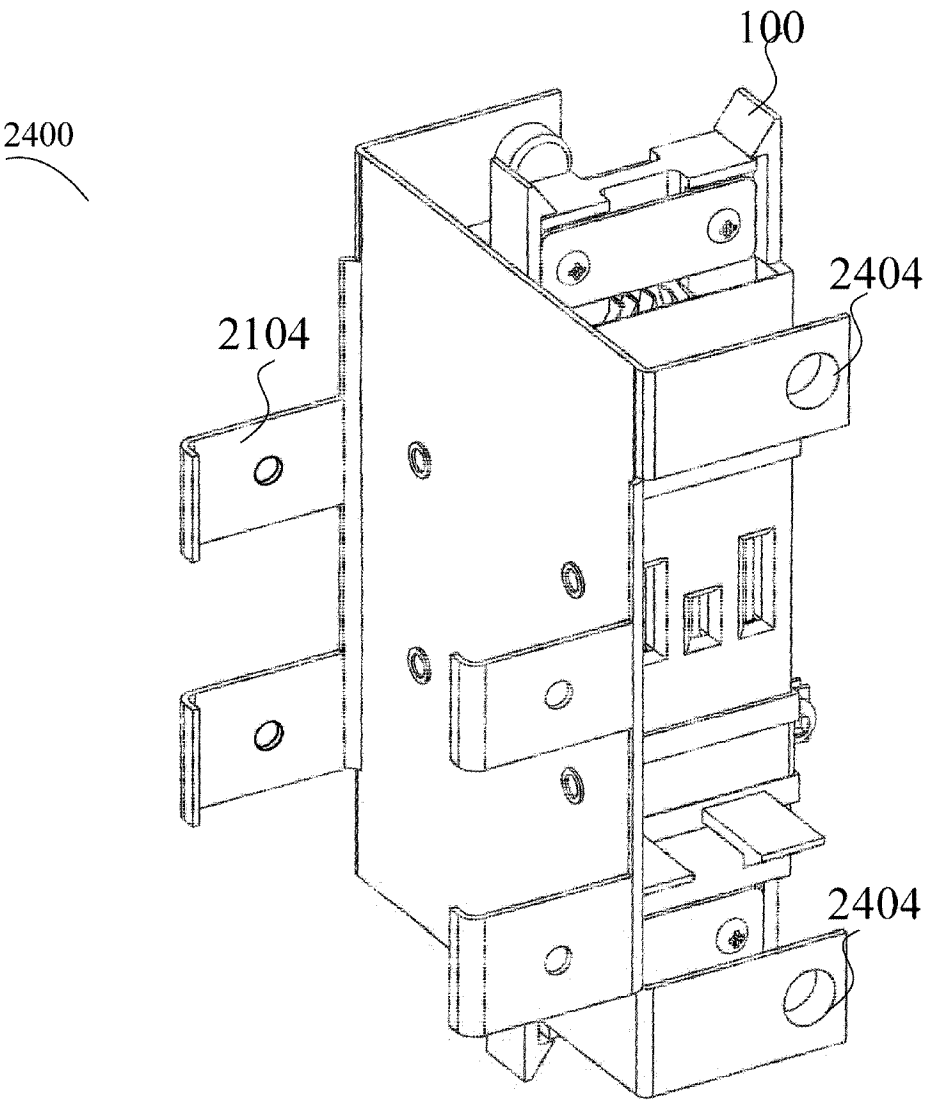
FIG. 24 is a schematic diagram illustrating an exemplary embodiment of a clip-on stud bracket.

Referring now to FIG. 24, an exemplary embodiment of center mount position 2400 is illustrated. Center mount position allows for back to back electrical boxes to connect to mounting feature 504 located on adapter module 104. Back to back electrical boxes allow for back to back electrical outlet installation. This may be advantageous such as when adapter module 104 is mounted to wall that divides rooms. Device plugs may be connected to electrical connector 116 located on front side 112 and back side 124 of adapter module 104 to connect with devices in both rooms. This may be advantageous such as when a room is later divided, and a new device connection needs to be established. Compact back to back design allows for additional space inside the wall for devices. Center mount position of electrical boxes also allows for electrical boxes to be easily swapped out and expanded. For example, a single gang electrical box can be easily exchanged for a double or triple gang electrical box as described in more detail below. Center mount position eliminates additional dimensional variables associated with current methods and contribute to more predictable job completion requirements. Center mount position places system 100 as far back from cutting and drilling tools on either surface of a wall or stud. Current wiring methods do not allow access to same outlet from both sides of the wall. Current wiring methods also tend to result in a messy mass of wires in an electrical box, which can be difficult and sometimes even dangerous to work with. Center mount position both on the stud mount bracket and in the wall improves safety while also providing access to a power source from both sides of the wall. Dual access reduces materials and time necessary to complete installation. Center mount configuration removes live part recess out of reach of accidental contact by placing system 100 as far back as possible. Center mount position is also suitable for shallow walls such as those found in mobile homes, campers, cruise ships and the like. Center mount configuration also eliminates electrical box depth adjustment as electrical box depth is standard stud size and designed to fit within onto common construction code sheetrock thickness. This may be of use in creating materials list for each project as analyzing electrical and wall specifications would allow one to generate a list of all parts necessary to complete a job, thus increasing efficiency and reducing waste. In an embodiment, stud mount bracket 2104 may contain a magnet housing socket 2404. Magnet housing socket 2404 may contain at least a magnet that may be utilized in detecting system 100 as described above in reference to FIG. 21.

Figure 25:
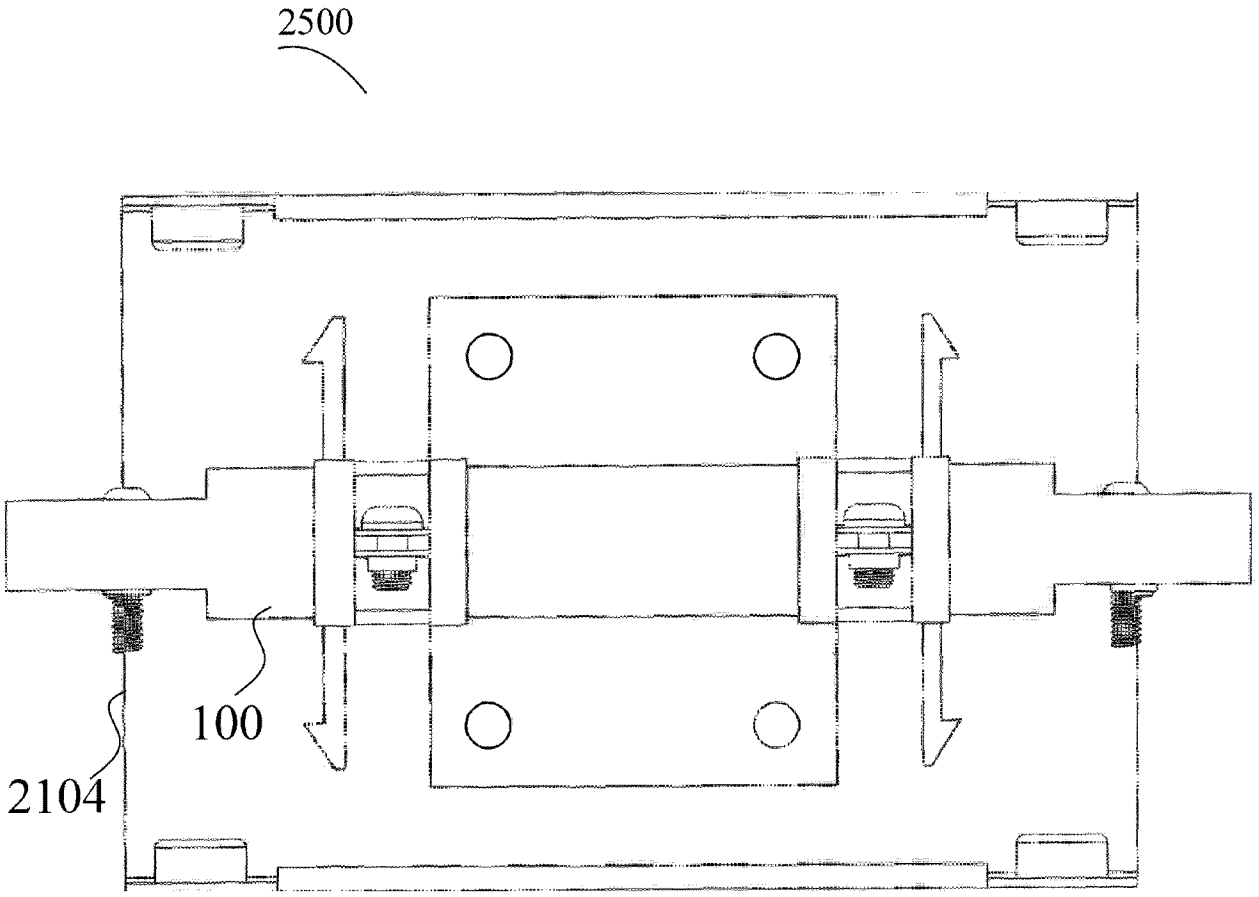
FIG. 25 is a schematic diagram illustrating an exemplary embodiment of a center mount position.

Referring now to FIG. 25, an exemplary embodiment 2500 of system 100 mounted to stud mount bracket 2104 is illustrated. System 100 is mounted in center mount position to maintain all four possible connection sites as described in more detail above in reference to FIGS. 20-24.

Figure 26:
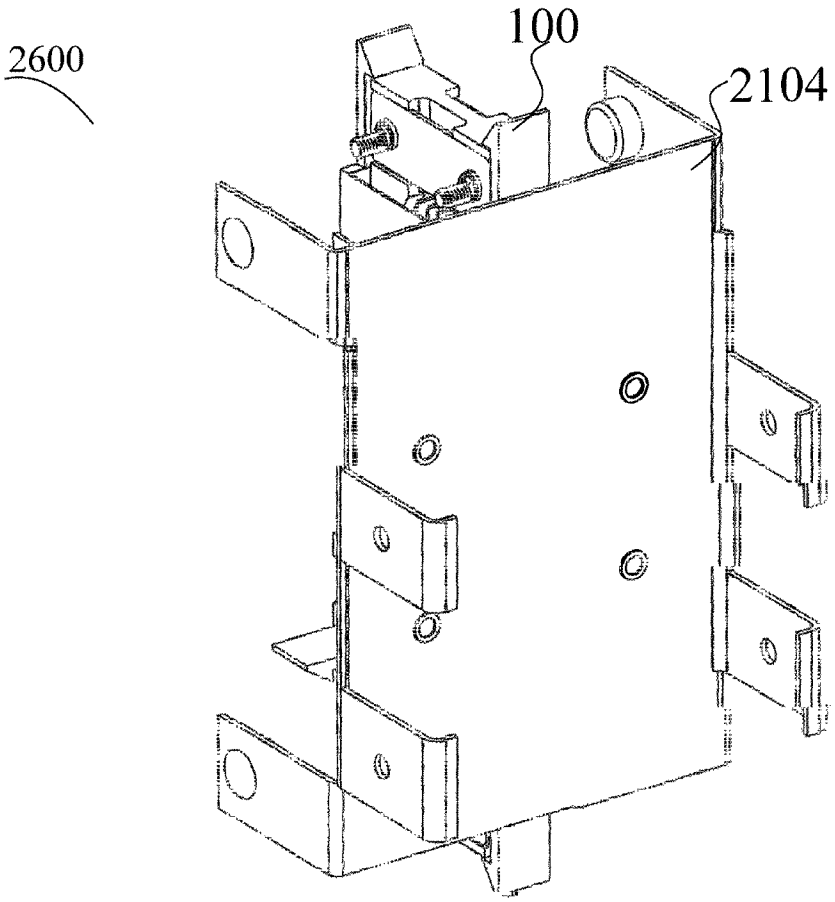
FIG. 26 is a schematic diagram illustrating an exemplary embodiment of a back view of stud mount bracket.

Referring now to FIG. 26, an exemplary embodiment 2600 of back view of stud mount bracket 2104 connected to system 100 is illustrated. Compact design allows for system 100 to be mounted to a single stud or at a single location on a wall. Center mount position and vertical position of adapter module 104 connected to stud mount bracket maintains all four possible connection sites as described in more detail above in reference to FIG. 20.

Figure 27:
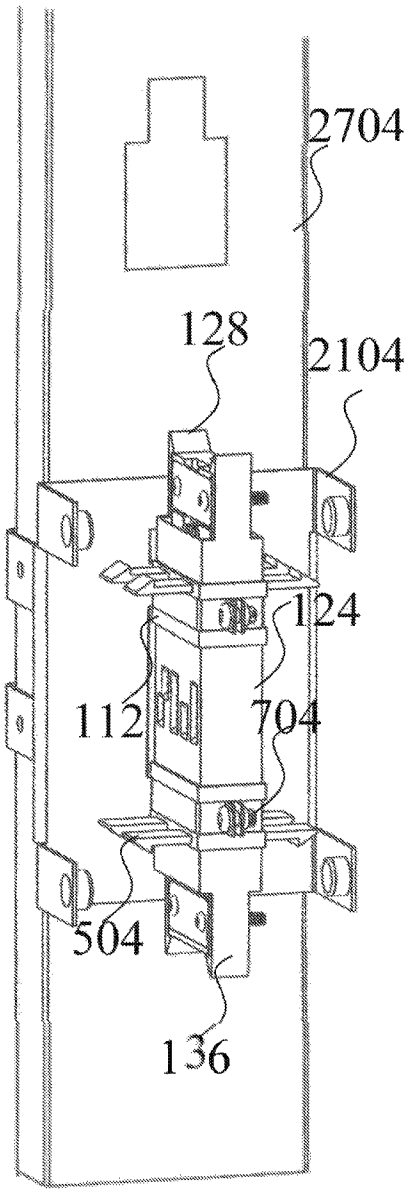
FIG. 27 is a schematic diagram illustrating an exemplary embodiment of a mount to a wall stud.

Referring now to FIG. 27, an exemplary embodiment 2700 of system 100 mounted to a wall stud 2704 is illustrated. Wall stud 2704 may include any of the studs as described above. In an embodiment, system 100 is mounted in center of stud mount bracket 2104 and secured by fastener 704. Center-mount position may allow adapter module 104 to accept connections at four possible directions, which may include a connection at electrical connector 116 located on front side 112, a connection at electrical connector 116 located on back side 124, a connection at plug 148 located at upper end 128, and a connection at plug 148 located at lower end 136. This offers numerous advantages as it allows device access from front side 112 and back side 124. Center mount position allows for electrical box to be connected to adapter module 104 to front side 112 and back side 124, thereby maintaining an even alignment with a finished wall board surface as described in more detail below. Electrical box may connect to adapter module 104 at mounting feature 504. Electrical box may include any of the electrical boxes as described above, including for example a single gang, double gang, and triple gang electrical box. Single gang electrical box may include an electrical box that is of a particular width to accommodate a single switch or duplex receptacle. Double gang electrical box may include an electrical box that is of a particular width to accommodate a double switch or two duplex receptacles. Triple gang electrical box may include an electrical box that is of a particular width to accommodate a triple switch or three duplex receptacles. Electrical box may be constructed to fit any standard United States outlet. Electrical box may be constructed of certain materials such as for example, metallic material such including stainless steel, aluminum, cast iron, and/or nonmetallic material such as polyvinyl chloride (PVC), and/or plastic. In an embodiment, mounting feature 504 which may include a clip-on feature may attach to side of electrical box. For example, mounting feature 504 located on front side 112 of adapter module 104 and back side 124 of adapter module 104 may allow for attachment of electrical box on both the front side 112 and back side 124. In an embodiment, stud mount bracket 2104 may be mounted to stud 2704 located in a wall separating two rooms, allowing devices located in both rooms to utilize power source from system 100. Compact design of system 100, reduces waste as current methods only allow for one electrical box to be connected to one outlet point. This may assist in streamlining functions of construction crew such as electricians and plumbers as there is less wasted space behind walls and greater amount of space to connect more devices. In an embodiment, at least a magnet located on stud mount bracket 2104 allows for system 100 to be located after installation. For example, an electrician may install system 100 on a stud during construction but not connect any devices or electrical boxes to system 100. Later on, to located system 100, an electrician may use a magnet detecting tool and locate system 100 within a wall. Electrician may then cut a hole in the wall and attach an electrical box, allowing for devices to be attached and ready to be hooked up with very little work as detection magnets will allow a precise hole cutout in the wall. Currently, locating connections for electrical boxes can be very cumbersome and lead to multiple holes having to be cut out of a wall. System 100 streamlines this by allowing for precise detection and size allowing for one single hole to be made.

Figure 28:
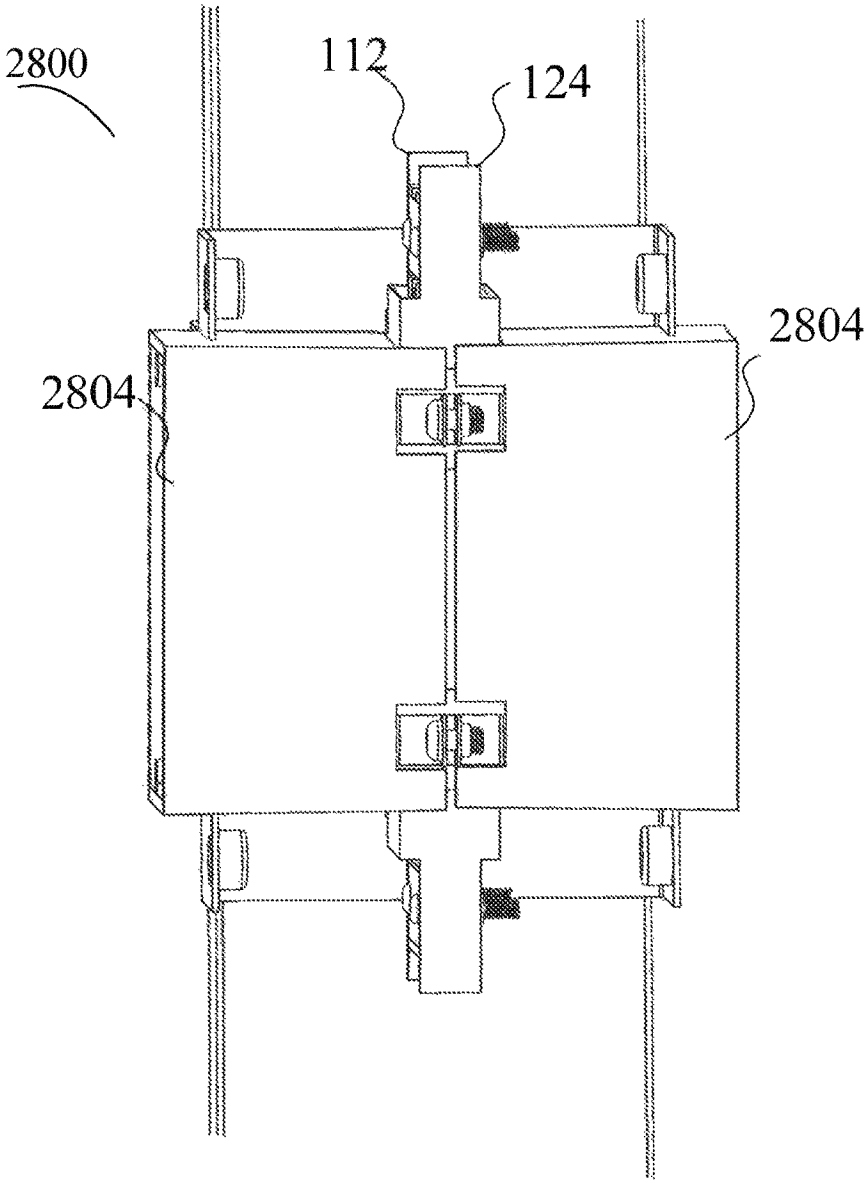
FIG. 28 is a schematic diagram illustrating an exemplary embodiment of a mount to an electrical box.

Referring now to FIG. 28, an exemplary embodiment of 2800 of electrical box 2804 mounted to system 100 is illustrated. In an embodiment, system 100 may accommodate a single gang electrical box 2804, with one mounted to front side 112 of adapter module 104 and one mounted to back side 124 of adapter module 104. Advantage of center mount configuration of system 100 on stud mount bracket 2104 as it allows for electrical boxes to protrude equally on both sides of the wall for equal alignment. This may also allow for a finished wall board surface to be placed over the electrical boxes uniformly so as to create an even surface. In an embodiment, an electrical box 2804 such as a single gang electrical box may attach to front side 112 and/or back side 124 of adapter module 104 by mounting feature 504. For example, mounting feature 504 may include a clip-on bracket that may interface with single gang electrical box 2804 and clip into place. This clip-on feature may allow for very little positioning and adjustment of single gang electrical box 2804, thereby allowing for quick installation. This feature may also allow for easy swap out of a single gang electrical box for a double gang electrical box or triple gang electrical box. For example, single gang electrical box may be connected however more switches may be necessary. Electrician or user can simply unclip single gang electrical box and clip on double or triple gang electrical box. In an embodiment, this may easily be completed after installation. For example, at least a magnet located on stud mount bracket 2104 may allow for precise detection of location of system 100 within a wall or stud. Electrician may detect precise location using a magnet sensing tool, cut precise hole and snap in a single gang electrical box or a double or triple gang electrical box depending on needs of a user.

Figure 29:
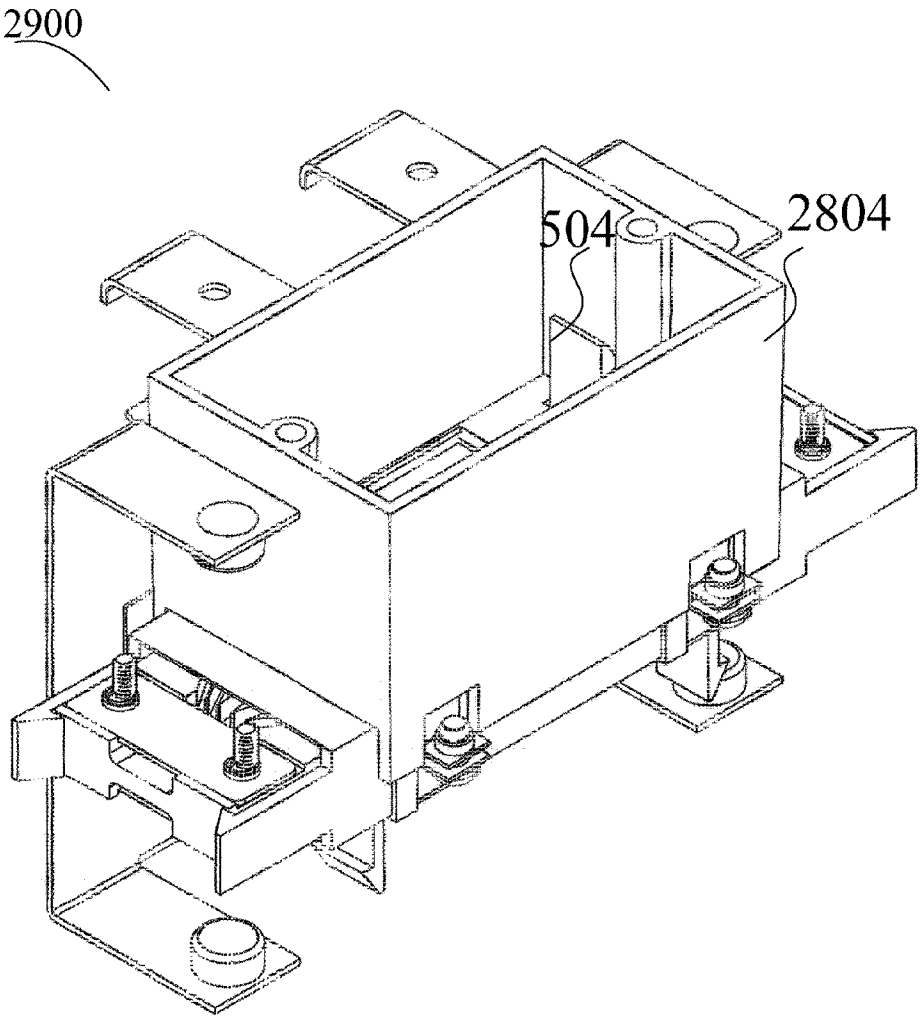
FIG. 29 is a schematic diagram illustrating an exemplary embodiment of a single gang electrical box.

Referring now to FIG. 29, an exemplary embodiment 2900 of a single gang electrical box connected to system 100 mounted on a stud mount bracket is illustrated. Electrical box 2804 such as a single gang electrical box may attach to system 100 at mounting feature 504. Single gang electrical box may include any of the single gang electrical boxes as described above. Mounting feature 504 may include a clip-on feature which may allow for very little positioning and adjustment of single gang electrical box 2804, thereby allowing for quick installation. Expansion of number of devices that can connect such as changing from a single gang to a double gang electrical box can easily occur without disturbing any of the wiring. For example, an electrician wishing to change from a single gang to a double gang electrical box that is mounted in the wall would only have to cut a larger opening into the sheetrock, replace the single gang box with a double gang box and position it appropriately. This may be done without any exposure to live wires, greatly increasing the safety features of system 100 for electricians operating in the field. In an embodiment, adapter module 104 may attach to electrical box 2804 on one side such as front side 112. In such an instance, back side 124 may not be attached to electrical box 2804. Once installed in a wall or at a stud, back side 124 may be attached to electrical box 2804 at a later time or not at all.

Figure 30:
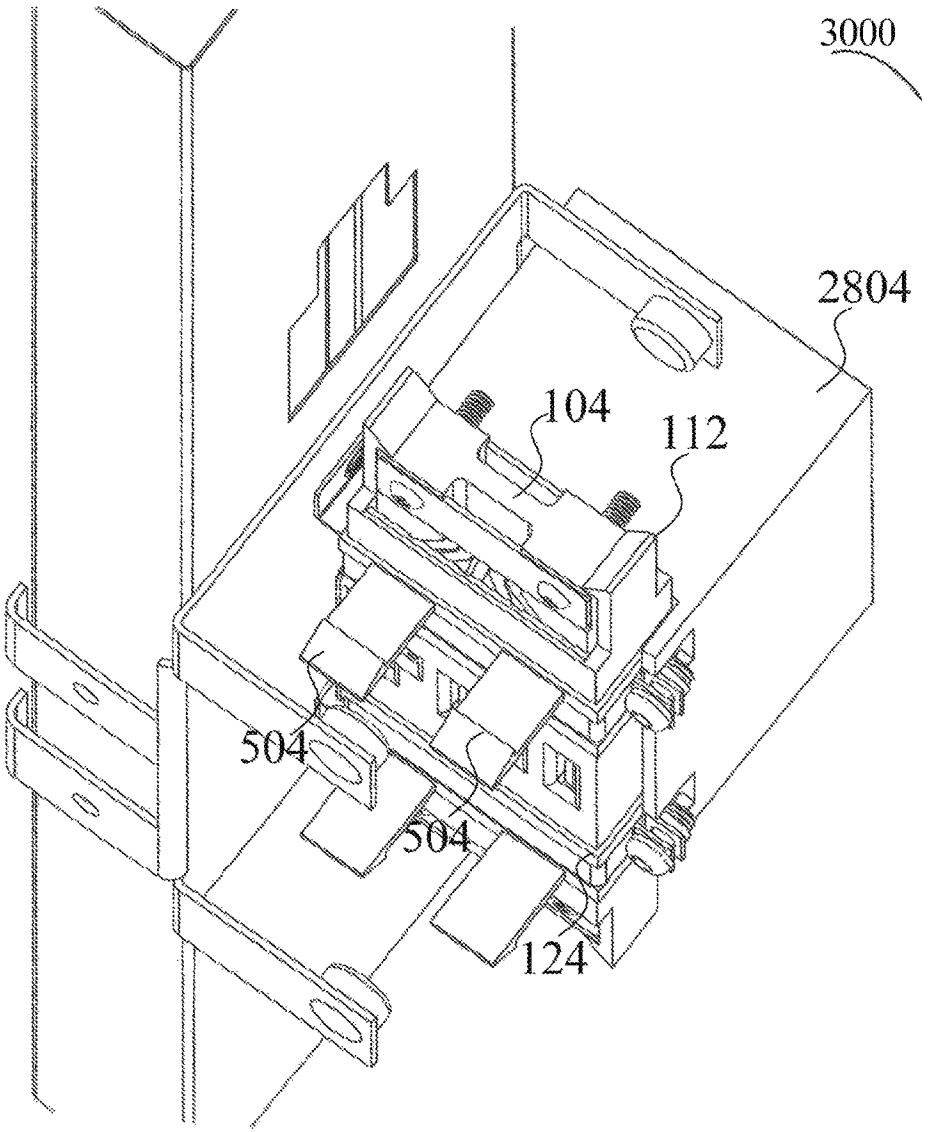
FIG. 30 is a schematic diagram illustrating an exemplary embodiment of a mount to an electrical box.

Referring now to FIG. 30, an exemplary embodiment 3000 of an electrical box mounted to system 100 on a stud is illustrated. In an embodiment, electrical box 2804 such as a single gang electrical box may be mounted to front side 112 of adapter module 104. Center mount alignment of system 100 on stud allows for electrical box 2804 to be mounted to back side 124 at a later time. In an embodiment, after installation at wall or stud electrician wishing to connect electrical box to back side 124 would only have to detect magnets on the stud mount bracket inside the wall, and then cut an opening into the sheetrock, and attach electrical box 2804 to back side 124 onto mounting feature 504. Mounting feature 504 may contain a clip-on feature that allows for electrical box 2804 to be mounted to system 100. In an embodiment, clip-on feature may include snap fit locking mechanism for joining a pair of components such as adapter module 104 and electrical box 2804. Snap mount feature may include a locking arm formed on first component, such as adapter module 104. Locking arm may include an outwardly extending projection. Second component, here electrical outlet box may include an aperture configured to receive and secure locking arm. Snap mount feature highlights yet another advantageous feature as there is no adjustment necessary as to position of electrical box. Especially useful for construction crew such as an electrician who may have numerous other tools in one's hands and may not need both hands free to install. Also saves time that would usually be necessary to adjust box and ensure proper position. This may also assist in reducing waste as no extra equipment or fasteners are necessary in order to install electrical box 2804. Snap mount feature may be built into adapter module and ensures accurate placement and alignment with electrical box. Snap mount feature contains numerous advantages as it may allow for a worker such as an electrician to operate more efficiently. This may provide advantages because currently an electrical box usually has to be screwed in place, taking up more time and resources. This also provides an advantage when switching an electrical box such as a single gang to a double gang, as old electrical box only has to be snapped out and new electrical box can be snapped in place without the use of machinery or complicated tools.

Figure 31:
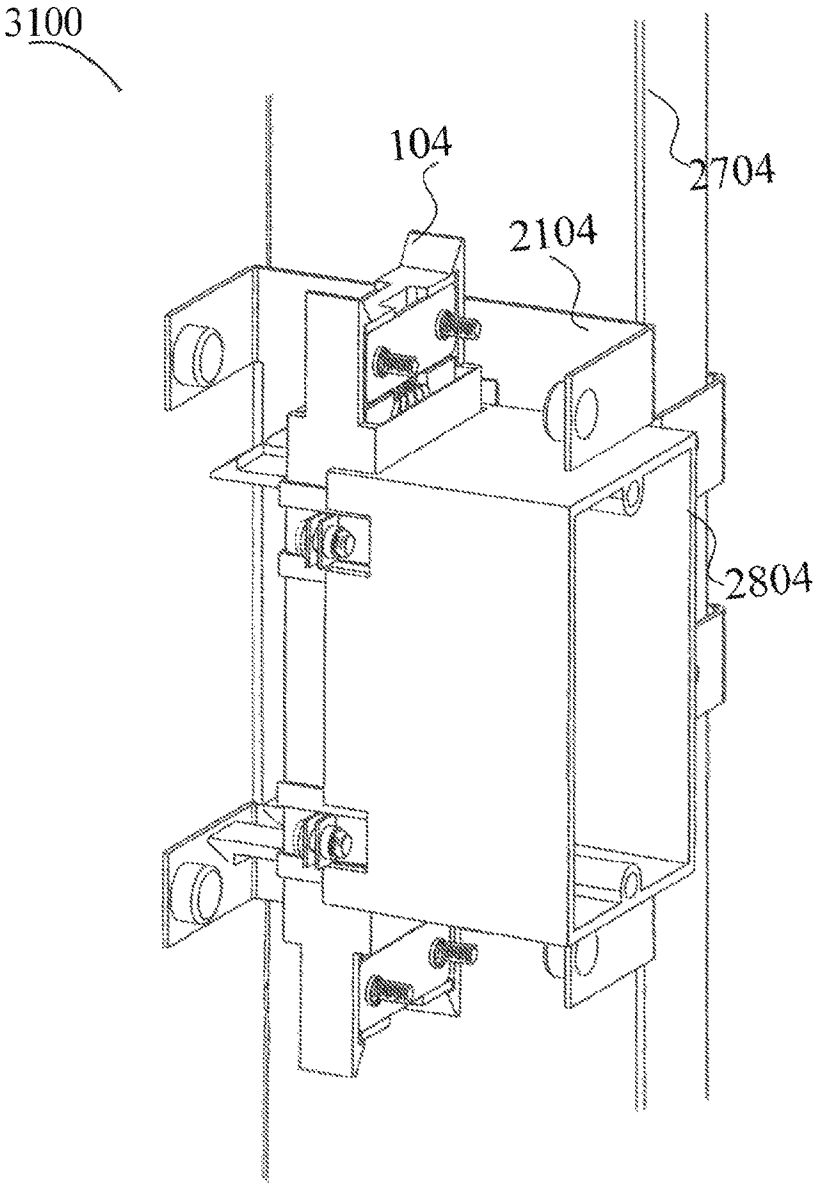
FIG. 31 is a schematic diagram illustrating an exemplary embodiment of a side view of a mount to an electrical box.

Referring now to FIG. 31, an exemplary embodiment 3100 of side view of an electrical box 2804 mounted to system 100 on a stud is illustrated. In an embodiment, center-mount position of system 100 on stud mount bracket 2104 allows for electrical box 2804 to lay flush against stud 2704, so that maximum structural support is gained from stud. The ability for electrical box 2804 to be easily inserted, with precision after wallboard is applied is a major advantage as to what is currently available. Current methods of wiring result in a system that is more difficult to make a change to, as the wiring is locked into whatever box is used, changes to current wiring methods may involve opening the wall. The ability to separate the box from the wiring in system 100, is of immense advantage to future reconfiguration of an electrical outlet, as it can be done without opening the wall. Connecting electrical box 2804 such as a single gang box to front side maintains access at plug 148 located at upper end 128 of adapter module. Back side 124 may accommodate an electrical box that may attach to back side 124 at mounting feature 504.

Figure 32:
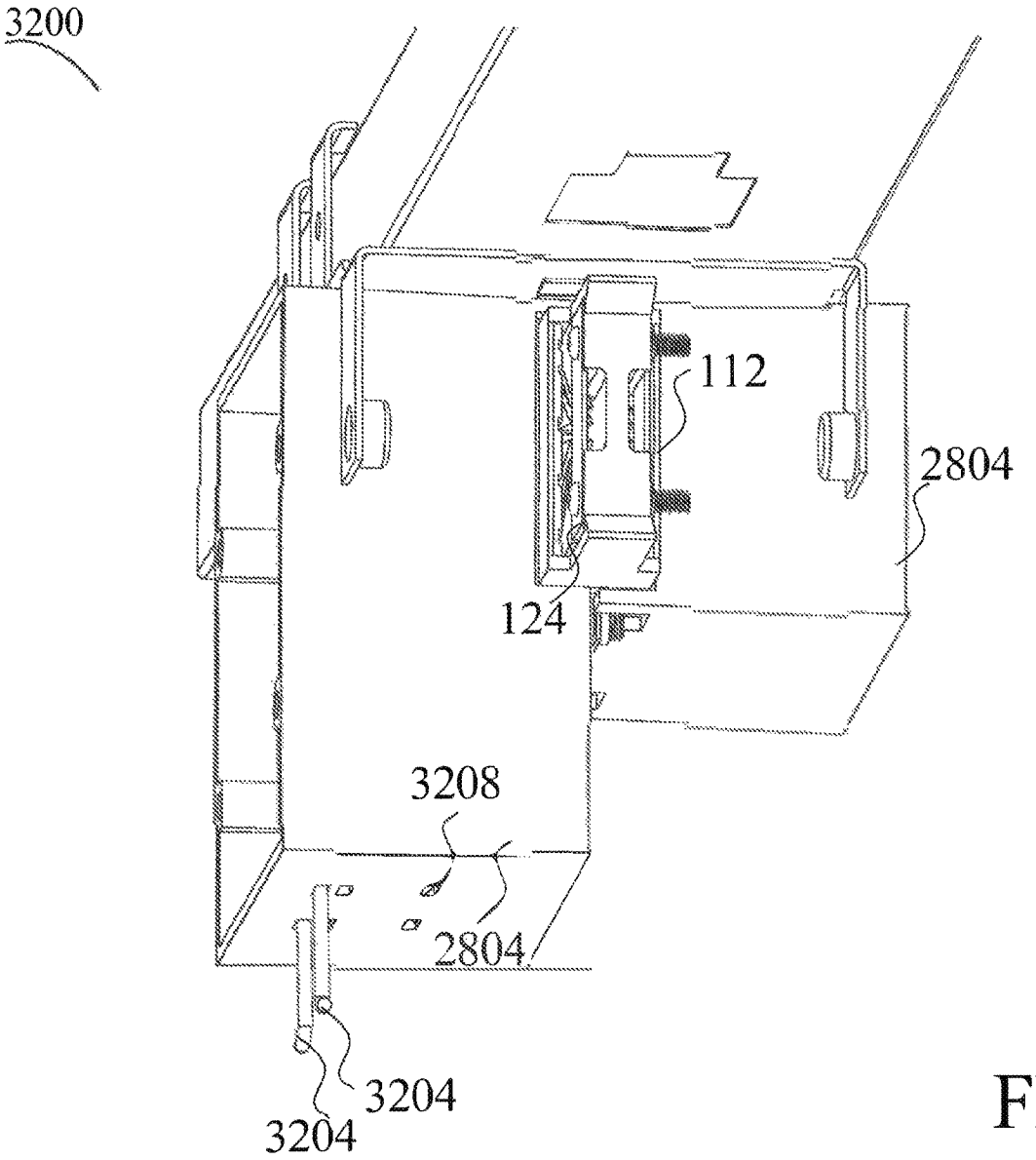
FIG. 32 is a schematic diagram illustrating an exemplary embodiment of a top view of a single gang and double gang electrical box.

Referring now to FIG. 32, an exemplary embodiment 3200 of a top view of a single gang and double gang electrical box connecting to system 100 mounted on a stud is illustrated. In an embodiment, front side 112 may connect to electrical box 2804 such as a single gang electrical box. Back side 124 may connect to electrical box 2804 such as a double gang electrical box that may contain two duplex receptacles 311011. In an embodiment, electrical box 2804 may contain at least a pin 3204. Pin 3204 may be housed within a pin opening 3208 on electrical box 2804 and may provide additional structural support to electrical box 2804. Pin opening 3208 may include a hole located on electrical box 2804 that may house pin 3204. Pin 3204 may include a fastener, for example a screw, bolt, stud, threaded fastener, carriage bolt, rivet, threaded rod, and the like. Pin may be composed of material such as steel, brass, nickel, aluminum, and the like. Pin may be covered by a protective coating to protect fastener from corrosion over time, to create a decorative finish, and/or to alter the surface properties of the base materials. Pin 3204 may be of varying length and size depending on opening located on electrical box 2804 as well as desired sheetrock depth. For example, a shallow depth to support a single gang electrical box may require a shorter pin, while a deeper depth to support a double or triple gang electrical box may require a longer pin. In yet another non-limiting example, pin length may be selected based on number of layers of sheetrock that will be applied to a wall and tailored to adjust accordingly. For example, a depth for a finish such as stone may warrant the use of a pin of a certain length as compared to a depth for a finish such as tile.

Figure 33:
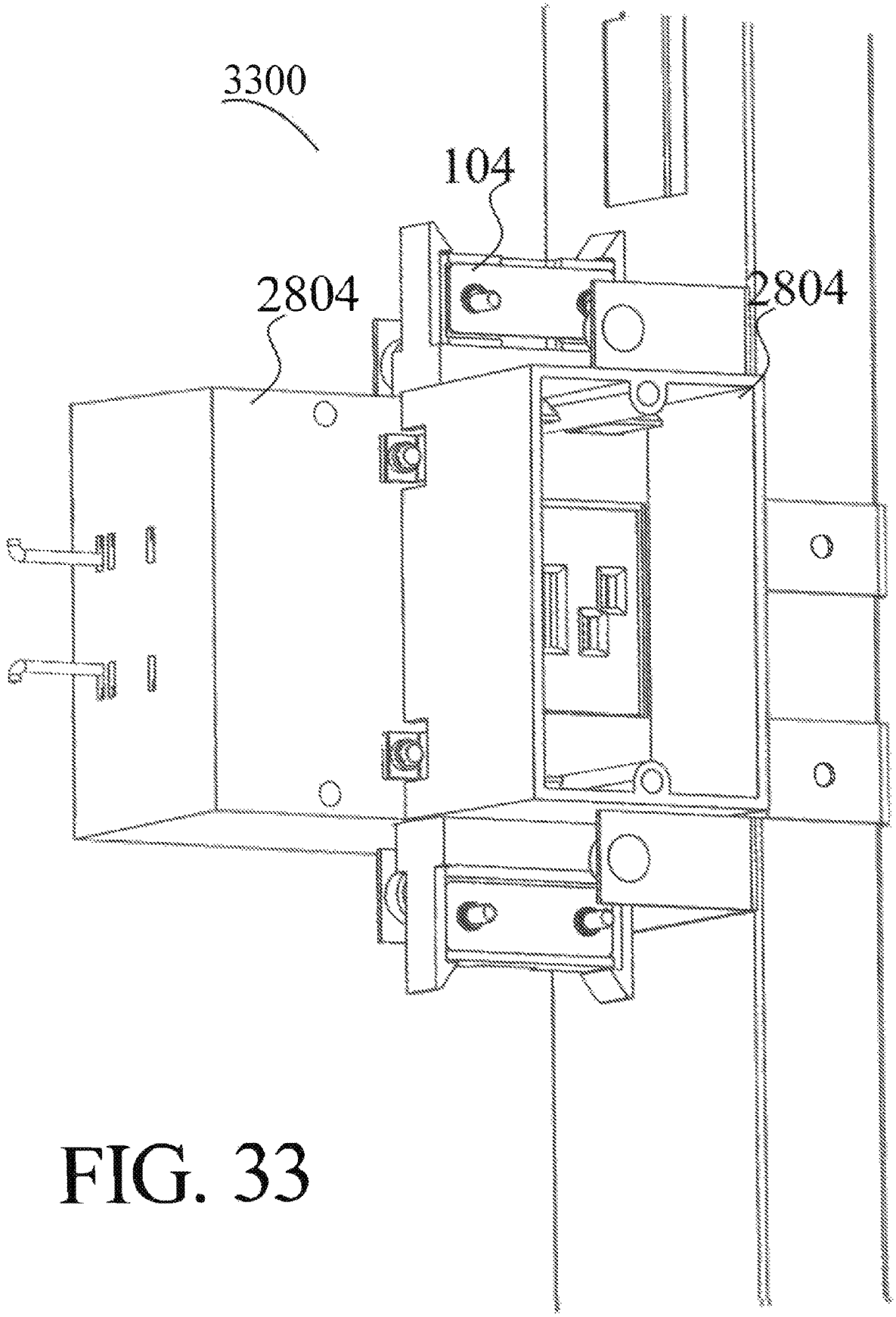
FIG. 33 is a schematic diagram illustrating an exemplary embodiment of a back view of a single gang and double gang electrical box.

Referring now to FIG. 33, an exemplary embodiment 3300 of a back-side view of a single gang and double gang electrical box connected to system 100 mounted on a stud is illustrated. In an embodiment, changes to electrical box 2804 can be performed without disturbing any wires or cables. This aids a worker by greatly reducing exposure to live wires and parts. In an embodiment, changes to electrical box 2804 can be performed by a customer who can simply un-clip a single gang electrical box 2804 and clip on a double gang electrical box, instantly doubling the number of devices that may be connected. This greatly reduces cost that the consumer would have to pay in having an electrician out to perform such a task.

Figure 34:
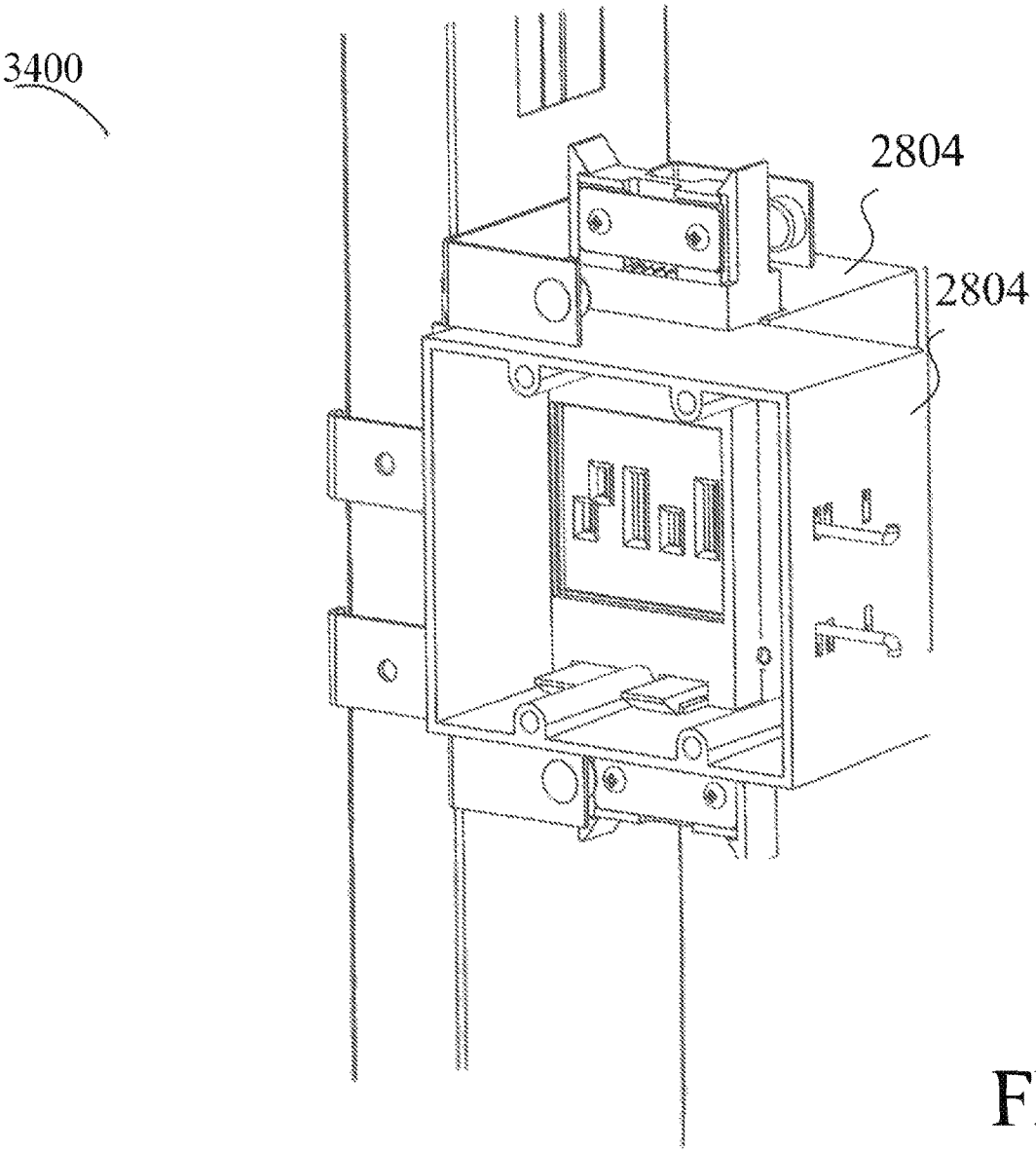
FIG. 34 is a schematic diagram illustrating an exemplary embodiment of a side view of a double gang electrical box.

Referring now to FIG. 34, an exemplary embodiment 3400 of a side view of a double gang electrical box connected to system 100 mounted to a stud is illustrated. In an embodiment, electrical box 2804 such as a double gang may include at least a pin 3204 to provide additional structural support for electrical box 2804. Pin 3204 may include any of the pins as described above in reference to FIG. 34. In an embodiment, length of pin 3204 may be chosen based on desired depth of sheetrock needed to support electrical box, as described above in more detail in FIG. 32. In an embodiment, electrical box 2804 may contain an opening 604 designed to house pin 3204.

Figure 35:
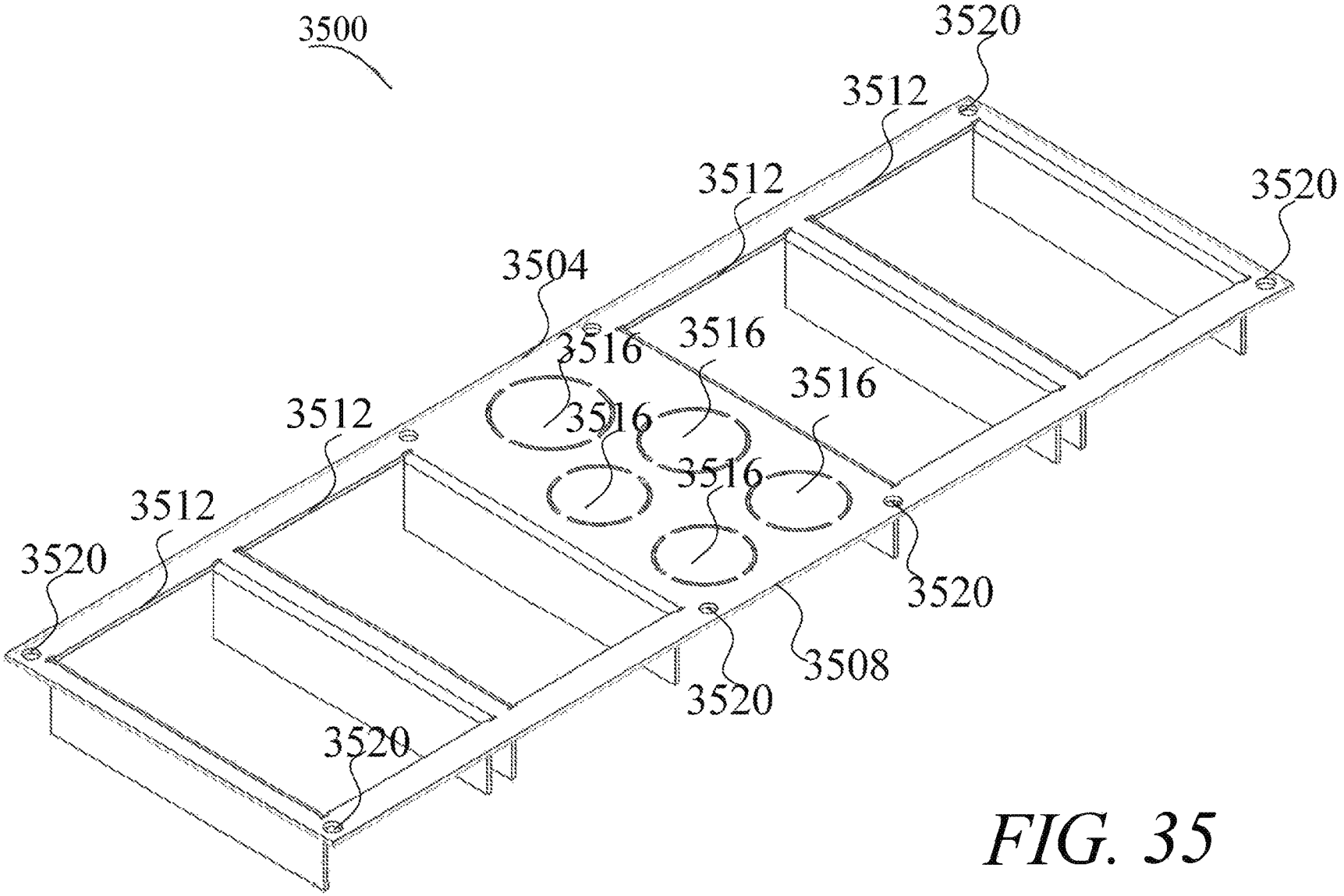
FIG. 35 is a schematic diagram illustrating an exemplary embodiment of a first side of a modular panel adapter plate.

Referring now to FIG. 35, an exemplary embodiment of a first side 3504 of modular panel adapter plate 3500 apparatus is illustrated. Modular panel adapter plate apparatus includes a first side 3504 and a second side 3508. First side 3504 contains at least a receptacle 3512 for at least a panel adapter module. Receptacle 3512 may be of a rectangular shape designed and configured to house at least a panel adapter module. Receptacle 3512 may include a cutout or hole that may house at least a panel adapter module. At least a panel adapter module may interface a cable and a circuit breaker panel. Cable may include any of the cables as described above and may be located in both the residential and commercial setting. For example, at least a panel adapter module may interface a cable located in a wall in a house, apartment building or office. Circuit breaker panel may include a component of an electrical supply system that may divide an electrical power feed into subsidiary circuits, while providing a protective fuse and/or circuit breaker for each circuit. A circuit breaker panel may contain a main switch that may control all electrical circuits. Main switch may also divert current from one wire and/or conductor to another. A beneficial feature of modular panel adapter plate apparatus is that when incorporated into a traditional circuit breaker panel, it can allow a cable with a system 100 plug installed on it, to simply plug into the circuit breaker panel, thereby greatly reducing the time between when a system 100 circuit breaker panel is delivered and when the system is ready to turn on. Currently, it is common practice to wait to connect the cables supplying the different circuits to a structure, until circuit breaker panel is installed. Connections are made on site, under challenging conditions, greatly lengthening construction projects and wasting hours. System 100 provides a safe plug and play solution for a more synchronized electrical system assembly format. In an embodiment, modular panel adapter plate may contain four receptacles, each designed to house four plugs for a total of 16 plugs contained on modular panel adapter plate as described in more detail below.

With continued reference to FIG. 35, modular panel adapter plate 3500 contains at least a receptacle 3516 for at least an electrically conductive wire. Receptacle 3516 for at least an electrically conductive wire may be designed and configured to house at least an electrically conductive wire of a particular size that may accommodate at least an electrically conductive wire. In an embodiment, modular panel adapter plate may contain a plurality of receptacles 3516. In such an instance, receptacles 3516 may be of varying size diameters to accommodate at least an electrically conductive wire of varying size. In an embodiment, a plurality of receptacles 3516 may be of the same diameter. In an embodiment, receptacle 3516 for at least an electrically conductive wire may be of a round shape. At least an electrically conductive wire may include any of the wires as described above. At least an electrically conductive wire may include for example at least an electrically conductive wire coming from a main feed such as an electric stove, water heater, dryer, and/or car charger. This may offer an advantage, as modular panel adapter plate is able to accommodate wiring for system 100 as described above, as well as for systems that have not been converted over to system 100. For example, an office building that has a mix of old wiring systems may connect to modular panel adapter plate 3500 at receptacle 3516 while new wiring systems such as those illustrated in FIGS. 1-34 may connect to modular panel adapter plate 3500 at receptacle 3512. Modular panel adapter plate 3500 may provide an economical way to allow updates to office buildings and/or homes to system 100 over time, so that the two systems can occur simultaneously.

With continued reference to FIG. 35, modular panel adapter plate 3500 may contain at least an opening 3520. At least an opening may include a hole which may house at least a fastener to allow modular panel adapter plate 3500 to be mounted to a structure such as a circuit breaker panel back box, wall and/or stud. Fastener may include any of the fasteners as described above. This may include for example, a screw, bolt, and the like. Fastener may be of varying length to accommodate different depths needed to mount modular panel adapter plate 3500 to circuit breaker panel, wall and/or stud.

Figure 36:
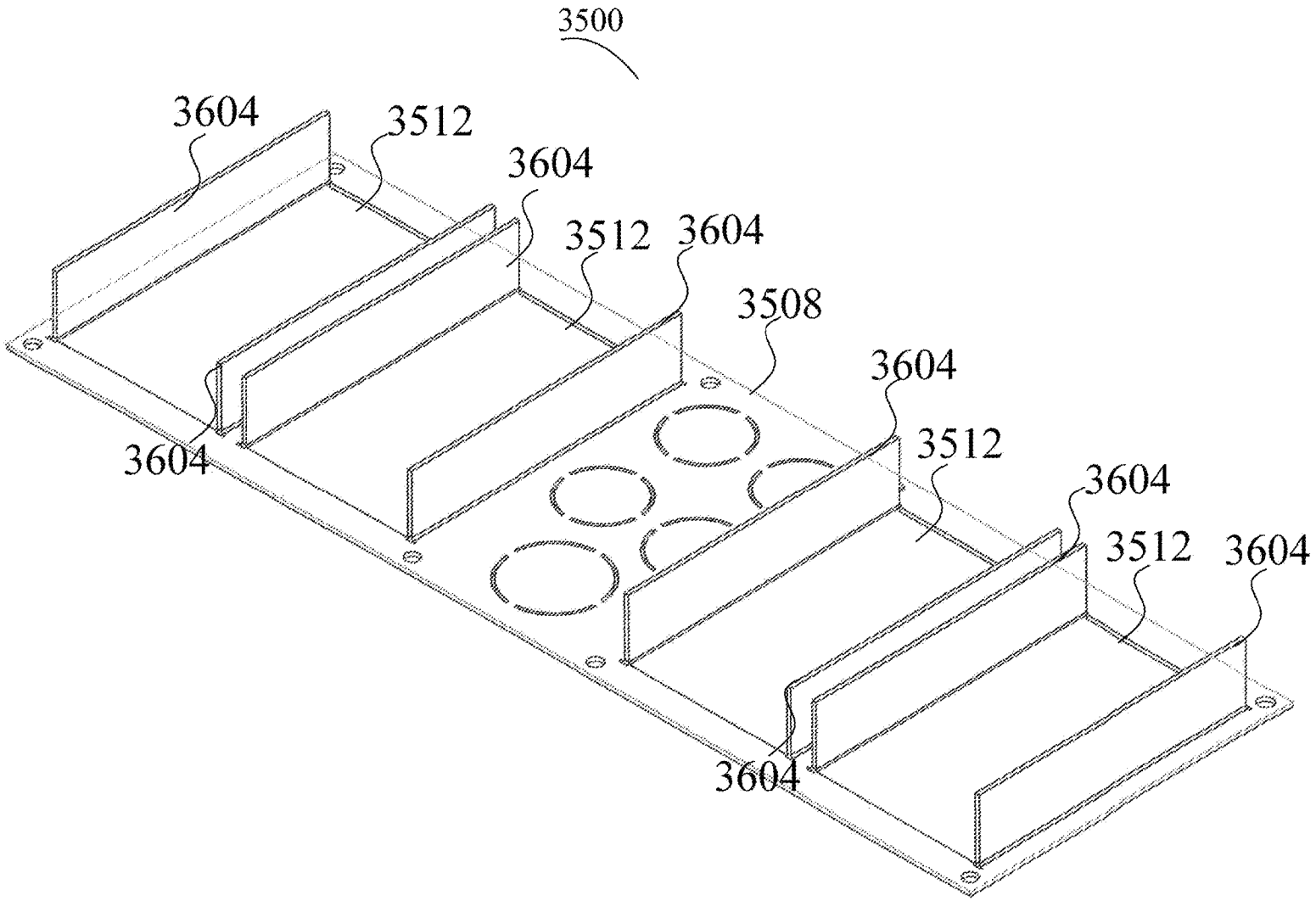
FIG. 36 is a schematic diagram illustrating an exemplary embodiment of a second side of a module panel adapter plate.

Referring now to FIG. 36, an exemplary embodiment of a second side 3504 of modular panel adapter plate 3500 apparatus is illustrated. Receptacle 3512 for at least a panel adapter module located on second side 3508 may include at least a protrusion 3604 designed to interface with panel adapter module. In an embodiment, panel adapter module may include an aperture configured to receive protrusion 3604. This highlights yet another feature as there is no adjustment necessary as to position of panel adapter module. This may be especially useful for construction crew such as an electrician who may have numerous other tools in one's hands and may not need both hands free to install. This may also save time that would usually be necessary to adjust panel adapter module and ensure proper position. This may also assist in reducing waste as no extra equipment or fasteners are necessary in order to install panel adapter module.

Figure 37:
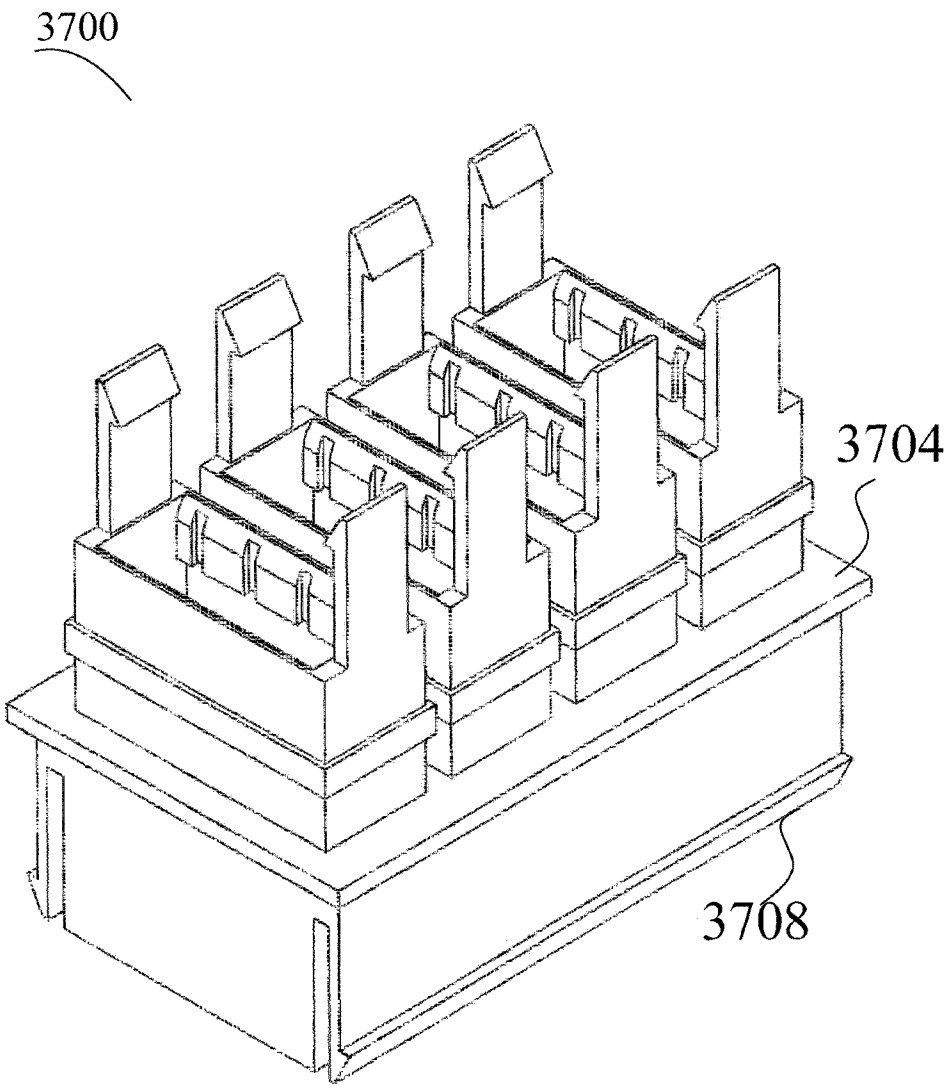
FIG. 37 is a schematic diagram illustrating an exemplary embodiment of a first side of a panel adapter module.

Referring now to FIG. 37, an exemplary embodiment 3700 of first side of a panel adapter module is illustrated. Panel adapter module may interface cables. Panel adapter module may be designed and configured to interface plug 148 connected to at least a cable. Panel adapter module may be designed and configured to interface plug 148 connected to adapter module 104. In an embodiment, panel adapter module may interface four plugs. This may include a beneficial feature as cable wired in a house or office can be terminated onto plug 148 in readiness for connection, before a plug in ready circuit breaker panel is delivered, thereby saving time between installation and use. This may also be of benefit as it may reduce the number of visits by an electrician to an office or house to perform installations. Future updates to the circuit breaker panel can be achieved with greater ease, allowing technological advancements in circuit protection to be incorporated with increased ease. Panel adapter module includes a first side 3704 and a second side 3708.

Figure 38:
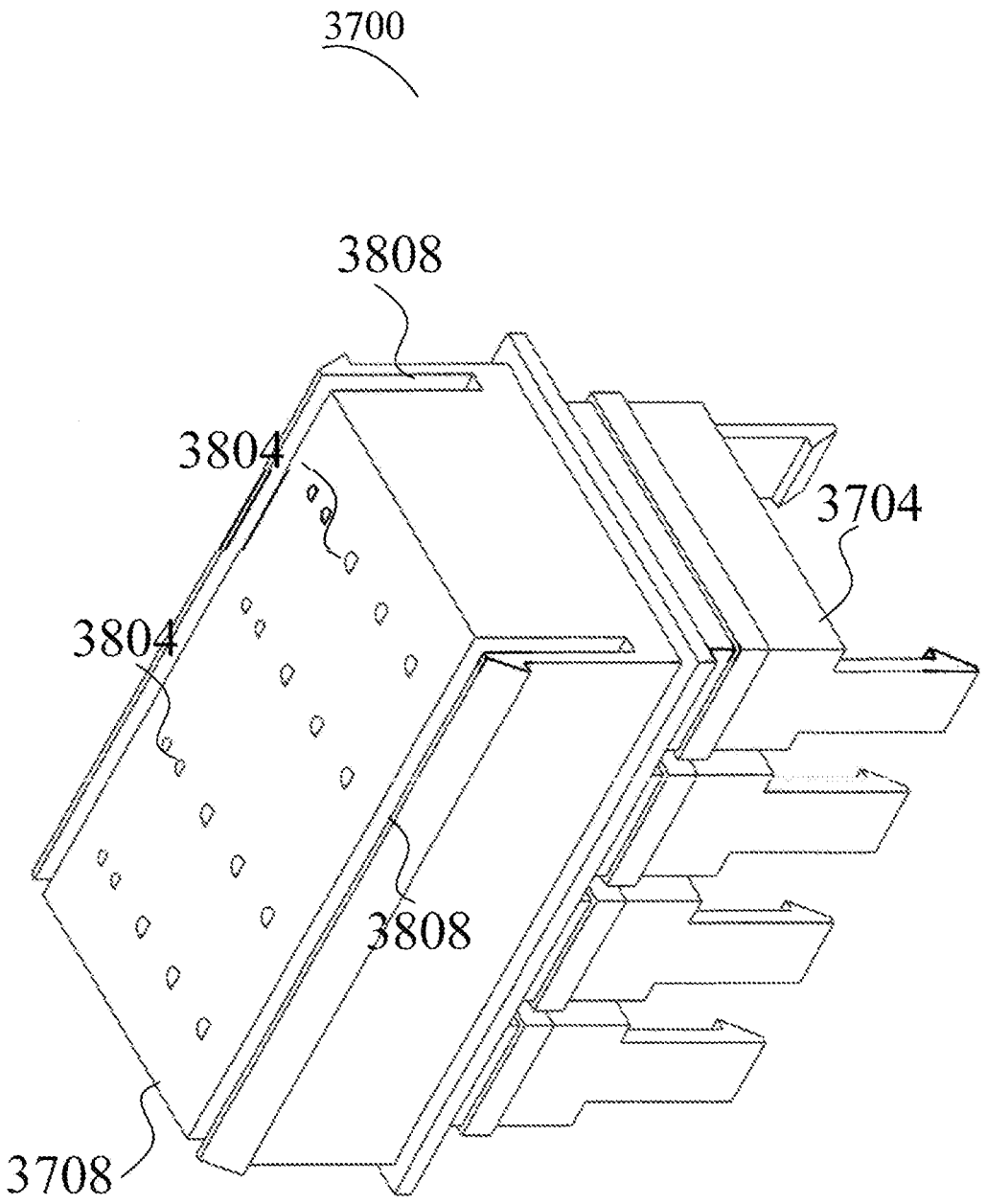
FIG. 38 is a schematic diagram illustrating an exemplary embodiment of a second side of a panel adapter module.

Referring now to FIG. 38, an exemplary embodiment 3800 of second side 3708 of panel adapter module is illustrated. Second side 3708 may include at least an opening 3804. Opening 3804 may include a hole designed and configured to house at least an electrically conductive wire. In an embodiment, electrically conductive wire may include wire attached to plug 148 located on adapter module 104. This may include for example a hot wire, neutral wire, ground wire, and/or communication wire as described in more detail above. At least an electrically conductive wire may pass through opening 3804 to connect with a circuit breaker panel. Circuit breaker panel may include any of the circuit breaker panels as described in more detail above. This may assist in streamlining construction production by reducing the amount of assembly performed in the often chaotic environment of a construction site. Panel adapter module may include a slot 3808 configured to receive protrusion 3604 on second side of modular panel adapter plate. This may be of benefit as there is no adjustment necessary as to position of panel adapter module. This may also assist a consumer looking to easily wire a house as it creates a slide and press design that can be installed without the need for special tools or knowledge. This may be especially useful for construction crew such as an electrician who may have numerous other tools in one's hands and may not need both hands free to install.

Figure 39:
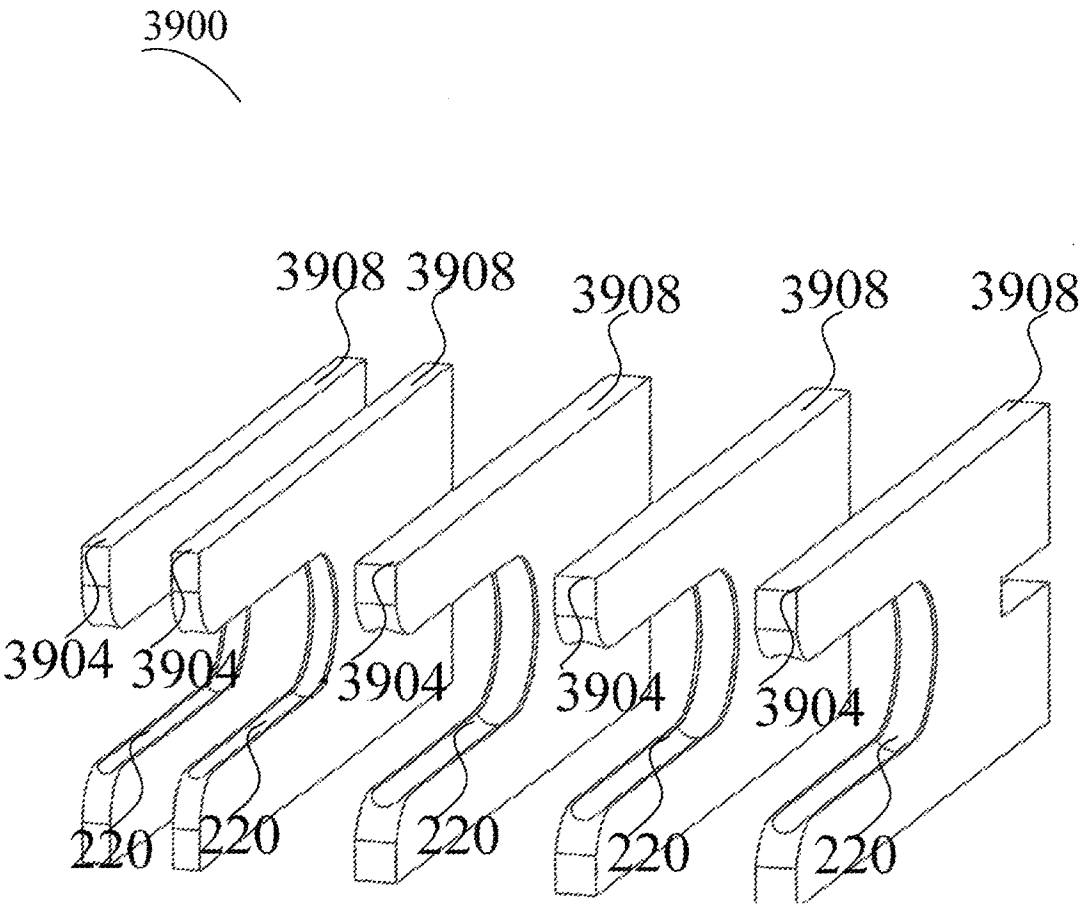
FIG. 39 is a schematic diagram illustrating an exemplary embodiment of a panel adapter module mini-busbar.

Referring now to FIG. 39, an exemplary embodiment 3900 of a panel adapter module mini-busbar is illustrated. Panel adapter module may contain at least a mini-busbar. Mini-busbar may include a first end 3904 and a second end 3908. In an embodiment, first end 3904 may contain a double jaw 220 designed and configured to electrically connect with at least a plug 148. Double jaw 220 may include two rounded curved edges that increase surface area to allow for greater transmission of power. In an embodiment, second end 3908 may not contain a double jaw 220. In such an instance, second end 3908 may be fused to a stranded conductor and directed into a circuit breaker panel for connection. Circuit breaker panel may include any of the circuit breaker panels as described above in more detail. In an embodiment, a plurality of mini-bus may be contained within panel adapter module. Mini-busbars may be stacked and housed within body of panel adapter module.

Figure 40:
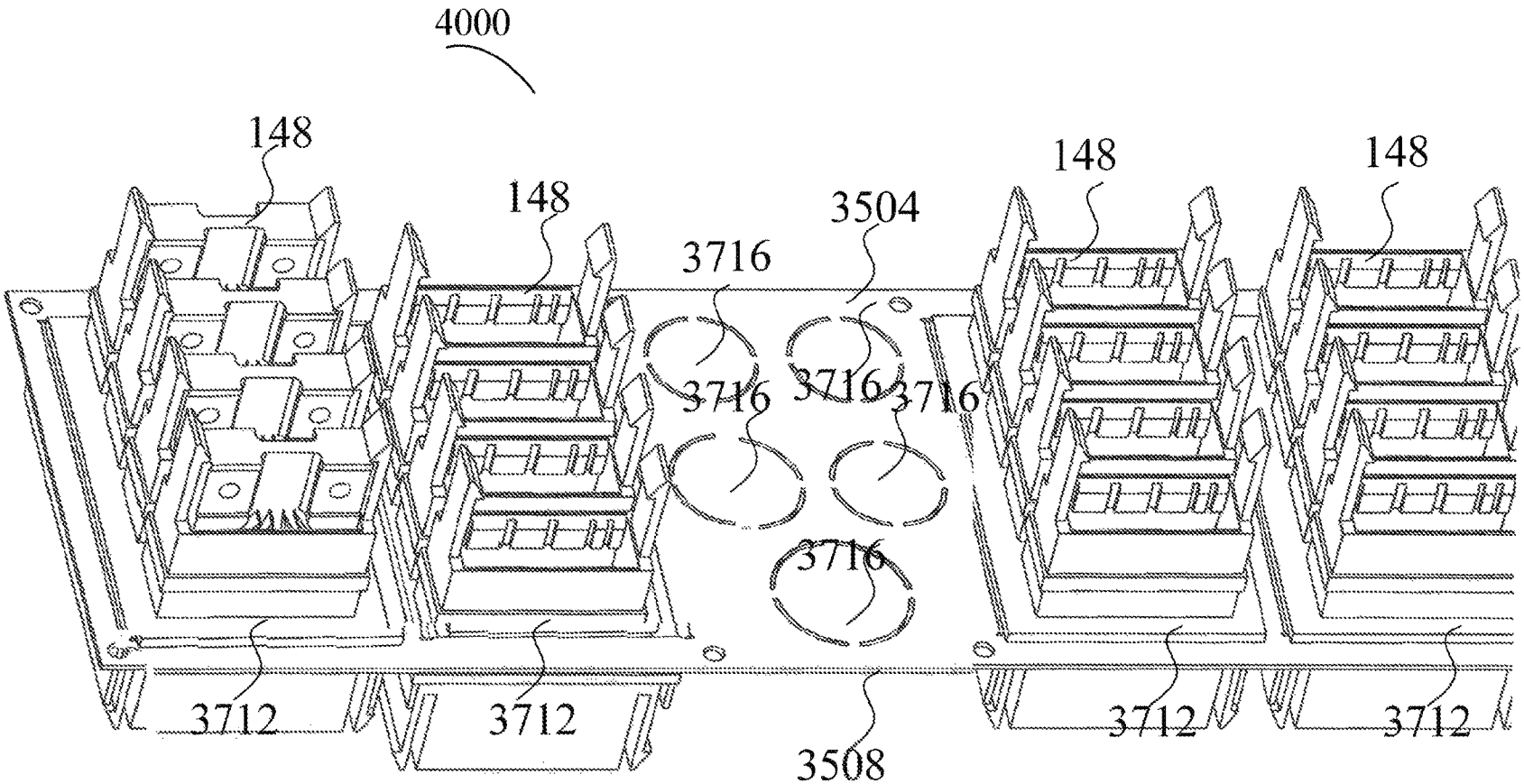
FIG. 40 is a schematic diagram illustrating an exemplary embodiment of a modular panel adapter plate containing an adapter module.

Referring now to FIG. 40, an exemplary embodiment 4000 of modular panel adapter plate containing an adapter module 104 is illustrated. In an embodiment, modular panel adapter plate may contain four receptacles 3712 for panel adapter module. Panel adapter module may be designed and configured to interface four plugs 148 attached to adapter module 104, for a total of 16 plugs housed within modular panel adapter plate. In an embodiment, modular panel adapter plate may contain five knock out receptacles 3716 for cable 3716, which may interface cables that may not contain system 100. A significant advantage of modular panel adapter plate is that it may be utilized to accept wiring systems such as system 100 that are updated to contain plugs that contain communication wires, as well as wires that have not been updated to such a system. This may allow for a home or office to be gradually updated to system 100 over time. Panel adapter plate can made in varying combinations of receptacles 3712 and 3716, to reflect the customer's needs.

Figure 41:
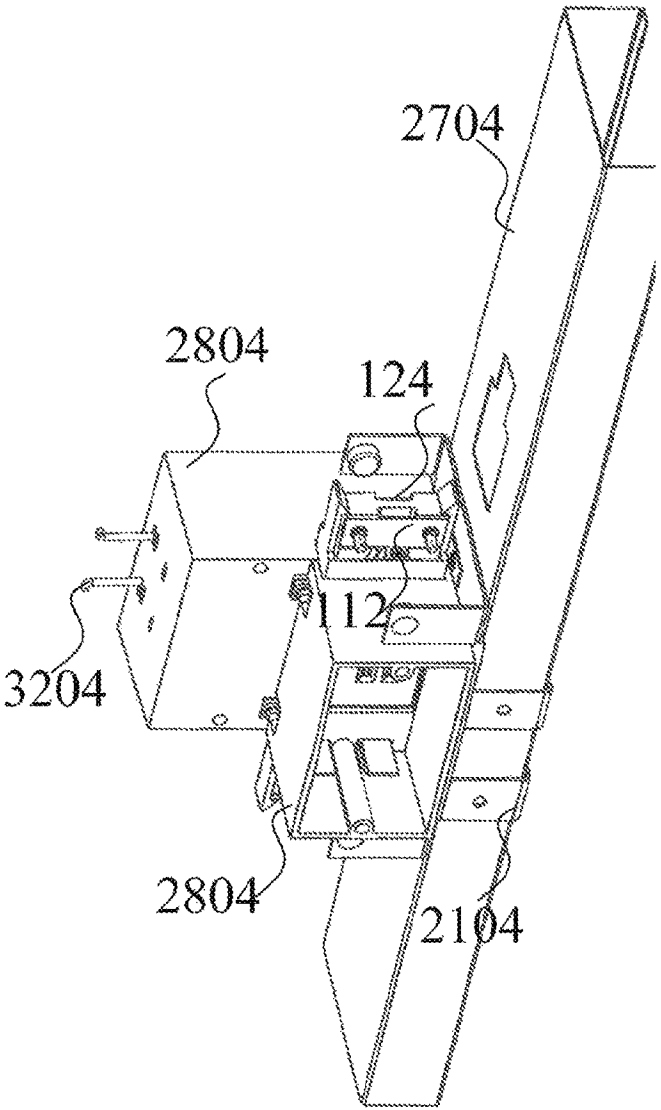
FIG. 41 is a schematic diagram illustrating an exemplary embodiment of a smart wiring system.
Figure 41:
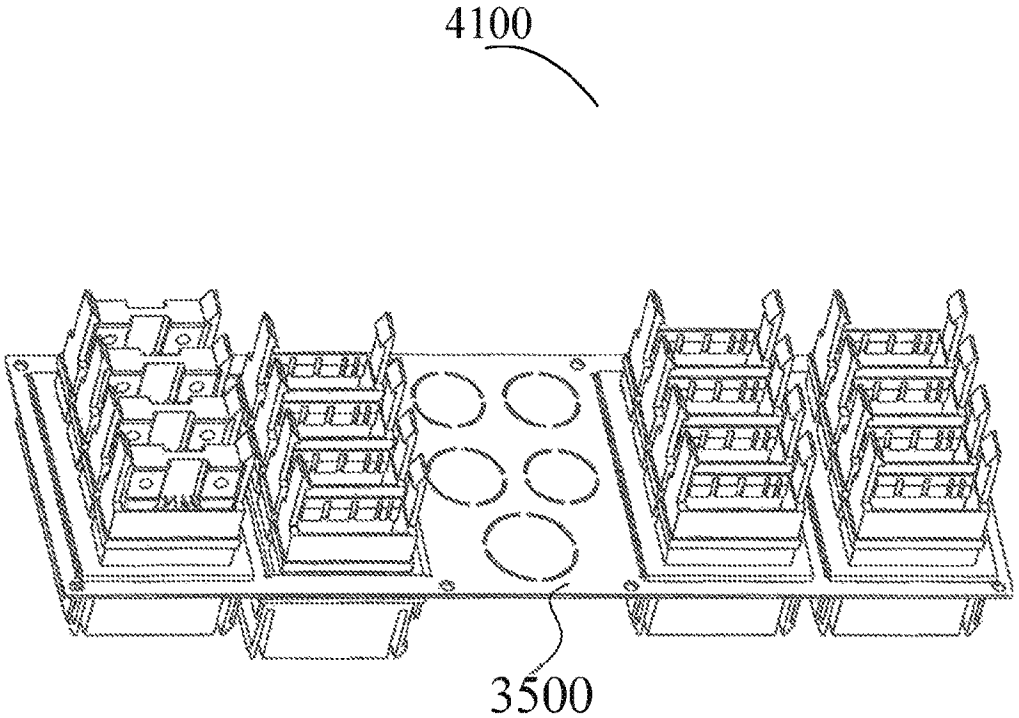

Referring now to FIG. 41, an exemplary embodiment of a smart wiring system 4100 is illustrated. Smart wiring system may include a more compact and easier way to wire a residential or commercial space while still allowing for adjustments to be made over time. Smart wiring system includes system 100 mounted to a stud by a stud mount bracket. A single gang electrical box is mounted to front side of adapter module. A double gang electrical box is mounted to back side of adapter module. Double gang electrical box may contain an opening housing a pin that may provide additional support for double gang electrical box against wall or stud. Pin may be of varying length depending on desired depth into wall or stud. System 100 may connect with modular panel adapter plate apparatus at panel adapter module. In an embodiment, plug 148 contained on adapter module 104 may interface with panel adapter module. Modular panel adapter plate apparatus may be configured to contain a receptacle 3716 for cable that may not utilize system 100. This may allow for systems to be updated to a wiring system such as system 100 over time.

Figure 42:
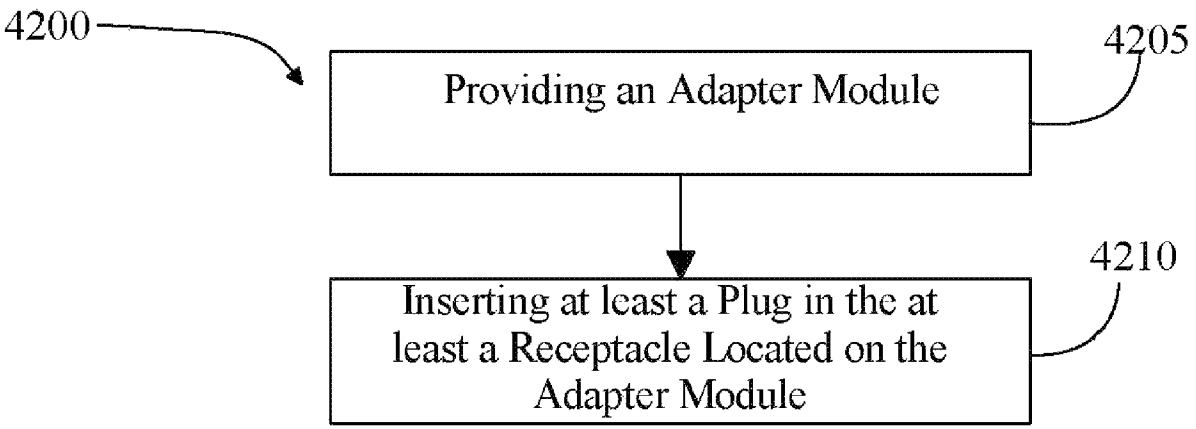
FIG. 42 is a block diagram illustrating a method of manufacturing a modular plug-in bus power wiring system for electrical connections.

Referring now to FIG. 42, an exemplary embodiment of a method 4200 of manufacturing a modular plug-in bus power wiring system for electrical connections is illustrated. At step 4205 an adapter module 104 is provided. An adapter module 104 includes at least a housing 108, wherein the housing 108 includes a front side 112, the front side 112 including at least an electrical connector 116. The housing 108 includes a back side 124. The housing 108 includes an upper end 128 and a lower end 136, wherein at least one of the upper and the lower end contain at least a receptacle 132 containing a conductive element linked to the at least an electrical connector. The housing 108 includes a first lateral side, the first lateral side 140 connecting the front side 112 and the back side 124. The housing 108 includes a second lateral side 144, the second lateral side 144 connecting the front side 112 and the back side 124.

With continued reference to FIG. 42, at step 4210, at least a plug is inserted in the at least a receptacle located on the adapter module, wherein the at least a plug is connected to at least a cable that includes at least an electrically conductive wire. The at least a plug a ventral surface, a dorsal surface, a first side surface connecting the ventral surface and the dorsal surface, and a second side connecting the ventral surface and the dorsal surface, wherein the ventral surface includes a ventral lower end containing a groove housing the at least a cable and connected to at least a channel housing the at least an electrically conductive wire and a ventral upper end, wherein insertion of the plug into the at least a receptacle causes the at least a wire in the at least a channel to come into electrical connection with the conductive element.

Figure 43:
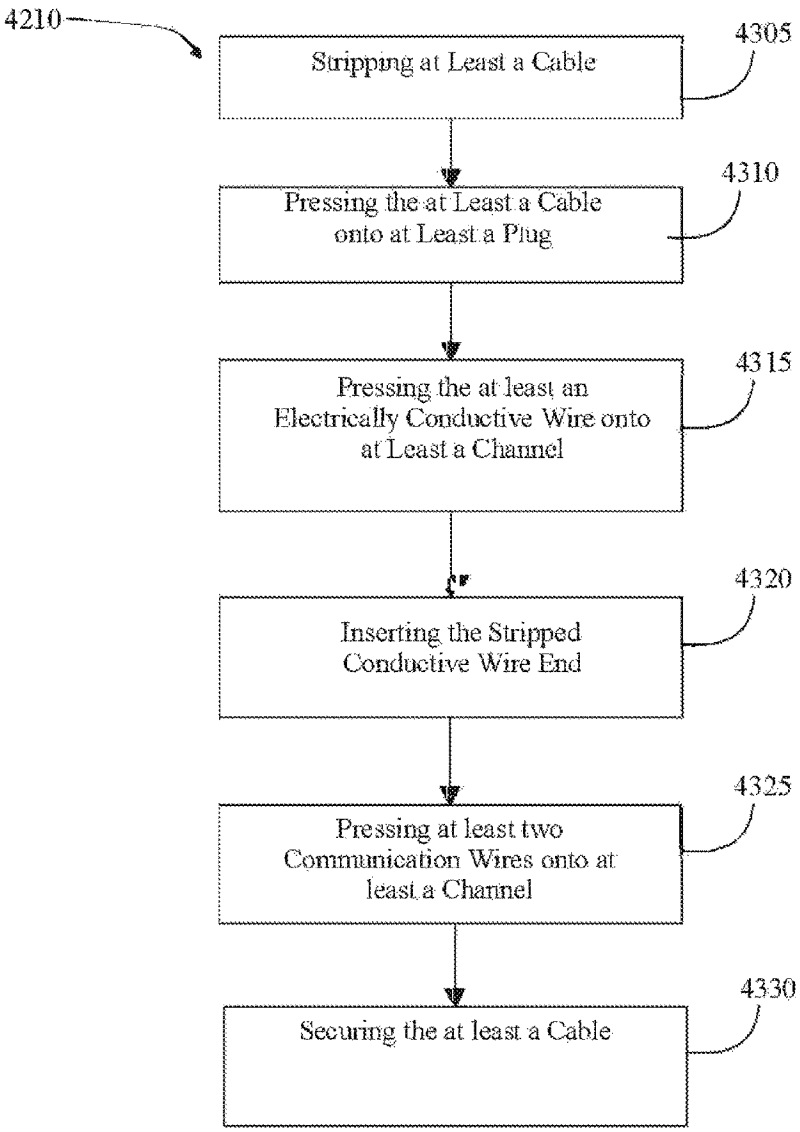
FIG. 43 is a block diagram of a method of connecting a plug to an end of an adapter module.

Referring now to FIG. 43, an exemplary embodiment of a method 4210 of inserting at least a plug to at least an end of the adapter module is illustrated. At step 4305 at least a cable is stripped to expose at least an electrically conductive wire end. At least a cable may include any of the cables as described above in FIGS. 1-42. Stripping may include inserting terminal end of a cable into a handheld stripping and forming tool containing an appropriately sized barrel or jaw. Cable may be inserted into the crimp barrel with the end of the wire flush with a stopper providing correct gauging of wire exposer to achieve optimum connection. Handles of the crimp tool may then be used to compress and reshape the terminal end until outer material has been stripped and shaped to allow easy placement into grooves over surface of plug 104. Outer material may include for example, thermoplastic sheath and/or a conductive shield. Stripping and shape forming may also occur by electric handheld crimping tools such as battery-powered crimpers that may allow for consistent crimps to be generated. Crimping may occur through a benchtop manual crimping tool, a benchtop electric crimping tool, a pneumatic mountable crimping tool, a hydraulic handheld crimping tool and the like. In an embodiment, crimping of a cable may expose three wires. Two of the wires may be covered with plastic insulation and the third may be a bare copper conductor. One wire may be a hot wire, providing a 120 volts AC power, one wire may be a neutral wire providing a return path for the current provided by the hot wire and may be connected to an earth ground, and one wire may be a ground wire such as a bare copper wire that may be connected to an earth ground.

With continued reference to FIG. 43, at step 4310 the at least a cable is pressed onto at least a plug containing a groove designed and configured to house at least a cable. In an embodiment, groove may be located on ventral lower end of at least a plug. In an embodiment, groove may be located on dorsal lower end of at least a plug. Plug may include any of the plugs as described in FIGS. 1-43. Groove may include any of the grooves as described above in FIGS. 1-43. Groove may include an indentation that cable may fit within, allowing for cable to be pressed into plug by handheld crimp tool. Groove may be designed and configured to house cable. In an embodiment, cable may be pressed into groove by a machine, such as on an assembly line.

With continued reference to FIG. 43, at step 4315 the at least an electrically conductive wire is pressed onto at least a channel designed and configured to house the at least an electrically conductive wire on the at least a plug. Plug may include any of the plugs as described above in FIGS. 1-43. Channel may include an indentation that wire may fit within, allowing for wire to be pressed into plug by hand held tool. Channel may be designed and configured to house wire. In an embodiment, wire may be pressed into channel by a machine, such as on an assembly line.

With continued reference to FIG. 43, at step 4320, stripped end of at least an electrically conductive wire end may be inserted into at least an electrically conductive wire receptacle located on the at least a plug. In an embodiment, stripped end of at least an electrically conductive wire may be inserted into channel receptacle 904 located on dorsal surface 172 of at least a plug 148 as illustrated in FIG. 10. In an embodiment, at least a plug 148 may contain at least a groove on dorsal and ventral surface of at least a plug 148. In such an instance, stripped end of at least an electrically conductive wire end may be doubled back forming a loop and inserted into base of channel 164 as illustrated in FIGS. 13-14.

With continued reference to FIG. 43, at step 4325 at least two communication wires may be pressed onto at least a channel designed and configured to house the at least a wire. Channel may include any of the channels as described above in FIGS. 1-43. At least a wire may include any of the wires as described above and may include power transmission wire and/or communication wires. Communication wires may send and receive computer data, television and sound data, telemechanical data, telephone data, photograph data and the like. Communication wire may include transmission mediums that may include optical fiber, coaxial conductors, copper conductors, and/or twisted wire pairs. Communication wires may include wires that may be utilized to control lighting, climate, entertainment systems, appliances, home security, building access, alarm systems as described in more detail above. In an embodiment, at least a channel may be designed and configured to house communication wire whereby communication wire may be pressed into channel by hand. In yet another non-limiting example, communication wire may be pressed onto a channel by a machine, such as on an assembly line.

With continued reference to FIG. 43, at step 4330 the at least a cable is secured with a plate and fastener on the at least a plug. Plate and fastener may include any of the plate and fasteners as described above in FIGS. 1-43. Securing may include inserting fastener through an opening located on plate and plug and tightening fastener with a tool such as a screw driver. In an embodiment, fastener may be secured onto plate and plug by a machine, such as on an assembly line.

What is claimed is:

1. A modular panel adapter system for electrical connections, the system comprising:

a modular panel adapter plate, the modular panel adapter plate comprising:

a first side, wherein the first side contains at least a receptacle containing an opening configured to house at least a panel adapter module, the at least a panel adapter module configured to interface with at least a cable; and a second side, wherein the second side contains at least a protrusion configured to interface with the at least a panel adapter module; and the at least a panel adapter module, wherein the at least a panel adapter module is configured to interface with the modular panel adapter plate and further comprising:

a panel adapter module front side, the panel adapter module front side configured to house at least a plug, wherein the at least a plug is connected to the at least a cable that includes at least an electrically conductive wire; and a panel adapter module back side, the panel adapter module back side containing at least an opening, the at least an opening configured to house the at least an electrically conductive wire located on the at least a plug, and at least a slot configured to interface with the at least a protrusion located on the second side on the modular panel adapter plate, and wherein the slot is located on a first side of the at least an opening, and the at least a second slot is located on a second side of the at least an opening; and at least a mini-busbar configured to interface with the at least a plug, the at least a mini-busbar further configured to aid in power distribution.

2. A modular panel adapter system for electrical connections, the system comprising:

a modular panel adapter plate, the modular panel adapter plate comprising:

a first side, wherein the first side contains at least a receptacle containing an opening configured to house at least a panel adapter module, the at least a panel adapter module configured to interface with at least a cable; and a second side, wherein the second side contains at least a protrusion configured to interface with the at least a panel adapter module; and the at least a panel adapter module, wherein the at least a panel adapter module is configured to interface with the modular panel adapter plate and further comprising:

a panel adapter module front side, the panel adapter module front side configured to house at least a plug, wherein the at least a plug is connected to the at least a cable that includes at least an electrically conductive wire; and a panel adapter module back side, the panel adapter module back side containing at least an opening, the at least an opening configured to house the at least an electrically conductive wire located on the at least a plug, and a slot configured to interface with the at least a protrusion located on the second side on the modular panel adapter plate.

3. The system of claim 2, wherein the modular panel adapter plate is further configured to interface a circuit breaker panel containing a component of an electrical supply system.

4. The system of claim 2, wherein the opening configured to house the at least a panel adapter module connects the first side to the second side.

5. The system of claim 2, wherein the at least a receptacle further comprises of four sides.

6. The system of claim 5, wherein the receptacle comprises of a rectangular shape.

7. The system of claim 5, wherein the at least a protrusion configured to interface with the at least a panel adapter module is located on opposite sides of the at least a receptacle.

8. The system of claim 2, wherein the at least an electrically conductive wire further comprises at least a communication wire.

9. The system of claim 2, wherein the at least an electrically conductive wire further comprises at least a power transmission wire.

10. The system of claim 2, wherein the modular panel adapter plate further comprises at least an opening, the at least an opening configured to house a fastener and wherein the at least an opening is configured to mount the modular panel adapter plate to a structure.

11. The system of claim 10, wherein the at least an opening is located on one of the sides of the at least a receptacle.

12. The system of claim 2, wherein the at least an electrically conductive wire housed within the at least an opening located on the back side of the at least a panel adapter module is configured to connect with a circuit breaker panel containing a component of an electrical supply system.

13. The system of claim 2, wherein the at least a panel adapter module further comprises at least a mini-busbar containing a first end and a second end and configured to aid in power distribution, wherein the first end is configured to interact with the at least a plug housed within the panel adapter module front side.

14. The system of claim 13, wherein the first end further comprises a double jaw configured to electrically connect with the at least a plug.

15. The system of claim 13, wherein the second end further comprises a double jaw configured to electrically connect with the at least a plug.

16. The system of claim 13, wherein the second end is further configured to fuse to a stranded conductor and interface with a circuit breaker containing a component of an electrical supply system.

17. The system of claim 16, wherein the second end is fused to the stranded conductor.

18. A method of manufacturing a modular panel adapter system for electrical connections, the method comprising:

providing a modular panel adapter plate, the modular panel adapter plate comprising:

a first side, wherein the first side contains at least a receptacle containing an opening configured to house at least a panel adapter module, the at least a panel adapter module configured to interface with at least a cable; and a second side, wherein the second side contains at least a protrusion configured to interface with the at least a panel adapter module; and inserting the at least a panel adapter module into the at least a receptacle, wherein the at least a panel adapter module further comprises:

a panel adapter module front side, the panel adapter module front side configured to house at least a plug, wherein the at least a plug is connected to at least a cable that includes at least an electrically conductive wire; and a panel adapter module back side, the panel adapter module back side containing at least an opening, the at least an opening configured to house the at least an electrically conductive wire located on the at least a plug, and a slot configured to interface with the at least a protrusion located on the second side on the modular panel adapter plate.

* * * * *